US012779295B2

(12) United States Patent
Nicolette et al.

(10) Patent No.: US 12,779,295 B2
(45) **Date of Patent: *Nov. 3, 2026**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Michael R. Nicolette, Scottsdale, AZ (US); Bradley D. Schweigert, Cave Creek, AZ (US); Daniel C. Kirtley, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/304,872

(22) Filed: Aug. 20, 2025

(65) Prior Publication Data

US 2025/0387676 A1 Dec. 25, 2025

Related U.S. Application Data

(63) Continuation of application No. 19/227,663, filed on Jun. 4, 2025, now Pat. No. 12,420,152, which is a continuation of application No. 19/093,449, filed on Mar. 28, 2025, now Pat. No. 12,350,559, which is a continuation-in-part of application No. 19/064,989, filed on Feb. 27, 2025, now Pat. No. 12,377,325, which is a continuation-in-part of application No. 18/953,266, filed on Nov. 20, 2024, now Pat. No. 12,257,485, which is a continuation of application No. 18/903,190, filed on Oct. 1, 2024, now Pat. No. 12,194,351, which is a continuation-in-part of (Continued)

(51) Int. Cl.
*A63B 53/04* (2015.01)
*A63B 60/54* (2015.01)

(52) U.S. Cl.
CPC .. *A63B 53/0475* (2013.01); *A63B 2053/0479* (2013.01); *A63B 2053/0491* (2013.01); *A63B 60/54* (2015.10); *A63B 2209/00* (2013.01)

(58) Field of Classification Search
CPC ..... A63B 53/0475; A63B 2053/0479; A63B 2209/00; A63B 60/54; A63B 2053/0491
USPC ..... 473/324–350, 287–292
See application file for complete search history.

(56) References Cited

U.S. PATENT DOCUMENTS 4,754,977 A 7/1988 Sahm
6,077,171 A 6/2000 Yoneyama
(Continued)

*Primary Examiner* — Sebastiano Passaniti

(57) ABSTRACT

Embodiments of golf club heads, golf clubs, and methods to manufacture golf club heads and golf clubs are generally described herein. In one example, a golf club head includes a body portion having an interior cavity with a maximum cavity width, a filler material in the interior cavity, a body mass portion integral with the body portion and including a cavity portion having an opening to the interior cavity, a first mass portion and a second mass portion coupled to the hollow body portion, and a third mass portion in the cavity portion. The third mass has a shape different from each of the first mass portion and the second mass portion. The maximum cavity width is proximate to the sole portion edge of the body portion and at or proximate to the body mass portion. Other examples and embodiments may be described and claimed.

20 Claims, 31 Drawing Sheets

Related U.S. Application Data application No. 18/613,386, filed on Mar. 22, 2024, now Pat. No. 12,109,464, which is a continuation-in-part of application No. 18/442,782, filed on Feb. 15, 2024, now Pat. No. 12,005,328, which is a continuation of application No. 18/526,106, filed on Dec. 1, 2023, now Pat. No. 11,938,385, which is a continuation-in-part of application No. 18/205,019, filed on Jun. 2, 2023, now Pat. No. 11,833,398, which is a continuation of application No. 18/115,222, filed on Feb. 28, 2023, now Pat. No. 11,707,655.

(60) Provisional application No. 63/687,070, filed on Aug. 26, 2024, provisional application No. 63/678,703, filed on Aug. 2, 2024, provisional application No. 63/655,229, filed on Jun. 3, 2024, provisional application No. 63/461,491, filed on Apr. 24, 2023, provisional application No. 63/443,494, filed on Feb. 6, 2023, provisional application No. 63/389,561, filed on Jul. 15, 2022.

(56) References Cited

U.S. PATENT DOCUMENTS 6,638,183 B2 * 10/2003 Takeda ..... A63B 53/047 473/335
6,811,496 B2 11/2004 Wahl et al.
7,121,956 B2 10/2006 Lo
7,153,222 B2 12/2006 Gilbert et al.
7,182,698 B2 2/2007 Tseng
7,207,900 B2 4/2007 Nicolette et al.
7,303,486 B2 12/2007 Imamoto
7,588,502 B2 9/2009 Nishino
7,744,484 B1 6/2010 Chao
8,062,150 B2 11/2011 Gilbert et al.
8,088,025 B2 1/2012 Wahl et al.
8,246,487 B1 8/2012 Cackett et al.
8,262,506 B2 9/2012 Watson et al.
8,475,293 B2 7/2013 Morin et al.
8,690,710 B2 4/2014 Nicolette et al.
8,753,230 B2 6/2014 Stokke et al.
8,808,106 B2 8/2014 Tavares et al.
8,900,072 B1 12/2014 Willett et al.
8,926,451 B2 1/2015 Deshmukh et al.
9,061,186 B2 6/2015 Larson
9,079,081 B2 7/2015 Shimazaki
9,155,945 B2 10/2015 Demkowski et al.
9,387,370 B2 * 7/2016 Hebreo ..... B21K 17/00
9,610,481 B2 4/2017 Parsons et al.
9,623,296 B2 4/2017 Nicolette et al.
9,750,993 B2 9/2017 Ritchie et al.
9,975,013 B2 5/2018 Jertson et al.
10,086,244 B2 10/2018 Morin et al.
10,188,917 B2 * 1/2019 Ritchie ..... A63B 53/047
10,258,840 B2 4/2019 Larson
10,512,829 B2 12/2019 Parsons et al.
10,632,349 B2 4/2020 Parsons et al.
10,953,293 B2 3/2021 Demkowski et al.
11,167,187 B2 11/2021 Parsons et al.
11,351,426 B2 6/2022 Demkowski et al.
11,400,352 B1 * 8/2022 Parsons ..... A63B 53/0475
11,420,097 B2 8/2022 Demkowski et al.
11,559,727 B2 1/2023 Demkowski et al.
11,707,655 B2 7/2023 Parsons et al.
11,833,398 B2 * 12/2023 Parsons ..... A63B 53/0475
11,938,385 B1 * 3/2024 Parsons ..... A63B 53/0408
12,005,328 B1 * 6/2024 Parsons ..... A63B 53/0408
12,109,464 B2 * 10/2024 Parsons ..... A63B 53/0408
12,194,351 B1 * 1/2025 Nicolette ..... A63B 53/0408
12,257,485 B1 * 3/2025 Nicolette ..... A63B 53/0408
12,350,559 B1 * 7/2025 Nicolette ..... A63B 53/0408
12,377,325 B2 * 8/2025 Nicolette ..... A63B 53/0475
12,420,152 B1 * 9/2025 Nicolette ..... A63B 53/0408
2003/0139226 A1 7/2003 Cheng et al.
2005/0277485 A1 12/2005 Hou et al.
2008/0022502 A1 1/2008 Tseng
2011/0124432 A1 5/2011 Oldknow et al.
2016/0243413 A1 * 8/2016 Ritchie ..... A63B 53/047
2018/0318673 A1 11/2018 Parsons et al.
2019/0160347 A1 * 5/2019 Jertson ..... A63B 53/0475
2019/0201762 A1 * 7/2019 Hebreo ..... A63B 53/047
2019/0262673 A1 * 8/2019 Clarke ..... A63B 53/0429
2021/0146206 A1 * 5/2021 Hill ..... A63B 60/02
2021/0308537 A1 10/2021 Parsons et al.
2022/0143478 A1 * 5/2022 Greer ..... A63B 60/00

* cited by examiner

GOLF CLUB HEADS AND METHODS TO MANUFACTURE GOLF CLUB HEADS

CROSS REFERENCE

This application is a continuation of U.S. application Ser. No. 19/227,663, filed Jun. 4, 2025, which is a continuation of U.S. application Ser. No. 19/093,449, filed Mar. 28, 2025, now U.S. Pat. No. 12,350,559, which claims the benefit of U.S. Provisional Application No. 63/687,070, filed Aug. 26, 2024.

U.S. application Ser. No. 19/093,449, filed Mar. 28, 2025, is a continuation-in-part of U.S. application Ser. No. 19/064,989, filed Feb. 27, 2025, now U.S. Pat. No. 12,377,325, which claims the benefit of U.S. Provisional Application No. 63/678,703, filed Aug. 2, 2024.

U.S. application Ser. No. 19/064,989, filed Feb. 27, 2025, is a continuation-in-part of U.S. application Ser. No. 18/953,266, filed Nov. 20, 2024, now U.S. Pat. No. 12,257,485, which is a continuation of U.S. application Ser. No. 18/903,190, filed Oct. 1, 2024, now U.S. Pat. No. 12,194,351, which claims the benefit of U.S. Provisional Application No. 63/655,229, filed Jun. 3, 2024.

U.S. application Ser. No. 18/903,190, filed Oct. 1, 2024, is a continuation-in-part of U.S. application Ser. No. 18/613,386, filed Mar. 22, 2024, now U.S. Pat. No. 12,109,464, which is a continuation-in-part of U.S. application Ser. No. 18/442,782, filed Feb. 15, 2024, now U.S. Pat. No. 12,005,328, which is a continuation of U.S. application Ser. No. 18/526,106, filed Dec. 1, 2023, now U.S. Pat. No. 11,938,385, which claims the benefit of U.S. Provisional Application No. 63/461,491, filed Apr. 24, 2023.

U.S. application Ser. No. 18/526,106, filed Dec. 1, 2023, is a continuation-in-part of U.S. application Ser. No. 18/205,019, filed Jun. 2, 2023, now U.S. Pat. No. 11,833,398, which is a continuation of U.S. application Ser. No. 18/115,222, filed Feb. 28, 2023, now U.S. Pat. No. 11,707,655, which claims the benefit of U.S. Provisional Application No. 63/389,561, filed Jul. 15, 2022, and claims the benefit of U.S. Provisional Application No. 63/443,494, filed Feb. 6, 2023.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
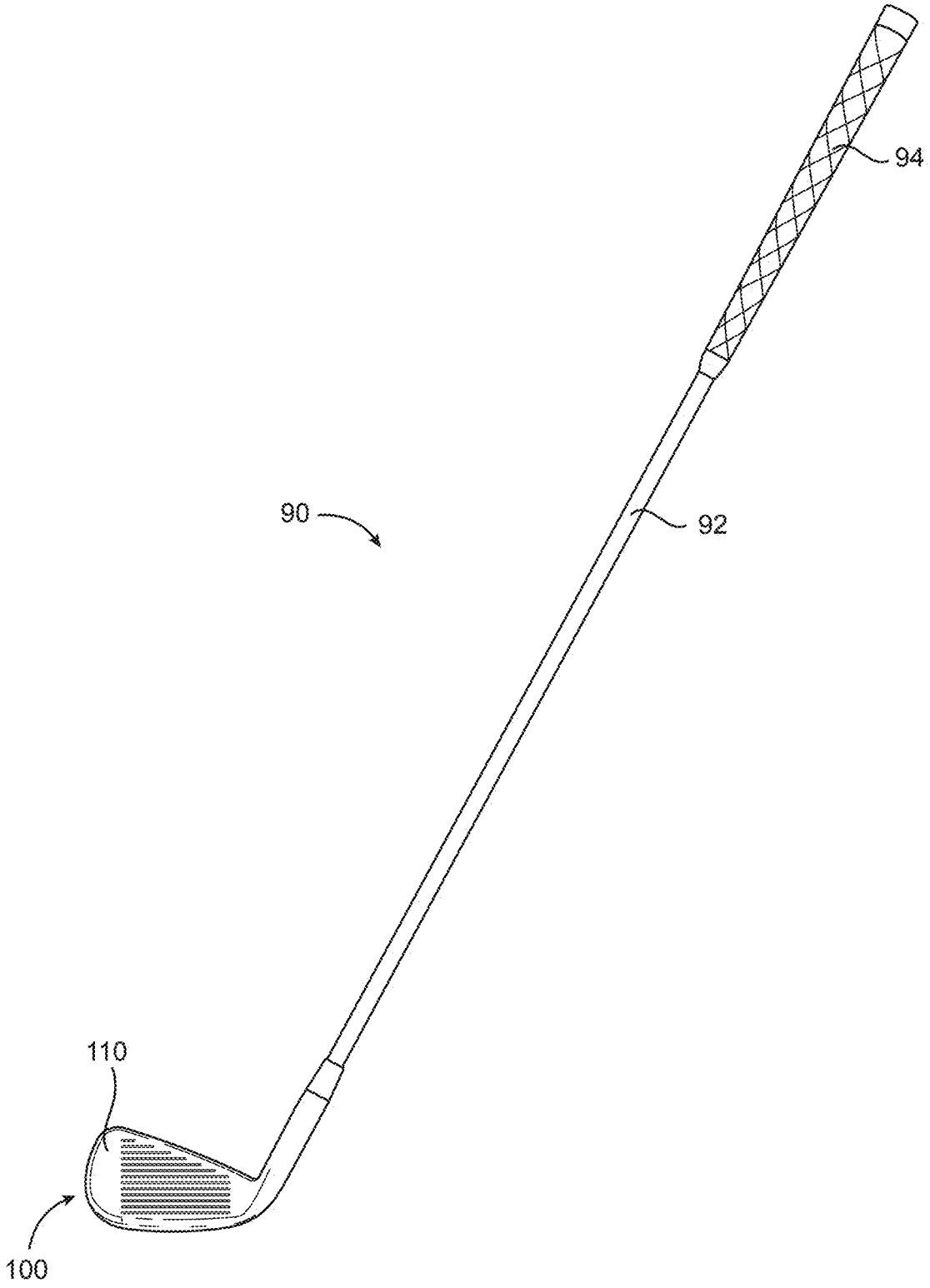
FIG. 1 depicts a golf club head having a golf club according to any embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. Patents and Patent Applications, which are collectively referred to herein as "the incorporated by reference patent documents," are incorporated by reference herein in their entirety: U.S. Pat. Nos. 8,961,336, 9,199,143, 9,421,437, 9,427,634, 9,468,821, 9,533,201, 9,610,481, 9,649,542, 9,675,853, 9,814,952, 9,878,220, 10,029,158, 10,029,159, 10,159,876, 10,232,235, 10,265,590, 10,279,233, 10,286,267, 10,293,229, 10,449,428, 10,478,684, 10,512,829, 10,596,424, 10,596,425, 10,632,349, 10,716,978, 10,729,948, 10,729,949, 10,814,193, 10,821,339, 10,821,340, 10,828,538, 10,864,414, 10,874,919, 10,874,921, 10,905,920, 10,933,286, 10,940,375, 11,058,932, 11,097,168, 11,117,030, 11,141,633, 11,154,755, 11,167,187, 11,173,359, 11,192,003, 11,207,575, 11,235,211; and U.S. Patent Publication Nos. 20170282026, 20170282027, 20170368429, 20180050243, 20180050244, 20180133567, 20180140910, 20180169488, 20180221727, 20180236325, 20190232125, 20190232126, 20190247727, 20200171363, 20210023422, 20210069557, 20210086044, 20210162278, 20210197037, 20210205672, 20210308537, 20220032138, and 20220040541.

In the example of FIG. 1, a golf club 90 may include a golf club head 100, a shaft 92, and a grip 94. The golf club head 100 may be attached to one end of the shaft 92 and the grip 94 may be attached to the opposite end of the shaft 92. An individual can hold the grip 94 and swing the golf club head 100 with the shaft 92 to strike a golf ball (not illustrated).

In the example of FIGS. 2-24, a golf club head 100 may include a body portion 110 having a toc portion 140 with a toc portion edge 142, a heel portion 150 with a heel portion edge 152 that may include a hosel portion 155. A golf club shaft such as the shaft 92 that is illustrated for example in FIG. 1 may include one end coupled to the hosel portion 155 and an opposite end coupled to a golf club grip such as the grip 94 that is illustrated for example in FIG. 1 to form a golf club such as the golf club 90 that is illustrated for example in FIG. 1. The body portion 110 may further include a front portion 160, a back portion 170 with a back wall portion 172, a top portion 180 with a top portion edge 182, and a sole portion 190 with a sole portion edge 192. The toc portion 140, the heel portion 150, the front portion 160, the back portion 170, the top portion 180, and/or the sole portion 190 may partially overlap. The toc portion edge 142, the heel portion edge 152, the top portion edge 182, and the sole portion edge 192 may define a periphery or boundary of the body portion 110. The golf club head 100 may be any type of golf club head described herein, such as, for example, an iron-type golf club head or a wedge-type golf club head. The volume of the golf club head 100, the materials of construction of the golf club head 100, and/or any components thereof may be similar to any of the golf club heads described herein and/or described in any of the incorporated by reference patent documents. The apparatus, methods, and articles of manufacture described herein are not limited in this regard.

The golf club head 100 may include a face portion 162 (i.e., the strike face) that may be integrally formed with the body portion 110 (e.g., a single unitary piece). In one example, as illustrated in FIGS. 2-24, the face portion 162 may be a separate piece coupled (e.g., directly or indirectly, adhesively, mechanically, by welding, and/or by soldering) to the front portion 160 to close a front opening of the front portion 160. The face portion 162 may include a front surface 164 and a back surface 166. The front surface 164 may include front grooves 168 that may extend between the toe portion 140 and the heel portion 150. The front grooves 168 may be similar in many respects to the front grooves of any of the golf club heads described herein or described in any of the incorporated by reference patent documents. The back surface 166 of the face portion 162 may include one or more grooves, slots, channels, depressions, or recesses. In one example, the grooves on the back surface 166 may be similar in many respects to any of the back grooves 2800 and 2900 illustrated in FIGS. 28 and 29, respectively, and described herein. In another example, the grooves on the back surface 166 may be similar to any of the back grooves described in U.S. Pat. Nos. 11,400,352 and 10,449,428, which are incorporated by reference herein. In another example, the back surface 166 may not include any grooves, slots, channels, depressions, or recesses. The face portion 162 and the attachment thereof to the body portion 110 or manufacturing thereof with the body portion 110 may be similar in many respects to any of the face portions described herein or described in any of the incorporated by reference patent documents. The apparatus, methods, and articles of manufacture described herein are not limited in this regard.

Figure 28:
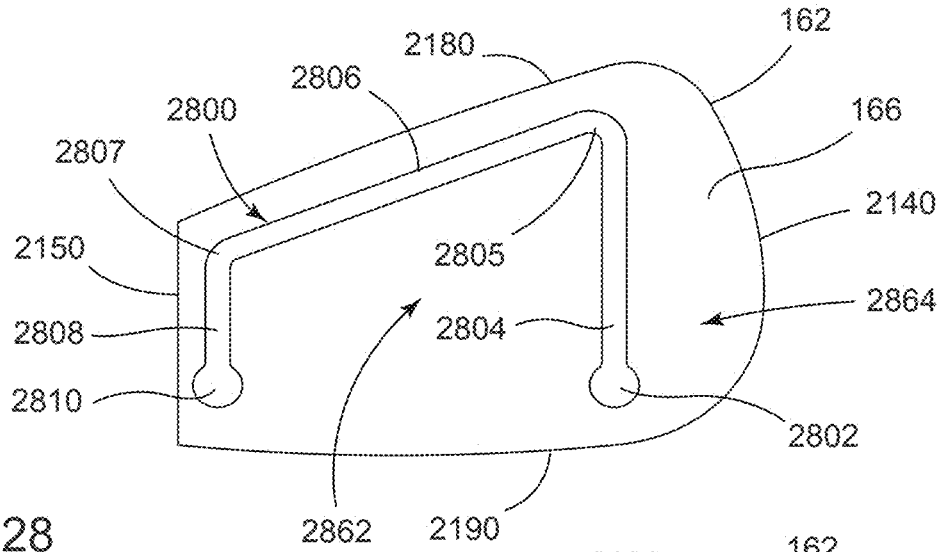

In the illustrated example of FIG. 28, the back surface 166 of the face portion 162 may include a back groove 2800 having a first end portion 2802, a first portion 2804, a first transition portion 2805, a second portion 2806, a second transition portion 2807, a third portion 2808, and a second end portion 2810. In one example, as illustrated in FIG. 28, the first end portion 2802 may be proximate to the face toe edge 2140 and proximate to the face sole edge 2190. The first end portion 2802 may be circular as illustrated in FIG. 28 to eliminate or reduce stress concentration regions on the face portion 162 at or proximate to the first end portion 2802. The first portion 2804 may extend from the first end portion 2802 toward the face top edge 2180. In the illustrated example of FIG. 28, the first portion 2804 may be linear and extend vertically from the first end portion 2802 toward the face top edge 2180. In another example, the first portion 2804 may extend from the first end portion 2802 toward the face top edge 2180 with a curvature that may be similar or substantially similar to the curvature or contour of the face toe edge 2140. In yet another example, the first portion 2804 may be inwardly curved. The first portion 2804 may then transition to the second portion 2806 via the first transition portion 2805 located proximate to the face toe edge 2140 and proximate to the face top edge 2180. The first transition portion 2805 may be curved to eliminate or reduce stress concentration regions on the face portion 162 at or proximate to the first transition portion 2805. The second portion 2806 may extend from the first transition portion 2805 toward the face heel edge 2150. The second portion 2806 may be linear and have the same orientation and contour as the face top edge 2180. The second portion 2806 may then transition to the third portion 2808 via the second transition portion 2807 located proximate to the face heel edge 2150 and proximate to the face top edge 2180. The second transition portion 2807 may be curved to prevent or reduce stress concentration regions on the face portion 162 at or proximate to the second transition portion 2807. The third portion 2808 may extend from the second transition portion 2807 toward the second end portion 2810 to the second end portion 2810. The second portion 2806 may be linear and have the same orientation and contour as the face heel edge 2150. The second end portion 2810 may be located proximate to the face heel edge 2150 and proximate to the face sole edge 2190. The second end portion 2810 may be circular as illustrated in FIG. 28 to eliminate or reduce stress concentration regions on the face portion 162 at or proximate to the second end portion 2810. In another example, the back groove 2800 may have the same as described herein but be in an inverted configuration (i.e., U-shaped or rotated 180 degrees relative to the back groove 2800 shown in FIG. 28). In another example, the back groove 2800 may have the shape as described herein but be rotated 90 degrees clockwise or counterclockwise relative to the back groove 2800 shown in FIG. 28 (i.e., C-shaped). In another example, the grooves on the back surface 166 may be similar to any of the back grooves described in U.S. Pat. Nos. 11,400,352 and 10,449,428, which are incorporated by reference herein. The apparatus, methods, and articles of manufacture described herein are not limited in this regard.

Figure 29:
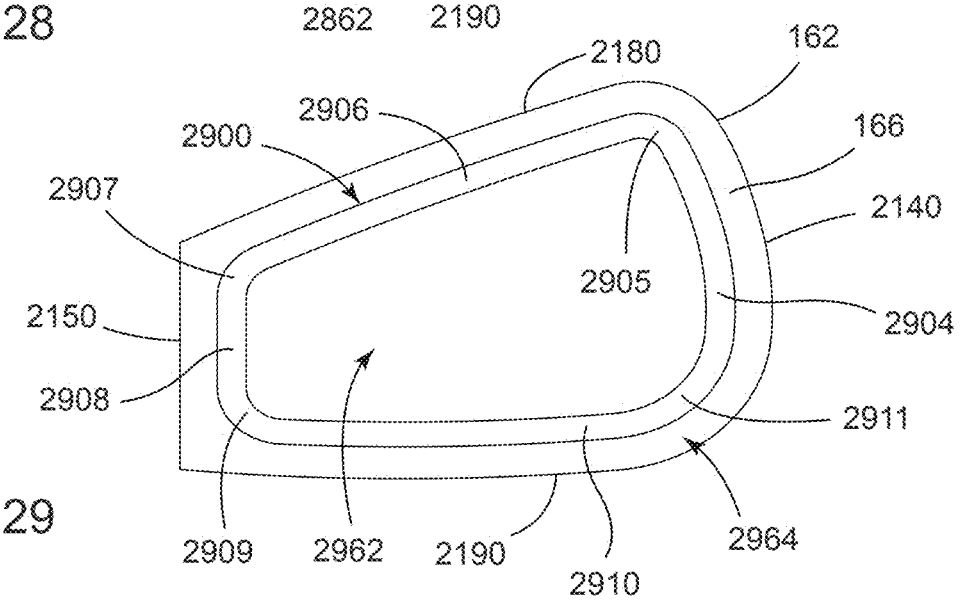

In another example, as illustrated in FIG. 29, the back surface 166 of the face portion 162 may include a back groove 2900, which may have similar back groove width, back groove depth, and/or cross-sectional shape as described and illustrated herein with respect to the back groove 2800. The back groove 2900 may include a first portion 2904, a first transition portion 2905, a second portion 2906, a second transition portion 2907, a third portion 2908, and a third transition portion 2909, a fourth portion 2910, and a fourth transition portion 2911, all of which may be continuous such that the back groove 2900 extends proximate to a perimeter of the back surface 166 of the face portion 162 and generally follows the contour of the perimeter of the face portion 162 without having any sharp corners to prevent stress concentration regions at or near any portion of the back groove 2900. The apparatus, methods, and articles of manufacture described herein are not limited in this regard.

As illustrated in FIGS. 28 and 29, the back grooves 2800 and 2900 may define inner areas 2862 and 2962 and outer areas 2864 and 2964, respectively, of the face portion 162. The inner areas may correspond to or include a portion of the face portion 162 that generally strikes a golf ball. Further, the back grooves may provide a relatively thinner part of the face portion 162 as compared to the remaining parts of the face portion 162. Accordingly, the back grooves may provide enhanced deflection of the inner areas relative to the outer areas as compared to face portion 162 without the back grooves. In other words, the back grooves may provide a trampoline effect for the inner areas of the face portion 162. The enhanced deflection of the inner areas may provide enhanced rebounding of the inner areas after the face portion 162 strikes a golf ball, which may increase ball speed and/or carry distance. The apparatus, methods, and articles of manufacture described herein are not limited in this regard.

In one example, the thickness of the face portion 162, which may be referred to herein as the face thickness, may be greater than or equal to 0.025 inch (0.635 mm) and less than or equal to 0.125 inch (3.175 mm). In another example, the face thickness may be greater than or equal to 0.047 inch (1.181 mm) and less than or equal to 0.078 inch (1.969 mm). In another example, the face thickness may be greater than or equal to 0.054 inch (1.378 mm) and less than or equal to 0.070 inch (1.772 mm). In yet another example, the face thickness may be greater than or equal to 0.060 inch (1.524 mm) and less than or equal to 0.065 inch (1.651 mm). The apparatus, methods, and articles of manufacture described herein are not limited in this regard.

Figure 2:
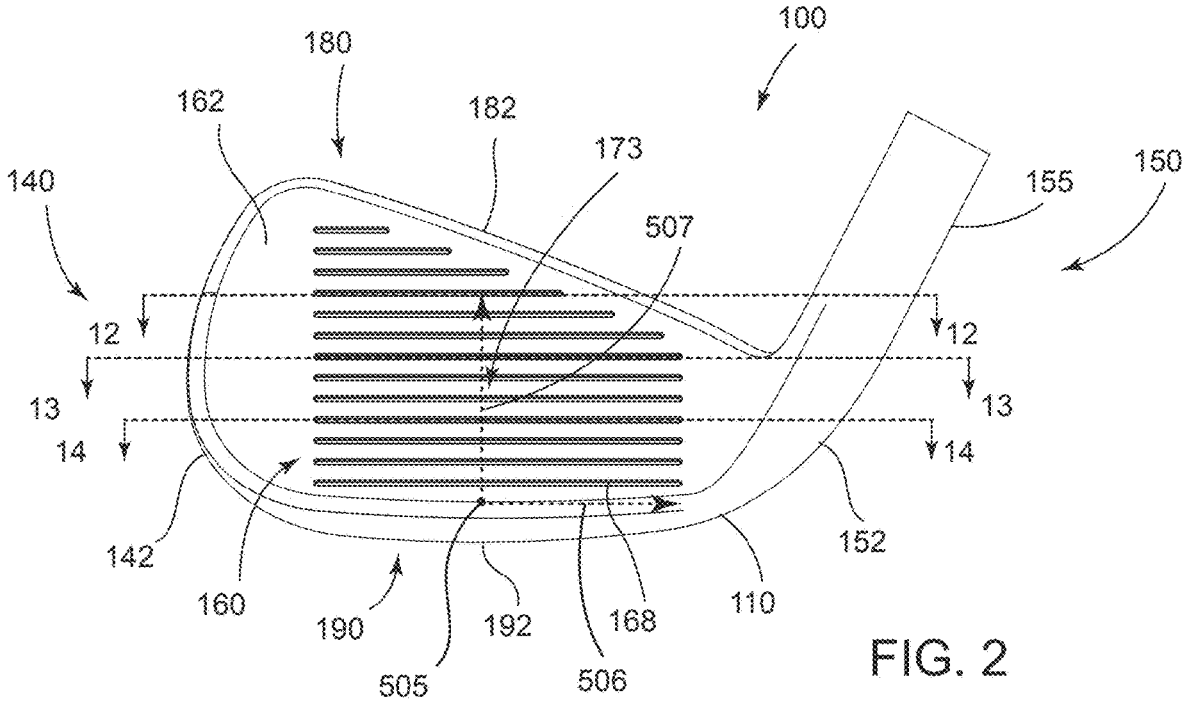
FIGS. 2, 3, 4, 5, 6, 7, 8, 9, 10, 11, 12, 13, 14, 15, 16, 17, 18, 19, 20, 21, 22, 23, 24, 25, and 26 illustrate a front view, a back view, a top view, a bottom view, a heel side view, a toe side view, a cross-sectional view taken at line 8-8 of FIG. 3, a cross-sectional view taken at line 9-9 of FIG. 3, a cross-sectional view taken at line 10-10 of FIG. 3, a cross-sectional view taken at line 11-11 of FIG. 3, a cross-sectional view taken at line 12-12 of FIG. 2, a cross-sectional view taken at line 13-13 of FIG. 2, a cross-sectional view taken at line 14-14 of FIG. 2, a cross-sectional view taken at line 16-16 of FIG. 3, another cross-sectional view taken at line 16-16 of FIG. 3, a back view of a port sleeve, a front view of a port sleeve, a front-side view of a mass portion, a side view of a mass portion, a back view, another back view, a front view without a face portion, a method of manufacturing, a cross-sectional view of another example taken at line 16-16 of FIG. 3, and a perspective view of a filler compression portion, respectively, of a golf club head according to embodiments of the apparatus, methods, and articles of manufacture described herein.
Figure 3:
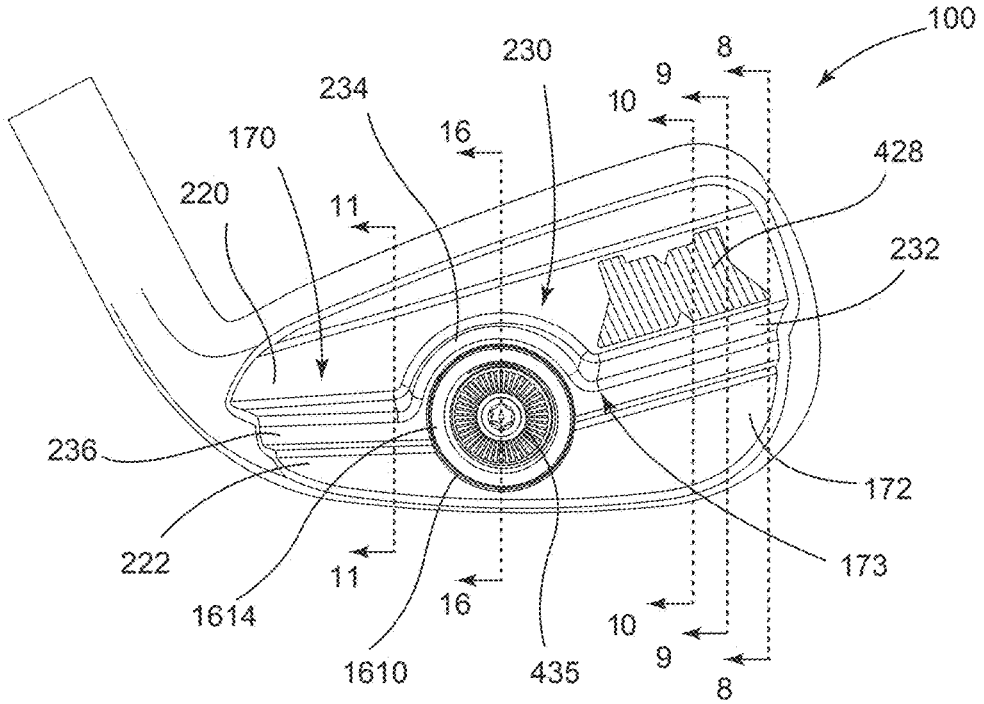
Figure 4:
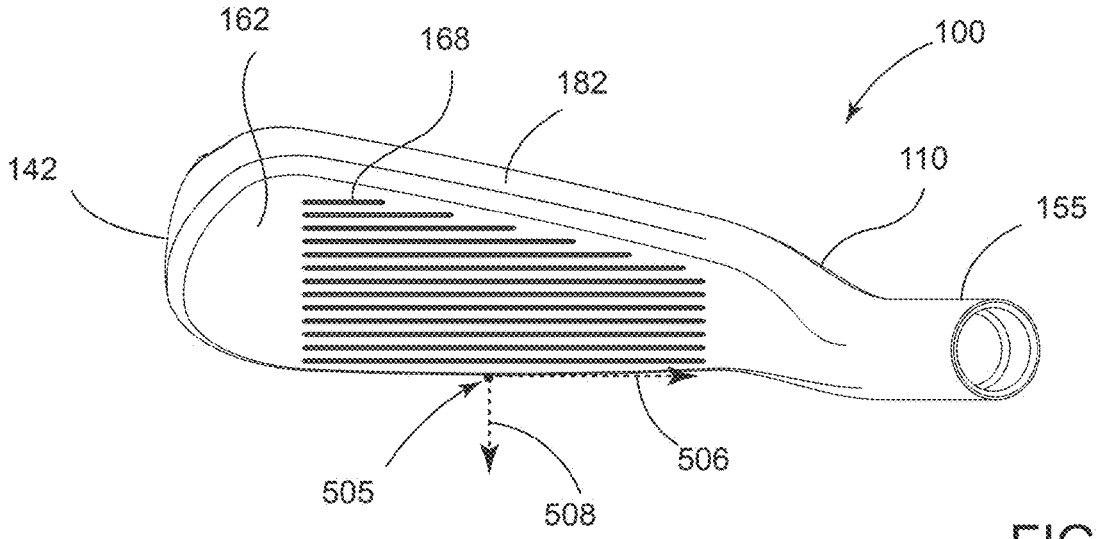
Figure 5:
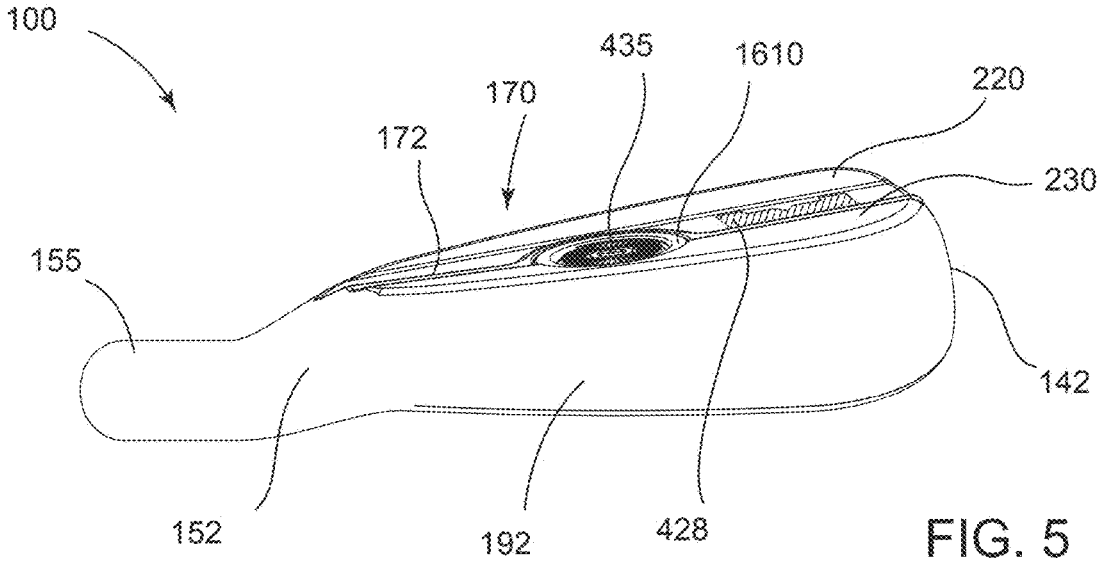
Figure 6:
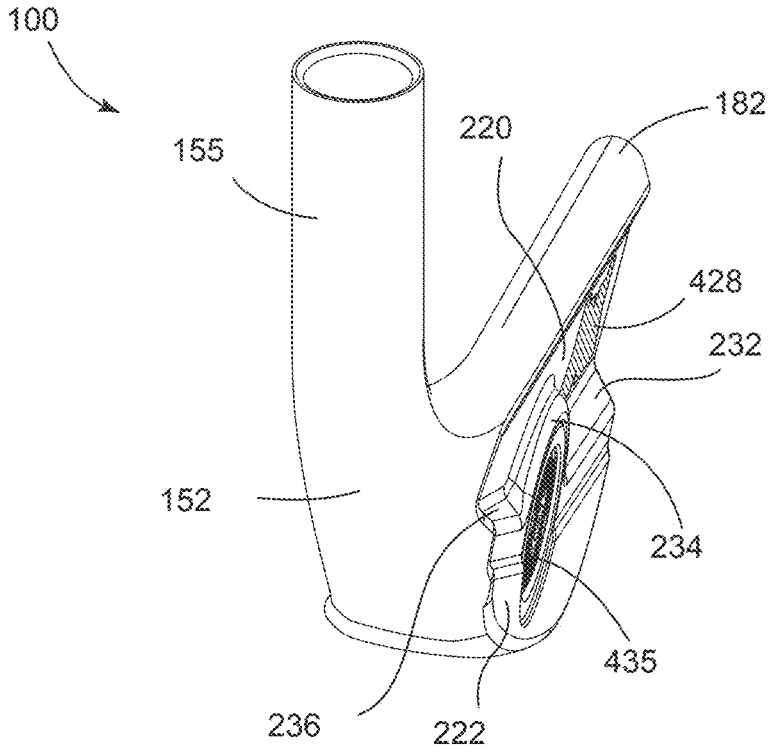
Figure 7:
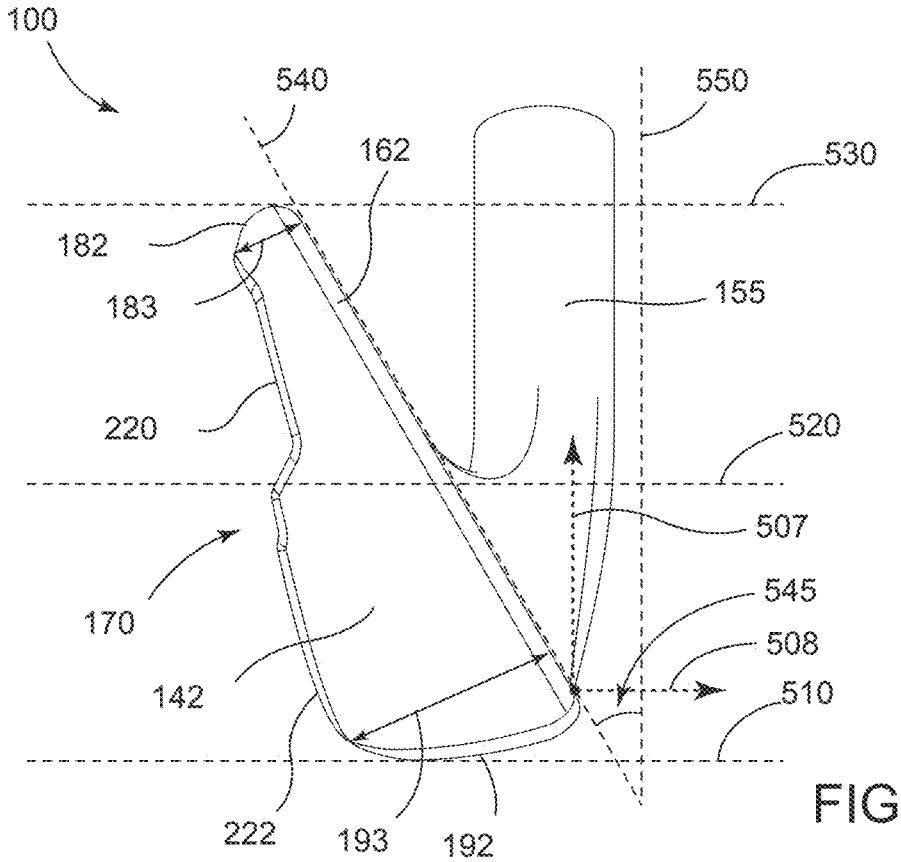
Figure 8:
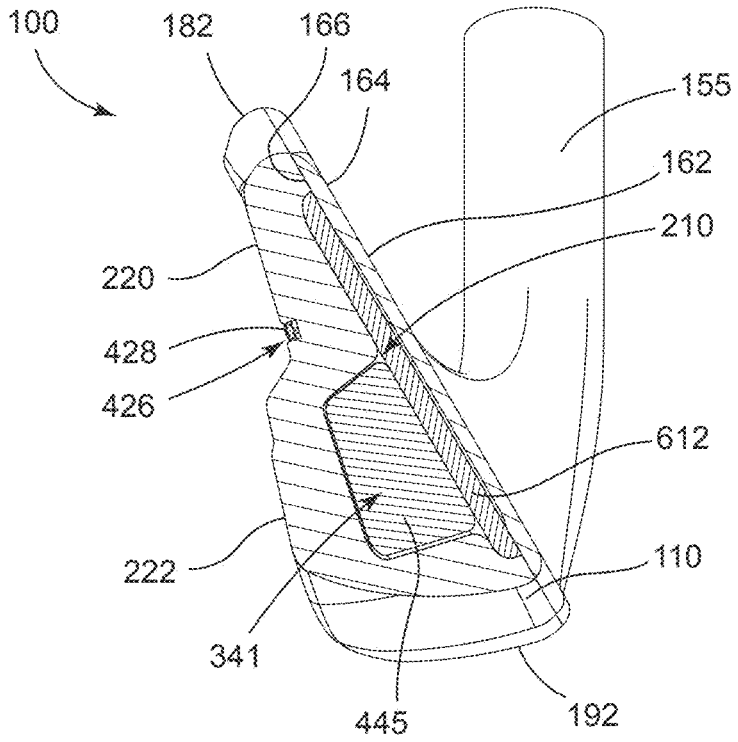
Figure 9:
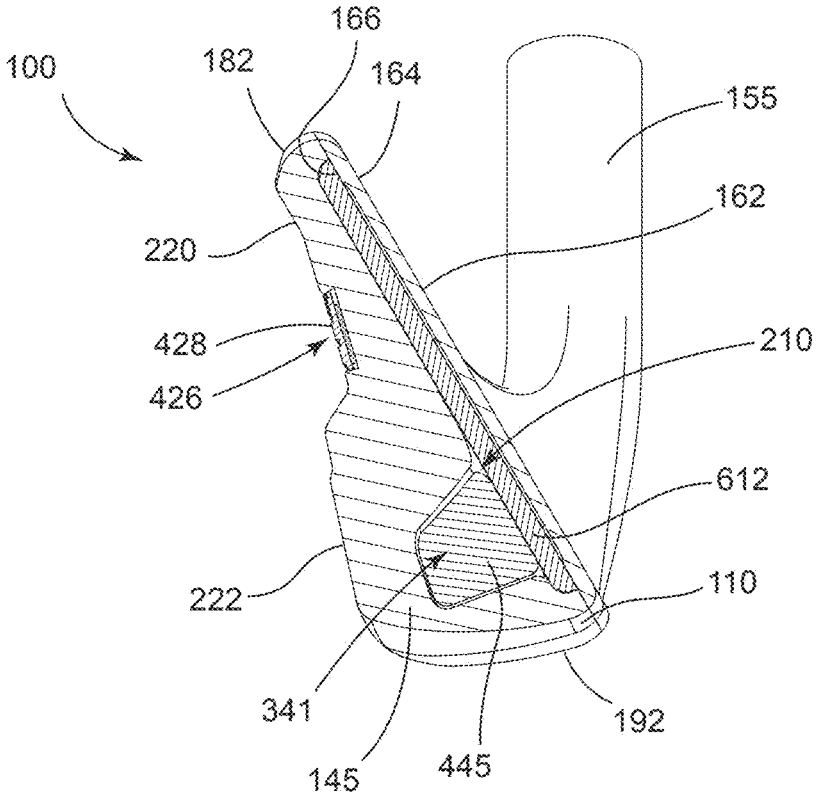
Figure 10:
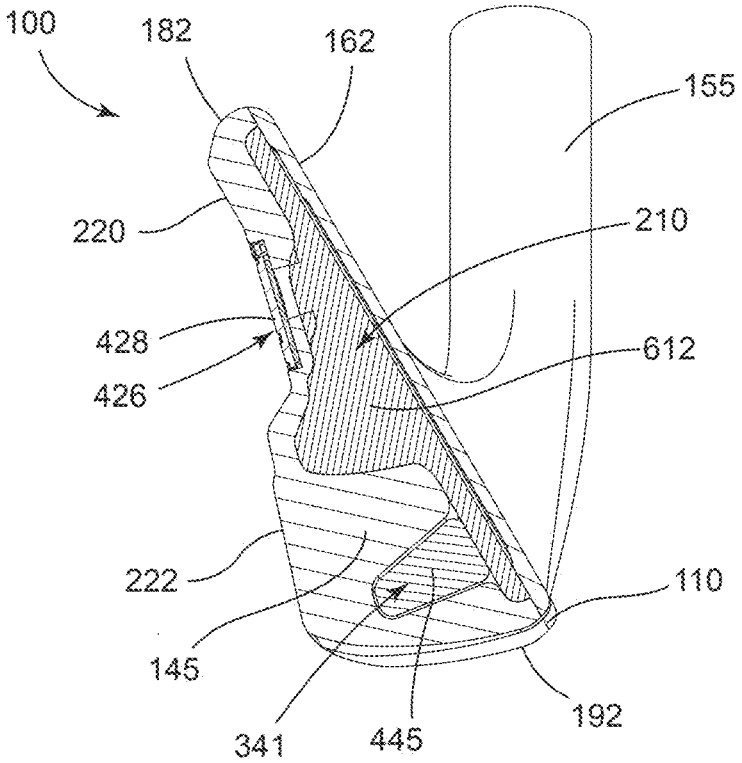
Figure 11:
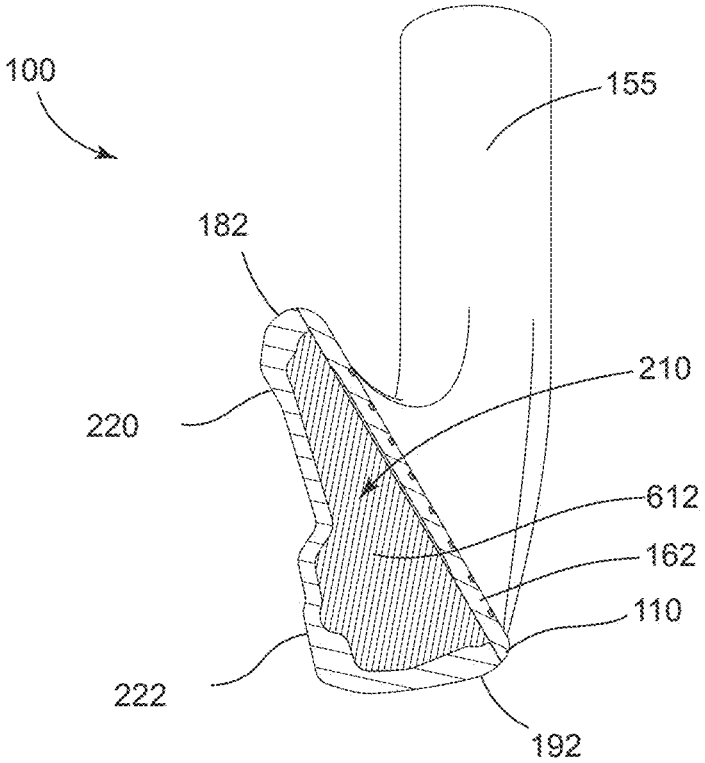
Figure 12:
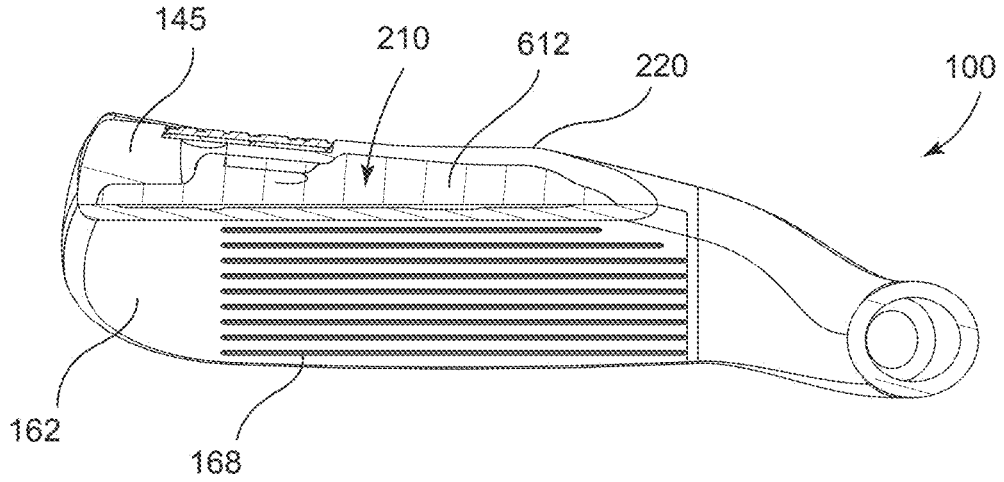
Figure 13:
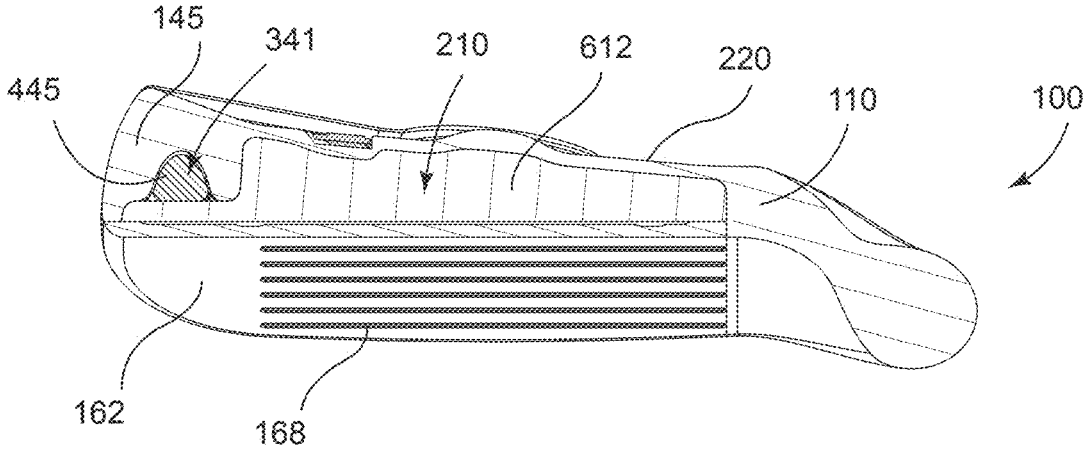

Any location on the golf club head 100 (or any of the golf club heads described herein) may be referenced by x, y, and z coordinates of a reference coordinate system. The coordinate system may have a horizontal x-axis, a vertical y-axis that is orthogonal to the x-axis, and a z-axis that is orthogonal to both the x-axis and the y-axis, all of which intersect at an origin of the coordinate system. In one example, as illustrated in FIGS. 2, 4 and 7, the origin 505 of the coordinate system or the location of coordinates x=0, y=0, and z=0 may be at the lowest point of the planar portion or flat portion of the face portion 162 or the lowest point on the face portion 162 prior to any curved transition portion between the face portion 162 and the sole portion edge 192. The x-axis (shown for example by reference number 506) of the coordinate system may extend in the horizontal and heel-to-toe direction with the positive x-axis extending from the origin 505 in a direction towards the heel portion edge 152. The y-axis (shown for example by reference number 507) of the coordinate system may extend in the vertical direction and be orthogonal to the x-axis with the positive y-axis extending vertically upward from the origin 505. The z-axis (shown for example by reference number 508) of the coordinate system may be orthogonal with both the x-axis and the y-axis with the negative z-axis extending from the origin in a direction towards the back portion 170 (positive z-axis direction is shown in FIGS. 4 and 7). In another example, the location of coordinates x=0, y=0, and z=0 may be at the lowest location of the toe portion edge 142. In another example, the location of coordinates x=0, y=0, and z=0 may be at the center of gravity of the golf club head 100. In yet another example, the location of coordinates x=0, y=0, and 7=0 may be at a geometric center of the face portion 162. The location of coordinates x=0, y=0, and z=0 may be at any location on the golf club head 100 or outside the golf club head 100. Additionally, the coordinate system may have the x-axis, y-axis, and the z-axis at different directions (e.g., x direction being vertical and y direction being horizontal) than the coordinate systems described herein. Accordingly, any location on the golf club head 100 may be referenced with x, y, and z coordinates relative to x=0, y=0, and z=0 of a reference coordinate system. The apparatus, methods, and articles of manufacture described herein are not limited in this regard.

The golf club head 100 may be associated with a ground plane 510, a horizontal midplane 520, and a top plane 530. In particular, the ground plane 510 may be a plane that is parallel or substantially parallel to the ground and is tangent to the lowest portion of the sole portion edge 192 when the golf club head 100 is at an address position (e.g., the golf club head 100 aligned to strike a golf ball). A top plane 530 may be a plane that is tangent to the upper most portion of top portion edge 182 when the golf club head 100 is at the address position. The ground plane 510 and the top plane 530 may be parallel or substantially parallel. The horizontal midplane 520 may be vertically halfway between the ground plane 510 and the top plane 530, respectively, and be parallel or substantially parallel to the ground plane 510. Further, the golf club head 100 may be associated with a loft plane 540 defining a loft angle 545 ($\alpha$) of the golf club head 100. The loft plane 540 may be a plane that is tangent to or coplanar with the face portion 162. The loft angle 545 may be defined by an angle between the loft plane 540 and a vertical plane 550 that is normal to the ground plane 510. The apparatus, methods, and articles of manufacture described herein are not limited in this regard.

The back wall portion 172 may include an upper back wall portion 220, a lower back wall portion 222, and a ledge portion 230 between the upper back wall portion 220 and the lower back wall portion 222. The ledge portion 230 may extend outward (i.e., away from the face portion 162) from the upper back wall portion 220 to the lower back wall portion 222 (i.e., the ledge portion 230 may extend inward or toward the face portion 162 from the lower back wall portion 222 to the upper back wall portion 220). The ledge portion 230 may include a first ledge portion 232 that may extend from a location at or proximate to the toe portion edge 142 toward the heel portion 150, a second ledge portion 234 that may be located at or proximate to a center portion 173 of the back wall portion 172, and a third ledge portion 236 that may extend from a location at or proximate to the heel portion edge 152 toward the toe portion 140. The second ledge portion 234 may extend between the first ledge portion 232 and the third ledge portion 236. The first ledge portion 232 may also extend in a downwardly inclined direction from a location at or proximate to the toe portion edge 142 to the second ledge portion 234. The third ledge portion 236 may also extend in a downwardly inclined or horizontal direction from a location at or proximate to the heel portion edge 152 to the second ledge portion 234. Alternatively, the first ledge portion 232 and/or the third ledge portion 236 may be upwardly inclined or horizontally oriented. The ledge portion 230 including the first ledge portion 232, the second ledge portion 234, and the third ledge portion 236 may be similar in many respects (e.g., height, width, orientation, configurations of any sidewall portions, configurations of any ledge portion transition portions, etc.) to any of the ledge portions described herein or described in any of the incorporated by reference patent documents. The apparatus, methods, and articles of manufacture described herein are not limited in this regard.

In one example, as illustrated in FIG. 7, a top rail width 183, which may be defined as a distance between the back wall portion 172 and the face portion 162 at the top portion edge 182, may be greater than equal to 0.25 inch (6.35 mm) and less than or equal to 0.35 inch (8.89 mm), and a sole width 193, which may be defined as a distance between the back wall portion 172 and the face portion 162 at the sole portion edge 192, may be greater than equal to 0.75 inch (19.05 mm) and less than or equal to 1.05 inch (26.67 mm). In another example, the top rail width 183 may be greater than equal to 0.2 inch (5.08 mm) and less than or equal to 0.5 inch (12.7 mm), and the sole width 193 may be greater than equal to 0.5 inch (12.7 mm) and less than or equal to 1.75 inch (44.45 mm). In yet another example, a ratio of the sole width 193 to the top rail width 183 may be greater than or equal to 2.5 and less than or equal to 3.5. Accordingly, a greater portion of the mass portion of the body portion 110 may be located closer to the sole portion edge 192 than the top portion edge 182 to place the center of gravity of the golf club head 100 relatively low or as low as possible while complying with rules established by one or more golf governing bodies to provide optimum performance for the golf club head 100. The apparatus, methods, and articles of manufacture described herein are not limited in this regard.

The body portion 110 may include one or more ports, which may be exterior ports and/or interior ports (e.g., located inside the body portion 110). The one or more ports may be at any location on the body portion 110. The inner walls of the body portion 110 that define the interior cavity 210 may include one or more ports. In one example, as illustrated in FIGS. 2-24, the body portion 110 may include a first port 321 above the first ledge portion 232, a second port 331 located below the second ledge portion 234, and a third port 341 in the interior cavity 210. Accordingly, the first port 321 and the second port 331 may be external ports, i.e., having port openings on an external surface of the body portion 110, whereas the third port 341 may be an internal port having an opening on one or more internal walls of the body portion 110 that define the interior cavity 210. The body portion 110 may include ports that may be similar in many respects to any of the ports described in any of the incorporated by reference patent documents. The apparatus, methods, and articles of manufacture described herein are not limited in this regard.

In one example as illustrated in FIGS. 2-24, the first port 321 may be located above the first ledge portion 232 and proximate to the toc portion edge 142. In another example, the first port 321 may be on the toc portion edge 142. In yet another example, the first port 321 may be below the first ledge portion 232. The first port 321 may have a first port first opening 326 on the back wall portion 172 that may be raised, coplanar, or recessed relative to portions of the back wall portion 172 that surround the first port first opening 326. In one example, as illustrated in FIGS. 2-24, the first port first opening 326 may be inside a recessed portion 426 on the upper back wall portion 220. The first port 321 may be cylindrical and extend from the first port first opening 326 to the interior cavity at a first port second opening 327 to connect to the interior cavity 210. Accordingly, the first port first opening 326 may provide access to the interior cavity 210 from outside of the body portion 110 via the first port second opening 327. As illustrated in FIGS. 2-24, the first port 321 may have a circular cross section (i.e., cylindrical port). In another example, the first port 321 may be elliptical. In yet another example, the first port 321 may have any shape. In one example, as illustrated in FIGS. 2-24, the recessed portion 426 may be configured to receive a cover portion or a badge 428 to cover the first port first opening 326. In another example, the first port 321 may be closed with a mass portion that may be constructed from a material having a different density than a material of the body portion 110. In yet another example, the first port 321 may be closed with a mass portion that may be constructed from a material having the same density as a material of the body portion 110. The apparatus, methods, and articles of manufacture described herein are not limited in this regard.

In one example, the badge 428 may display one or more alphanumeric characters, symbols, shapes or other visual marks to signify a particular feature of or information about of the golf club head 100. Accordingly, the badge 428 may be configured to be inserted and secured in the recessed portion 426. In one example, the badge 428 may be secured in the recessed portion 426 with an adhesive or a bonding agent. In another example, depending on the material of construction of the badge 428, welding or soldering may be used to attach the badge 428 inside the recessed portion 426. In another example, the badge 428 may be press fit into the recessed portion 426. In yet another example, one or more fasteners may be used to attach the badge 428 inside recessed portion 426. As described herein, the badge 428 may cover and/or close the first port 321. In one example, the badge 428 may be plate shaped to fit in the recessed portion 426. In another example, the badge 428 may further have a projection that may be received in the first port 321 to close the first port 321. In another example, the badge 428 may be rectangular, circular, or have any shape. In another example, the badge 428 may be visible and distinguishable from the remaining parts of the body portion 110 by color, texture, materials of construction, and/or other visual features. In yet another example, the badge 428 may be attached to the body portion 110 such as to appear seamless or almost seamless with the body portion 110 and be an integral part of the body portion 110, i.e., indistinguishable or almost indistinguishable from the body portion 110. The apparatus, methods, and articles of manufacture described herein are not limited in this regard.

In one example, as illustrated in FIGS. 2-24, the second port 331 may be larger in diameter than the first port 321. The distance between a center of the second port 331 and the sole portion edge 192 may be less than the distance between the center of the second port 331 and the top portion edge 182. Accordingly, the second port 331 may be closer to the sole portion edge 192 than to the top portion edge 182. The second port 331 may be located at or proximate to the center portion 173 of the back wall portion 172 and may have a diameter that is sized such that portions of the second port 331 may be located at or proximate to the sole portion edge 192. The second port 331 may be located between the sole portion edge 192 and the second ledge portion 234. The second port 331 may have a second port first opening 333 on the back wall portion 172 and port walls 335 that extend from the second port first opening 333 to a second port second opening 337 that may be connected to the interior cavity 210. Accordingly, the interior cavity 210 may be accessed from outside of the body portion 110 through the second port first opening 333 and the second port second opening 337. In one example, an inner diameter of the second port 331 may be greater than or equal to 0.2 inch (5.08 mm) and less than or equal to 1.0 inch (25.4 mm). In another example, the inner diameter of the second port 331 may be greater than or equal to 0.3 inch (7.62 mm) and less than 1.5 inch (38.1 mm). In another example, the inner diameter of the second port 331 may be greater than or equal to 0.4 inch (10.16 mm) and less than or equal to 0.8 inch (20.32 mm). In yet another example, the inner diameter of the second port 331 may be greater than or equal to 0.5 inch (12.7 mm) and less than or equal to 0.7 inch (17.78 mm). The apparatus, methods, and articles of manufacture described herein are not limited in this regard.

As illustrated in FIGS. 2-24, the second ledge portion 234 may partially surround the second port 331. Accordingly, in one example, as illustrated in FIGS. 2-24, the second ledge portion 234 may have a curved or semi-circular shape that may surround the upper portion of the second port 331. Alternatively, the second ledge portion 234 may be similar to any of the second ledge portions described herein or described in any of the incorporated by reference patent documents. The apparatus, methods, and articles of manufacture described herein are not limited in this regard.

The body portion 110 may include any number of ports above and/or below the first ledge portion 232, the second ledge portion 234, and/or the third ledge portion 236. The body portion 110 may include any number of ports above and/or below the horizontal midplane 520. The body portion 110 may include any number of ports on the toc portion edge 142, the heel portion edge 152, the top portion edge 182, and/or the sole portion edge 192. Any port may be connected to the interior cavity 210. The number of ports on the body portion 110, the arrangement and/or the configuration of the ports on the body portion 110 may be similar in many respects to any of the golf club heads described herein or in any of the incorporated by reference patent documents. The apparatus, methods, and articles of manufacture described herein are not limited in this regard.

In one example, as illustrated in FIGS. 2-24, the golf club head may include a port sleeve 1610 that may be sized to be inserted into the second port 331. The port sleeve 1610 may be constructed from any material such as metals, polymers, and/or composite materials. The port sleeve 1610 may be constructed from a material having a lower density than the material of the body portion 110. The lower mass of the port sleeve 1610 relative to a port sleeve 1610 constructed from a material having the same or higher density than the material of the body portion 110, or a golf club head 100 without a port sleeve 1610 (i.e., the space filled by the port sleeve 1610 is filled with a material having the same or higher density than the material of the body portion 110), allows more mass to be shifted to the toe region of the body portion 110 to increase the moment of inertia of the golf club head or optimize the location of the center of gravity of the golf club head 100 without changing or greatly changing the total mass of the golf club head 100. In other words, the port sleeve 1610 allows mass to be shifted from the center portion of the golf club head 100 to other parts of the golf club head 100 to optimize the performance of the golf club head 100. In one example, the port sleeve 1610 may provide a weight savings of greater than or equal to 0.5 gram and less than or equal to 10 grams at the center portion of the golf club head 100 to be shifted to other locations on the golf club head 100 as described herein. In another example, the port sleeve 1610 may provide a weight savings of greater than or equal to 2 gram and less than or equal to 7 grams at the center portion of the golf club head 100 to be shifted to other locations on the golf club head 100 as described herein. In yet another example, the port sleeve 1610 may provide a weight savings of greater than or equal to 1 gram and less than or equal to 5 grams at the center portion of the golf club head 100 to be shifted to other locations on the golf club head 100 as described herein. The apparatus, methods, and articles of manufacture described herein are not limited in this regard.

In one example, as illustrated in FIGS. 2-24, the port sleeve 1610 may be constructed from titanium or any titanium-based materials, whereas all or portions of the body portion 110 may be constructed from steel or steel-based materials. In another example, the port sleeve 1610 may be constructed from a polymer material. In yet another example, the port sleeve 1610 may be constructed from a composite material. For certain applications or configurations of the golf club head 100, the port sleeve 1610 may be constructed from a material having a greater density than the density of the material of the body portion 110 to place more mass at or proximate to the center portion of the golf club head 100. The port sleeve 1610 may be constructed from a material having the same density or a different density as the density of the material of the body portion 110. The apparatus, methods, and articles of manufacture described herein are not limited in this regard.

In one example, as illustrated in FIGS. 2-24, the port sleeve 1610 may include a sleeve body 1612 and a sleeve bezel 1614. The sleeve body 1612 may have an outer diameter that is sized to be movably received in the second port 331 while coupling to or engaging the inner walls of the second port 331 as described herein. In one example, the sleeve body 1612 may be externally threaded and compatible with threaded port walls 335 of the second port 331. Accordingly, the port sleeve 1610 may be inserted into and engage the threaded inner walls of the second port 331 by being screwed into the second port 331. The port sleeve 1610 may include a sleeve bottom 1616 having one or more structures, such as projections, recesses, and/or apertures for engaging a tool to turn the port sleeve 1610 inside the second port 331 and/or to provide access to the interior cavity 210. In one example, as illustrated in FIGS. 2-24, the sleeve bottom 1616 may include a bottom opening 1617 to provide access to the interior cavity 210 from the second port 331 when the port sleeve 1610 is inside the second port 331, and the sleeve bottom 1616 may include recesses 1618 that may be rectangular and configured in a four quadrant arrangement to provide engagement with a correspondingly shaped tool (not shown) to turn the port sleeve 1610 and secure the port sleeve 1610 in the second port 331. A tool that engages the recesses 1618 may also include a cylindrical projection that may be inserted into the bottom opening 1617 to engage the sleeve bottom 1616 and/or function to center the tool on the sleeve bottom 1616 for engagement with the recesses 1618. The sleeve bottom 1616 may have any structure and/or openings for engaging a corresponding tool for turning the port sleeve 1610 inside the second port 331. The apparatus, methods, and articles of manufacture described herein are not limited in this regard.

The sleeve bezel 1614 may have a greater diameter than the sleeve body 1612 and a greater diameter than the internal diameter of the second port 331. Accordingly, the sleeve bezel 1614 may engage the back wall portion 172 surrounding the second port 331 to prevent further insertion of the sleeve body 1612 into the second port 331. In one example, as illustrated in FIGS. 2-24, a portion of the back wall portion 172 surrounding the second port 331 may include a recessed ledge portion 177 that may be sized and shaped to receive the sleeve bezel 1614 therein and prevent further insertion of the sleeve body 1612 into the second port 331. Accordingly, in one example, the sleeve bezel 1614 may sit flush with the back wall portion 172 when the port sleeve 1610 is fully inserted into the second port 331 and the sleeve bezel 1614 is engaged with the recessed ledge portion 177. Alternatively, the sleeve bezel 1614 may not be flush with the back wall portion 172 such that the sleeve bezel 1614 may be partially or fully raised or partially or fully recessed relative to the back wall portion 172. In one example, the sleeve bezel 1614 may also include one or more structures for engaging a correspondingly shaped tool to secure the port sleeve 1610 in the second port 331. The apparatus, methods, and articles of manufacture described herein are not limited in this regard.

In one example, as illustrated in FIGS. 2-24, the length of the port sleeve 1610 may be greater than the length of the second port 331. Accordingly, a sleeve front portion 1620 of the port sleeve 1610 may extend past the second port 331 and into the interior cavity 210. As the port sleeve 1610 is screwed into the second port 331 as described herein, the sleeve front portion 1620 may extend through the second port 331 and enter or penetrate the interior cavity 210. As the port sleeve 1610 is further screwed into the second port 331, the sleeve front portion 1620 may advance farther into the interior cavity 210 until the engagement of the sleeve bezel 1614 with the recessed ledge portion 177 prevents further insertion of the port sleeve 1610 into the second port 331. Accordingly, interior cavity penetration depth of the sleeve front portion 1620 may be adjusted by the port sleeve 1610 being screwed into and out of the second port 331 with the maximum interior cavity penetration depth being defined by engagement of the sleeve bezel 1614 with the recessed ledge portion 177. The apparatus, methods, and articles of manufacture described herein are not limited in this regard.

The body portion 110 may include one or more mass portions (e.g., weight portion(s)) at any location on the body portion 110. The one or more mass portions may be integral mass portion(s) or separate mass portion(s) that may be coupled to the body portion 110 at any exterior or interior location on the body portion 110. In the illustrated example of FIGS. 2-24, the body portion 110 may include an external mass portion 435, which may be also referred to herein as the first mass portion, and an internal mass portion 445, which may be also referred to herein as the second mass portion. In one example, the external mass portion 435 may be disc shaped as illustrated in FIGS. 2-26 and further illustrated in detail in FIG. 27 and referred to as mass portion 2700. Referring to FIG. 27, the mass portion 2700 may be cylindrical or cylindrical shaped with a head portion 2702, a shaft portion 2706 and a top portion 2710 including a tool engagement portion 2712. The diameter 2704 of the mass portion 2700 may be greater than the length 2708 of the mass portion 2700. Accordingly, the mass portion 2700 may be disc shaped as illustrated in FIG. 27. In another example, the external mass portion 435 may be similar to any of the mass portions described. In another example, the external mass portion 435 may be similar to any of the mass portions or the disc-shaped mass portion described in U.S. Pat. Nos. 11,369,847, 11,400,352, and 11,707,655, which are incorporated by reference herein. The apparatus, methods, and articles of manufacture described herein are not limited in this regard.

The diameter of the external mass portion 435 may be determined based on one or more properties (e.g., material density) of the materials of construction of the external mass portion 435. The port sleeve 1610 may be configured to receive the external mass portion 435, which may be inserted and secured into the port sleeve 1610 by any of the methods described herein with respect to any of the golf club heads described herein such as being screwed in, press fitted, secured with an adhesive, or welded. In other words, the port sleeve 1610 may function as a sleeve for receiving the external mass portion 435. In one example, as illustrated in FIGS. 2-24, the inner walls of the port sleeve 1610 may be threaded to engage corresponding threads on the external mass portion 435. Accordingly, the inner diameter of the port sleeve 1610 may correspond to the outer diameter of the external mass portion 435. The external mass portion 435 may be fully inserted into the port sleeve 1610 and engage the sleeve bottom 1616. Accordingly, the outer surface of the external mass portion 435 may define a portion of the back wall portion 172 and be flush with the sleeve bezel 1614. Alternatively, the external mass portion 435 may be recessed relative to the sleeve bezel 1614 or protrude outward relative to the sleeve bezel 1614. The external mass portion 435 may be visible to an individual viewing the golf club head 100. In another example, the external mass portion 435 may be configured (e.g., size of diameter, length, etc.) to be directly inserted (e.g., screwed into) and fastened in the second port 331 as described in U.S. Pat. Nos. 11,369,847, 11,400,352, and 11,707,655, which are incorporated by reference herein. In other words, the golf club head 100 may not include the port sleeve 1610, or optionally the port sleeve 1610 may not be used. The apparatus, methods, and articles of manufacture described herein are not limited in this regard.

A center region or a geometric center of the second port 331 may be located at or proximate to the CG of the golf club head 100. Accordingly, a center of gravity of the external mass portion 435 may also be located at or proximate to the CG of the golf club head 100 when the external mass portion 435 is secured in the second port 331 as described herein. The x, y, and z coordinates of the center of gravity of the golf club head 100 may be denoted herein by $CG_X$, $CG_Y$, and $CG_Z$, respectively, and the x, y, and z coordinates of the center of gravity of the external mass portion 435 may be denoted herein by $CG_{M1X}$, $CG_{M1Y}$, and $CG_{M1Z}$, respectively. In one example, a distance on the x-axis between $CG_{M1X}$ and $CG_X$ may be less than or equal to 0.02 inch (0.51 mm), a distance on the y-axis between $CG_{M1Y}$ and $CG_Y$ may be less than or equal to 0.3 inch (7.62 mm), and/or a distance on the z-axis between $CG_{M1Z}$ and $CG_Z$ may be less than or equal to 0.2 inch (5.08 mm). In another example, a distance on the x-axis between $CG_{M1X}$ and $CG_X$ may be less than or equal to 0.1 inch (2.54 mm), a distance on the y-axis between $CG_{M1Y}$ and $CG_Y$ may be less than or equal to 0.6 inch (15.24 mm), and/or a distance on the z-axis between $CG_{M1Z}$ and $CG_Z$ may be less than or equal to 0.4 inch (10.16 mm). In another example, a distance on the x-axis between $CG_{M1X}$ and $CG_X$ may be less than or equal to 0.01 inch (0.25 mm), a distance on the y-axis between $CG_{M1Y}$ and $CG_Y$ may be less than or equal to 0.15 inch (3.81 mm), and/or a distance on the z-axis between $CG_{M1Z}$ and $CG_Z$ may be less than or equal to 0.1 inch (2.54 mm). In yet another example, a distance on the x-axis between $CG_{M1X}$ and $CG_X$ may be less than or equal to 0.25 inch (6.35 mm), a distance on the y-axis between $CG_{M1Y}$ and $CG_Y$ may be less than or equal to 0.25 inch (6.35 mm), and/or a distance on the z-axis between $CG_{M1Z}$ and $CG_Z$ may be less than or equal to 0.25 inch (6.35 mm). As a result, the external mass portion 435 may be interchangeable with another mass portion having a lower mass or a mass portion having a higher mass without causing a relatively large or a significant shift in the CG of the golf club head 100. In one example, for each gram of mass increase of the external mass portion 435, the CG location of the golf club head may shift by less than 0.5% of the $CG_X$ location (x-axis coordinate of the CG), less than 0.5% of the $CG_Y$ location (y-axis coordinate of the CG), and/or less than 0.2% of the $CG_Z$ location (z-axis coordinate of the CG). In another example, for each gram of mass increase of the external mass portion 435, the CG location of the golf club head may shift by less than 0.35% of the $CG_X$ location, less than 0.35% of the $CG_Y$ location, and/or less than 0.15% of the $CG_Z$ location. In yet another example, for each gram of mass increase of the external mass portion 435, the CG location of the golf club head may shift by less than 0.25% of the $CG_X$ location, less than 0.25% of the $CG_Y$ location, and/or less than 0.10% of the $CG_Z$ location. Thus, the external mass portion 435 may be interchangeable with another mass portion having a lower or a greater mass to provide certain performance characteristics for an individual (i.e., customize the performance of the golf club head 100 for a certain individual) without substantially shifting the CG of the golf club head 100 and/or altering the overall or general performance characteristics of the golf club head 100. In one example, as illustrated in FIGS. 2-24, the entire external mass portion 435 may be below the horizontal midplane 520. In another example, a substantial portion of the external mass portion 435 may be below the horizontal midplane 520. The apparatus, methods, and articles of manufacture described herein are not limited in this regard.

Figure 14:
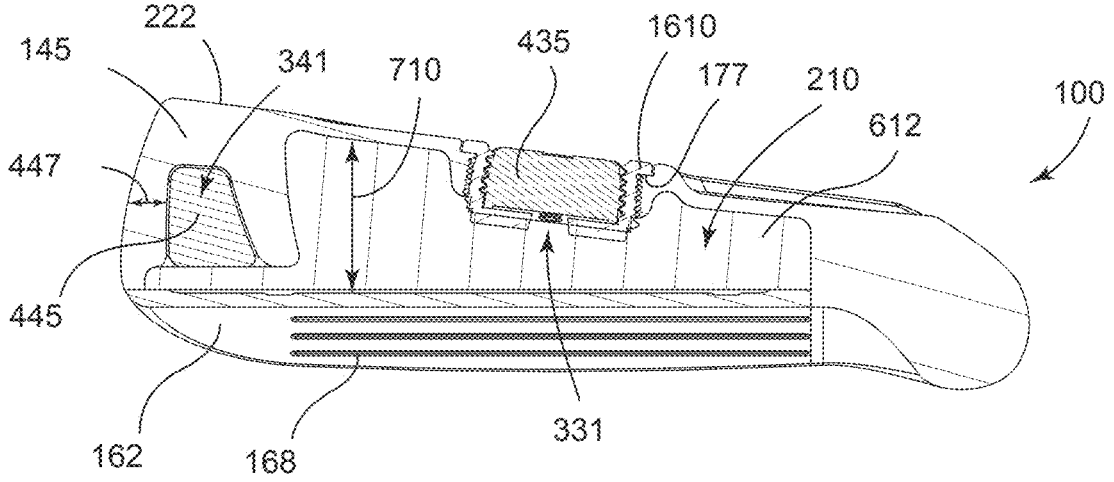
Figure 15:
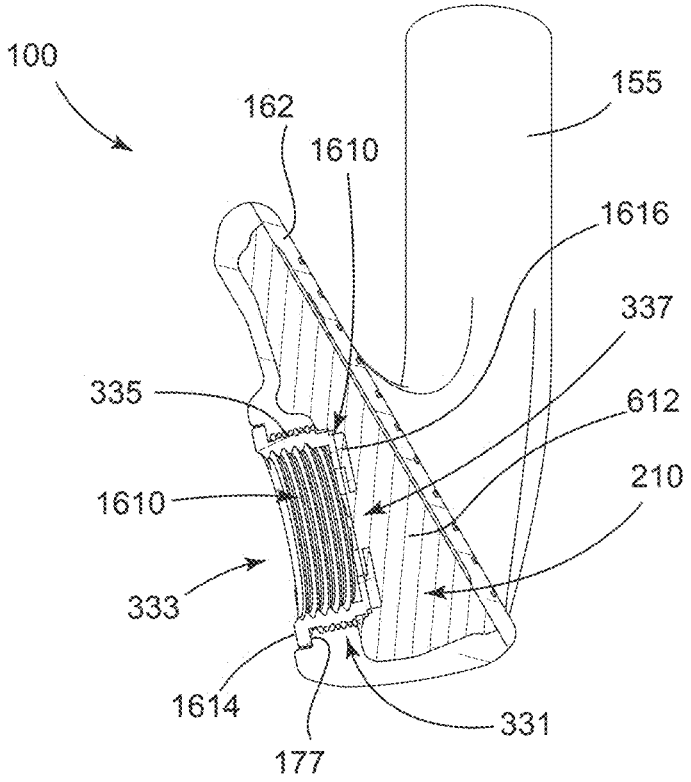
Figure 16:
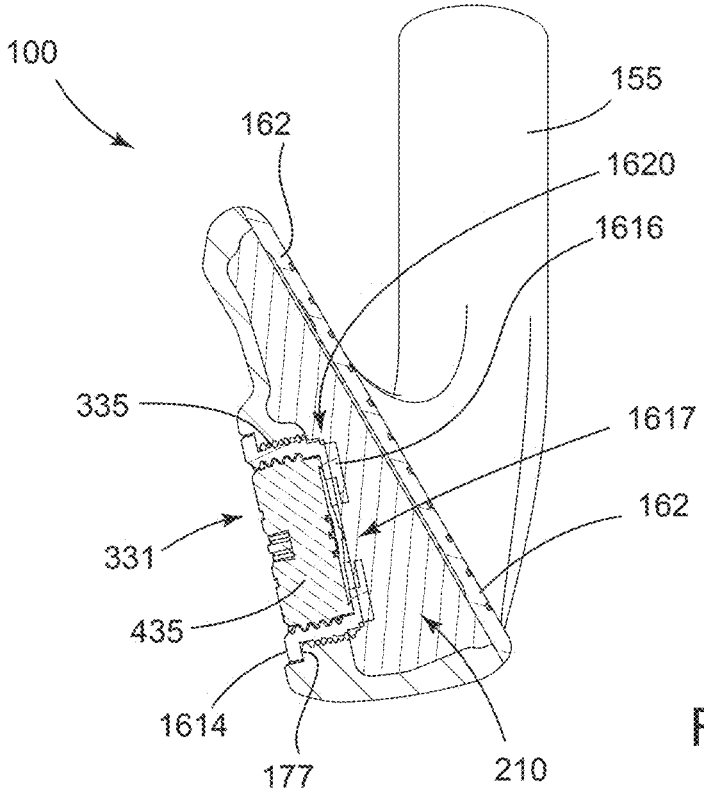
Figure 17:
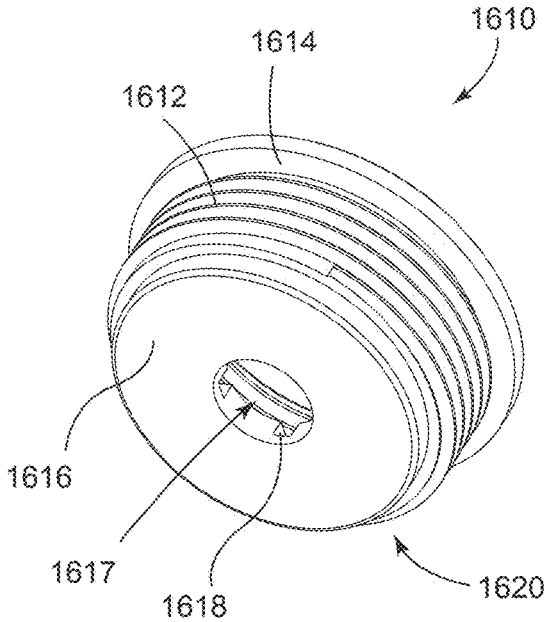
Figure 18:
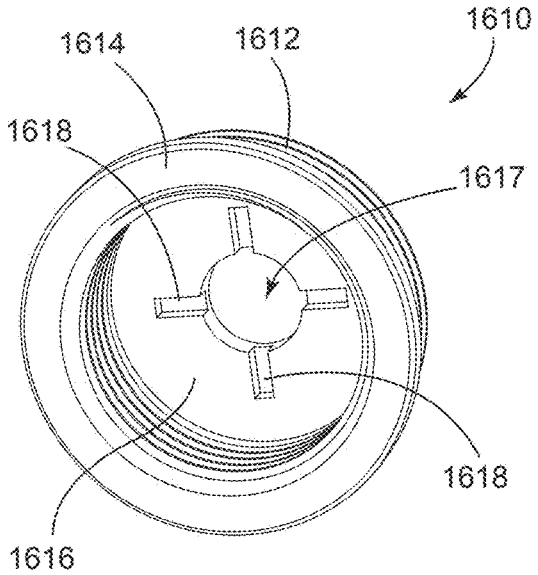
Figure 19:
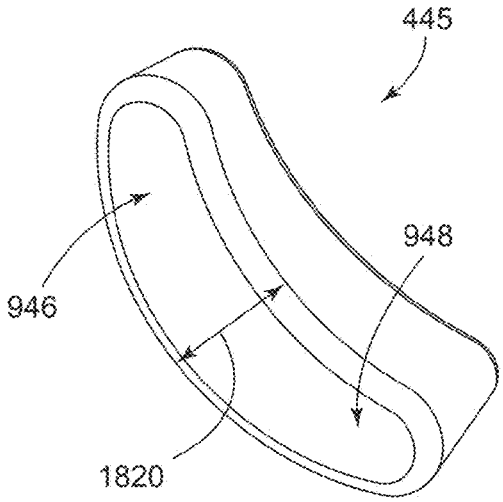
Figure 20:
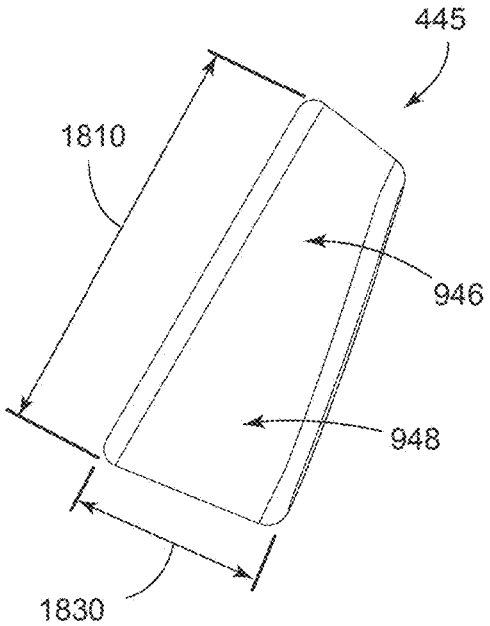
Figure 21:
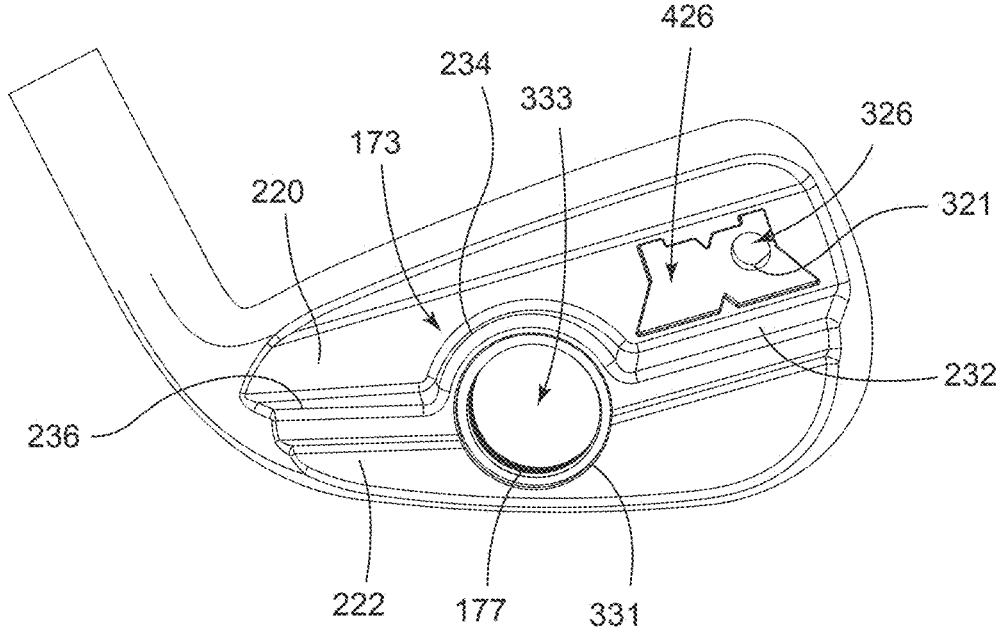
Figure 22:
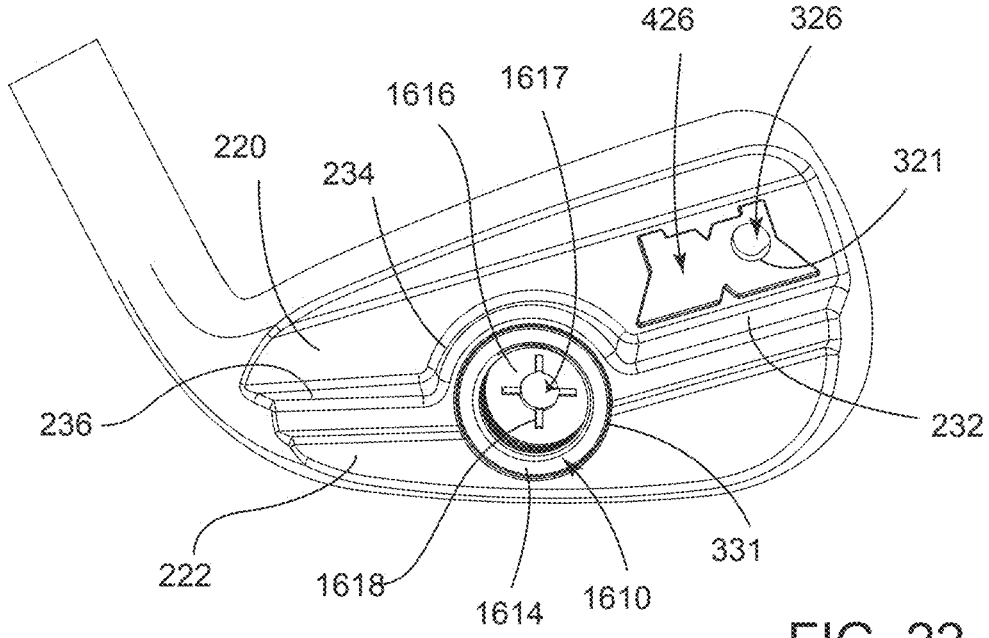
Figure 23:
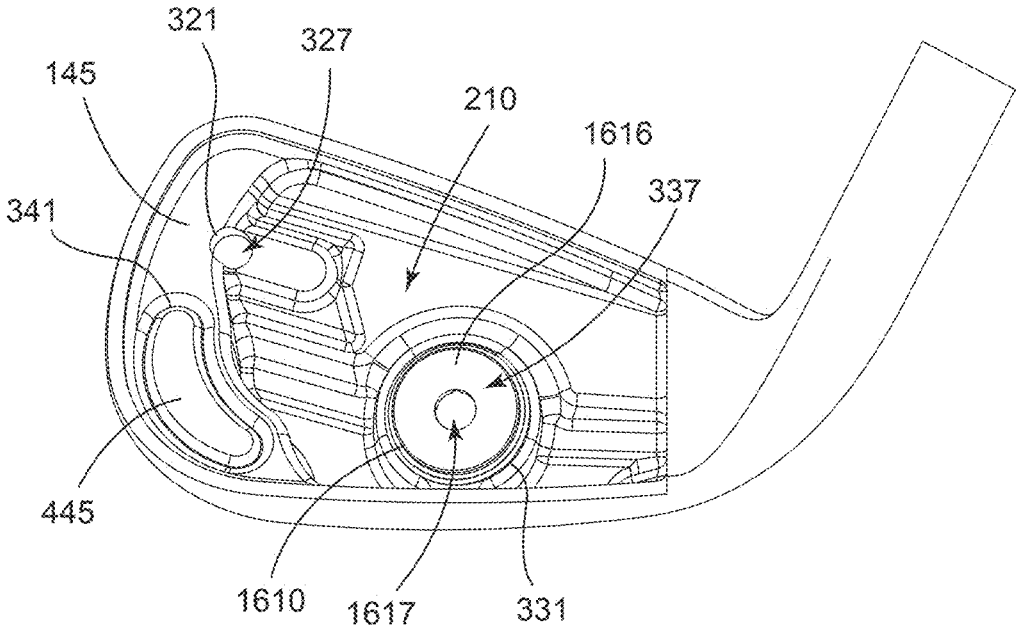

The internal mass portion 445 may be at any location on the body portion 110. In one example, as illustrated in FIGS. 2-24, the internal mass portion 445 may be located proximate to the toe portion edge 142. In another example, the internal mass portion 445 may be located between the external mass portion 435 and the toc portion edge 142. The location of the internal mass portion 445 being proximate to the toe portion edge 142 may increase the moment of inertia of the golf club head 100 to improve performance. All or portions of the internal mass portion 445 may be placed close to the toe portion edge 142 to increase the moment of inertia of the golf club head. Referring to FIGS. 14, in one example, the shortest distance 447 between the internal mass portion 445 and the toc portion edge 142 may be less than or equal to 0.1 inch (2.54 mm). In another example, the shortest distance 447 between the internal mass portion 445 and the toe portion edge 142 may be less than or equal to 0.2 inch (5.08 mm). In another example, the shortest distance 447 between the internal mass portion 445 and the toc portion edge 142 may be less than or equal to 0.3 inch (7.62 mm). In another example, the shortest distance 447 between the internal mass portion 445 and the toc portion edge 142 may be less than or equal to 0.4 inch (10.16 mm). In another example, the shortest distance 447 between the internal mass portion 445 and the toc portion edge 142 may be less than or equal to 0.5 inch (12.70 mm). In another example, the shortest distance 447 between the internal mass portion 445 and the toe portion edge 142 may be less than or equal to half the distance between the external mass portion 435 and the toe portion edge 142. In yet another example, the shortest distance 447 between the internal mass portion 445 and the toe portion edge 142 may be less than or equal to ¼ the distance between the external mass portion 435 and the toc portion edge 142. The apparatus, methods, and articles of manufacture described herein are not limited in this regard.

In one example, as illustrated in FIGS. 2-24, the internal mass portion 445 may have a curved shape that may correspond or approximately correspond to the shape of portions of the toe portion edge 142 that are proximate to the internal mass portion 445. Accordingly, the internal mass portion 445 may be located close to the toe portion edge 142 and have curvature that is the same or substantially the same as the curved shape of the toc portion edge 142. The shape and location of the internal mass portion 445 allows the internal mass portion to be placed close to the toe portion edge and have a mass distribution that closely resembles or resembles the curvature of the portions of the of the toe portion edge that are proximate to the internal mass portion 445. Accordingly, the internal mass portion 445 may increase the moment of inertia (MOI) of the golf club head 100. The location of the internal mass portion 445 along the y-axis and the z-axis may be determined so that the internal mass portion 445 may not greatly affect or shift the location of the CG of the golf club head 100. In other words, the y-coordinate and/or the z-coordinate of the CG of the internal mass portion 445 may be the same or substantially similar (considering manufacturing tolerances) or offset from the y-coordinate and/or z-coordinate of the CG of the golf club head, respectively, by a small amount so that the CG of the golf club head 100 may be maintained relatively low and aft on the golf club head 100. The x, y, and z coordinates of the center of gravity of the internal mass portion 445 may be denoted herein by $CG_{M2X}$, $CG_{M2Y}$, and $CG_{M2Z}$, respectively. In one example, a distance on the x-axis between $CG_{M2X}$ and $CG_X$ may be greater than or equal to 0.5 inch (12.70 mm) and less than or equal to 1.5 inch (38.10 mm), a distance on the y-axis between $CG_{M2Y}$ and $CG_Y$ may be less than or equal to 0.2 inch (5.08 mm), and/or a distance on the z-axis between $CG_{M2Z}$ and $CG_Z$ may be less than or equal to 0.2 inch (5.08 mm). In another example, a distance on the x-axis between $CG_{M2X}$ and $CG_X$ may be greater than or equal to 0.5 inch (12.70 mm) and less than or equal to 2.0 inch (50.80 mm), a distance on the y-axis between $CG_{M2Y}$ and $CG_Y$ may be less than or equal to 0.5 inch (12.70 mm), and/or a distance on the z-axis between $CG_{M2Z}$ and $CG_Z$ may be less than or equal to 0.5 inch (12.70 mm). In another example, a distance on the x-axis between $CG_{M2X}$ and $CG_X$ may be greater than or equal to 0.75 inch (19.05 mm) and less than or equal to 1.75 inch (44.45 mm), a distance on the y-axis between $CG_{M2Y}$ and $CG_Y$ may be less than or equal to 0.25 inch (6.35 mm), and/or a distance on the z-axis between $CG_{M2Z}$ and $CG_Z$ may be less than or equal to 0.25 inch (6.35 mm). In yet another example, a distance on the x-axis between $CG_{M2Z}$ and $CG_X$ may be greater than or equal to 1.0 inch (25.40 mm) and less than or equal to 1.75 inch (44.45 mm), a distance on the y-axis between $CG_{M2Y}$ and $CG_Y$ may be less than or equal to 0.75 inch (19.05 mm), and/or a distance on the z-axis between $CG_{M2Z}$ and $CG_Z$ may be less than or equal to 0.75 inch (19.05 mm). In other examples, the internal mass portion 445 may be the same or substantially the same as any of the internal mass portions described herein. The apparatus, methods, and articles of manufacture described herein are not limited in this regard.

The external mass portion 435 and the internal mass portion 445 may be strategically located to lower the center of gravity of the golf club head 100, whereas the internal mass portion 445 may also increase the MOI of the golf club head 100. Accordingly, the distance between the external mass portion 435 and the internal mass portion 445 along the x-axis may be relatively large to increase the MOI of the golf club head 100, whereas the distances between the external mass portion 435 and the internal mass portion 445 along the y-axis and the z-axis, respectively, may be relatively small to maintain a relatively low position for the center of gravity of the golf club head 100. In one example, a distance on the x-axis between $CG_{M1X}$ and $CG_{M2X}$ may be greater than or equal to 0.5 inch (12.70 mm) and less than or equal to 2.0 inch (50.80 mm), a distance on the y-axis between $CG_{M1Y}$ and $CG_{M2Y}$ may be less than or equal to 0.25 inch (6.35 mm), and/or a distance on the z-axis between $CG_{M1Z}$ and $CG_{M2Z}$ may be less than or equal to 0.1 inch (2.54 mm). In another example, a distance on the x-axis between $CG_{M1X}$ and $CG_{M2X}$ may be greater than or equal to 0.75 inch (19.05 mm) and less than or equal to 1.75 inch (44.45 mm), a distance on the y-axis between $CG_{M1Y}$ and $CG_{M2Y}$ may be less than or equal to 0.2 inch (5.08 mm), and/or a distance on the z-axis between $CG_{M1Z}$ and $CG_{M2Z}$ may be less than or equal to 0.2 inch (5.08 mm). In another example, a distance on the x-axis between $CG_{M1X}$ and $CG_{M2X}$ may be greater than or equal to 1.0 inch (25.40 mm) and less than or equal to 2.0 inch (50.80 mm), a distance on the y-axis between $CG_{M1Y}$ and $CG_{M2Y}$ may be less than or equal to 0.5 inch (12.70 mm), and/or a distance on the z-axis between $CG_{M1Z}$ and $CG_{M2Z}$, may be less than or equal to 0.25 inch (6.35 mm). In yet another example, a distance on the x-axis between $CG_{M1X}$ and $CG_{M2X}$ may be greater than or equal to 1.0 inch (25.40 mm) and less than or equal to 1.75 inch (44.45 mm), a distance on the y-axis between $CG_{M1Y}$ and $CG_{M2Y}$ may be less than or equal to 0.4 inch (10.16 mm), and/or a distance on the z-axis between $CG_{M1Z}$ and $CG_{M2Z}$ may be less than or equal to 0.4 inch (10.16 mm). The apparatus, methods, and articles of manufacture described herein are not limited in this regard.

In one example as illustrated in FIGS. 2-24, the top portion 946 of the internal mass portion 445 may have a smaller volume than the bottom portion 948, and the internal mass portion 445 may have a gradually increasing volume from the top portion 946 to the bottom portion 948. Accordingly, to lower a center of gravity of the golf club head 100, a distance between a center of gravity of the internal mass portion 445 and the sole portion edge 192 may be less than or substantially less than a distance between the center of gravity of the internal mass portion 445 and the horizontal midplane 520. In other words, the shape of the internal mass portion 445 as provided herein allows placement of the internal mass portion 445 close to the toe portion edge and placement of a relatively larger portion of the internal mass portion 445 below the horizontal midplane 520 and relatively close to the sole portion edge 192. As illustrated in the example of FIGS. 2-24, the entire internal mass portion 445 may be below the horizontal midplane 520. In another example, a substantial portion of the internal mass portion 445 may be below the horizontal midplane 520. In another example, the internal mass portion 445 may include a plurality of internal mass portions arranged proximate to the toe portion edge 142 in a top-to-sole and toe-to heel direction, with a greater number or all of the mass portions being located below the horizontal midplane 520. In another example, the internal mass portion 445 may include large portions that extend close to the sole portion edge 192. The apparatus, methods, and articles of manufacture described herein are not limited in this regard.

As illustrated in FIGS. 2-24, the internal mass portion 445 may include a height 1810 in a top-to-sole direction, a width 1820 in a toe-to-heel direction, and a depth 1830 in a front-to-back direction. In one example, as illustrated in FIGS. 2-24, the height 1810 may be greater than the width 1820 and greater than the depth 1830. Accordingly, the internal mass portion 445 may extend proximate to a greater portion of the toc portion edge 142 to increase the moment of inertia of the golf club head 100. In another example, as illustrated in FIGS. 2-24, the depth 1830 may increase in a top-to-sole direction to increase the volume and the mass of the internal mass portion 445 in a top-to-sole direction as described herein. In another example, as illustrated in FIGS. 2-24, the depth 1830 may be greater than the width 1820. Accordingly, the internal mass portion 445 may extend proximate to a greater portion of the toe portion edge 142 and farther aft to increase the moment of inertia of the golf club head 100 and move the center of gravity of the golf club head 100 lower and farther aft. In one example, the height 1810 may be greater than or equal to 0.5 inch (12.70 mm) and less than or equal to 1.25 inch (31.75 mm). In another example, the height 1810 may be greater than or equal to 0.8 inch (20.32 mm) and less than or equal to 1.1 inch (27.94 mm). In yet another example, the height 1810 may be greater than or equal to 0.9 inch (22.86 mm) and less than or equal to 1.0 inch (25.40 mm). In one example, the width 1820 and the depth 1830 may have the same values with any variation being due to manufacturing tolerances. In another example, the width 1820 may be greater than equal to 75% and less than or equal to 125% of the depth 1830. In another example, the depth 1830 may be greater than or equal to 75% and less than or equal to 125% of the width 1820. In another example, the width 1820 and/or the depth 1830 may be greater than or equal to 0.2 inch (5.08 mm) and less than or equal to 0.5 inch (12.70 mm). In another example, the width 1820 and/or the depth 1830 may be greater than or equal to 0.27 inch and less than or equal to 0.37 inch. In another example, the width 1820 and/or the depth 1830 may be greater than or equal to 0.3 inch (7.62 mm) and less than or equal to 0.35 inch (8.89 mm). In another example, the width 1820 and/or the depth 1830 may be greater than or equal to 10% of the height 1810 and less than or equal to 50% of the height 1810. The apparatus, methods, and articles of manufacture described herein are not limited in this regard.

The third port 341 may define a recess or cavity in the body portion 110 that may be shaped to correspond to the shape of the internal mass portion 445 to receive the internal mass portion 445. In one example, as illustrated in FIGS. 2-24, the third port 341 may be shaped to completely receive the internal mass portion 445 so that the outer surface of the internal mass portion is flush with the interior walls of the body portion 110 defining the interior cavity 210. The internal mass portion 445 may be secured inside the third port 341 with one or more adhesives or bonding agents, by welding or soldering, and/or by being press fit. The third port 341 may be defined by a cavity inside a body mass portion 145, which may be an integral portion of the body portion 110, formed with the body portion 110, and/or include the same materials as the materials of the body portion 110. The body mass portion 145 may be located in the toe portion 140 and may extend to the toc portion edge 142 to increase the moment of inertial of the golf club head 100. In the illustrated example of FIGS. 2-24, the body mass portion may extend from the top portion edge 182 to the sole portion edge 192 and extend into the interior cavity 210 from the toe portion edge 142. The shape, size, volume, and/or mass of the body mass portion 145 may be determined to provide certain performance characteristics for the golf club head 100. In one example, as illustrated in FIGS. 2-24, the body mass portion 145 may be located in the toc portion 140, extend to the toc portion edge 142, and extend from the top portion edge 182 to the sole portion edge 192. The shape, size, volume, and/or mass of the body mass portion 145 may vary and depend on various properties of the golf club head 100 including the loft angle 545. The apparatus, methods, and articles of manufacture described herein are not limited in this regard.

The interior cavity 210 may vary in width between the toc portion 140 and the heel portion 150. An interior cavity width 710 may be smaller proximate to the toe portion edge 142 than the interior cavity width 710 at the center portion of the body portion or at the heel portion 150 due to the presence of the body mass portion 145. Accordingly, a greater portion of the mass of the body portion 110 may be closer to the toe portion edge 142 than the heel portion edge 152 to increase the moment of inertia of the body portion 110. In one example, as illustrated in FIGS. 2-24, the interior cavity width 710 may have a maximum value at a location between the external mass portion 435 and the internal mass portion 445. As illustrated in the example of FIGS. 2-24, portions of the interior cavity 210 may extend vertically below the port sleeve 1610 and/or the external mass portion 435 and be farther from the face portion 162 than portions of the port sleeve 1610 and/or the external mass portion 435. Accordingly, in the example illustrated in FIGS. 2-24, a maximum value of the interior cavity width 710, which may be measured in a face-to-back direction, may be between the external mass portion 435 and the internal mass portion 445 in a toe-to-heel direction and between the sole portion edge 192 and the external mass portion 435 in a top-to sole direction. In one example, the maximum value of the interior cavity width 710 may be greater than or equal to 0.4 inch (10.16 mm) and less than or equal to 0.9 inch (22.86 mm). In another example, the maximum value of the interior cavity width 710 may be greater than or equal to 0.5 inch (12.70 mm) and less than or equal to 0.8 inch (20.32 mm). In yet another example, the maximum value of the interior cavity width 710 may be greater than or equal to 0.6 inch (15.24 mm) and less than or equal to 0.7 inch (17.78 mm). As illustrated in the example of FIGS. 2-24, portions of the interior cavity 210 located vertically above the port sleeve 1610 and/or the external mass portion 435 may be farther from the face portion 162 than portions of the port sleeve 1610 and/or the external mass portion 435. The apparatus, methods, and articles of manufacture described herein are not limited in this regard.

In one example, as illustrated in FIGS. 2-24, the second port 331, the badge 428, and the internal mass portion 445 may be located between the external mass portion 435 and the toe portion edge 142. As described herein, the external mass portion 435 may function to lower the center of gravity of the golf club head 100 and shift the center of gravity rearward. The internal mass portion 445 may function to increase the moment of inertia of the golf club head 100. The internal mass portion 445 may also lower and/or shift rearward the center of gravity of the golf club head 100. Additionally, with the bottom portion 948 of the internal mass portion 445 having a greater mass than the top portion 946, a vertical location of the center of gravity of the golf club head 100 may not be largely shifted by the internal mass portion 445 while placing more mass toward the toc portion edge to increase the MOI of the golf club head 100. The apparatus, methods, and articles of manufacture described herein are not limited in this regard.

In one example, the badge 428 may be constructed from a material having a lower density than the material of the body portion 110 to not have a large effect on the mass distribution of the body portion 110. In yet another example, the badge 428 may be made from a material having a relatively large density such as the material form which any of the mass portions may be constructed. Accordingly, the badge 428 may function to increase the moment of inertia of the golf club head 100. The apparatus, methods, and articles of manufacture described herein are not limited in this regard.

The interior cavity 210 may be partially or entirely filled with one or more filler materials (i.e., a cavity filling material), which may include one or more similar or different types of materials. In one example, as illustrated in FIGS. 2-24, the filler material 612 may be a urethane elastomer material that may be curable at room temperature or higher temperatures to accelerate the curing process. In one example, the filler material 612 may be injected into the interior cavity 210 from the first port 321 and/or the second port 331 to fill the interior cavity 210 partially or completely. The first port 321 may serve as an injection port whereas the second port 331 may serve as an exhaust port to allow the air that is displaced in the interior cavity 210 by the filler material to exit the interior cavity 210. Alternatively, the second port 331 may serve as an injection port whereas the first port 321 may serve as an exhaust port. Accordingly, as illustrated in FIGS. 2-24, the filler material 612 may be molded in the shape of the interior cavity 210. After injection of the filler material 612 into the interior cavity 210, the filler material 612 may be allowed to cure. In one example, the filler material 612 may cure at room temperature. In another example, the filler material 612 may be cured at 50 degrees Celsius. In another example, the filler material 612 may be cured at 70 degrees Celsius. In yet another example, the filler material 612 may be cured at 80 degrees Celsius. In another example, the filler material 612 may be similar to any of the filler materials described herein or in any of the incorporated by reference patent documents. In yet another example, the interior cavity 210 may be filled with a first filler material and a second filler material that may be similar to the first filler material and the second filler material of any of the golf club heads described in any of the incorporated by reference patent documents. The apparatus, methods, and articles of manufacture described herein are not limited in this regard.

In one example, the golf club head 100 may have a total weight of greater than or equal to 180 grams and less than or equal to 340 grams. In another example, the golf club head 100 may have a total weight of greater than or equal to 220 grams and less than or equal to 300 grams. In yet another example, the golf club head 100 may have a total weight of greater than or equal to 250 grams and less than or equal to 270 grams. In one example, the weight of the filler material may be greater than or equal to 15 grams and less than or equal to 35 grams. In another example, the weight of the filler material may be greater than or equal to 22 grams and less than or equal to 30 grams. In yet another example, the weight of the filler material may be greater than or equal to 22 grams and less than or equal to 28 grams. The total weight of the filler material 612 may be expressed as a percentage of the total weight of the golf club head 100. Accordingly, the weight of the filler material may comprise greater than or equal to 5% and less than or equal to 19% of the total weight of the golf club head 100. The apparatus, methods, and articles of manufacture described herein are not limited in this regard.

As described herein, the sizes and weights of the external mass portion 435, the internal mass portion 445, and/or the port sleeve 1610 may be determined to affect the moments of inertia and CG location of the golf club head 100 to provide certain performance characteristics for the golf club head 100. The internal mass portion 445 may have a total weight that may be greater than the total weight of the external mass portion 435, the total weight of the port sleeve 1610, and/or the sum of the total weights of the external mass portion 435 and the port sleeve 1610 to increase the MOI of the golf club head 100. In one example, the total weight of the internal mass portion 445 may be greater than or equal to 10 grams and less than or equal to 20 grams. In another example, the total weight of the internal mass portion 445 may be greater than or equal to 12 grams and less than or equal to 16 grams. In yet another example, the total weight of the internal mass portion 445 may be greater than or equal to 13 grams and less than or equal to 15 grams. The apparatus, methods, and articles of manufacture described herein are not limited in this regard.

In one example, the total weight of the external mass portion 435 may be greater than or equal to 5 grams and less than or equal to 11 grams. In another example, the total weight of the external mass portion 435 may be greater than or equal to 7 grams and less than or equal to 9 grams. In another example, the total weight of the external mass portion 435 may be greater than or equal to 6 grams and less than or equal to 8 grams. In another example, the total weight of the external mass portion 435 may be greater than or equal to 25% and less than or equal to 75% of the total weight of the internal mass portion 445. In another example, the total weight of the external mass portion 435 may be greater than or equal to 40% and less than or equal to 60% of the total weight of the internal mass portion 445. In another example, a ratio of a weight of the internal mass portion 445 to a weight of the external mass portion may be greater than or equal to 1.0. In another example, a ratio of a weight of the internal mass portion 445 to a weight of the external mass portion may be greater than or equal to 1.25. In yet another example, a ratio of a weight of the internal mass portion 445 to a weight of the external mass portion may be greater than or equal to 1.25 and less than or equal to 2.0. The apparatus, methods, and articles of manufacture described herein are not limited in this regard.

The port sleeve 1610 may be constructed from a material that has a lower density than the density of the material of the body portion 110 and the density of the material of the external mass portion 435 so that the weight savings from using the port sleeve 1610 may be strategically transferred to other portions of the golf club head 100 to achieve certain performance characteristics. In one example, the port sleeve 1610 may be constructed from an aluminum-based material. In another example, the port sleeve 1610 may be constructed from a titanium-based material. In yet another example, the port sleeve 1610 may be constructed from a polymer material. As described herein, the external mass portion 435 may be constructed from a material having a greater density than the density of the material of the body portion 110. In one example, the external mass portion 435 may be constructed from a tungsten-based material. Accordingly, the total weight of the external mass portion 435 may be greater than the total weight of the port sleeve 1610. In one example, the total weight of the port sleeve 1610 may be greater than or equal to 3 grams and less than or equal to 6 grams. In another example, the total weight of the port sleeve 1610 may be greater than or equal to 3.5 grams and less than or equal to 5 grams. In another example, the total weight of the port sleeve 1610 may be greater than or equal to 4 grams and less than or equal to 4.75 grams. In another example, the total weight of the port sleeve 1610 may be greater than or equal to 25% and less than or equal to 75% of the total weight of the external mass portion 435. In yet another example, the total weight of the port sleeve 1610 may be greater than or equal to 40% and less than or equal to 60% of the total weight of the external mass portion 435. The apparatus, methods, and articles of manufacture described herein are not limited in this regard.

As described herein, the interior cavity 210 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head). (ii) provide structural support for the face portion, and/or (iii) optimize ball travel distance, ball speed, ball launch angle, ball spin rate, ball peak height, ball landing angle and/or ball dispersion. The interior cavity 210 may be filled with a filler material such that the back surface 166 of the face portion is covered with the filler material. Accordingly, the filler material may provide structural support for the relatively thinner portions of the face portion 162.

The resilience of the filler material 612 of the golf club head 100, which is referred to herein as GC1 (i.e., Golf Club No. 1), was tested and compared with the resilience of the filler materials of three example golf clubs, which are referred to herein as GC2. GC3, and CG4. To test each golf club head, the face portion of each golf club head was removed by a milling machine by cutting around the perimeter of the face portion and exposing the filler material in intact for by carefully removing the face portion. The resilience of the filler material of each golf club head was tested using the test equipment and procedures used by United States Golf Association to determine the characteristic time (CT) of a golf club head as provided in R&A Rules Limited and United States Golf Association PROTOCOL FOR MEASURING THE FLEXIBLITY OF A GOLF CLUBHEAD. TPX3004 Rev. 2.0, 9 Apr. 2019; and United States Golf Association PROCEDURE FOR MEASURING THE FLEXIBILITY OF A GOLF CLUBHEAD. USGA-TPX3004 Revision 1.0.0 May 1, 2008. In other words, the CT test equipment used by the United States Golf Association, which includes a pendulum striking the face of a test golf club, was used to determine the resilience of the filler material. Each golf club head was mounted in the fixture of the CT test equipment such that the pendulum struck the face portion at a location approximately 0.75 inch (19.05 mm) from the leading edge of the sole portion edge 192 and at a center of a face groove at that location. Additionally, each golf club head was mounted in the fixture such that the heel-to-toe direction of the golf club head was in a vertical orientation (i.e., face groove oriented vertically). The pendulum was equipped with an accelerometer and accelerometer data was sampled at 10240 Hz to determine the maximum velocity of the pendulum in meters per second (m/s) before contact with the filler material and the maximum velocity of the pendulum in m/s after contact with the filler material during the rebound of the pendulum. For all tests, the average pendulum velocity when striking the filler material was between 0.79 and 0.81 m/s. In one example, the maximum rebound velocity obtained from multiple tests for GC1 was greater than 2.0 m/s and less than 2.09 m/s with an average maximum rebound velocity of 2.06 m/s; the maximum rebound velocity obtained from multiple tests for GC2 was greater than 1.9 m/s and less than 1.98 m/s with an average maximum rebound velocity of 1.95 m/s; the maximum rebound velocities obtained from multiple tests for GC3 and CG4 were similar and greater than 1.71 m/s and less than 1.79 m/s with an average maximum rebound velocity of 1.76. Accordingly, the average maximum rebound velocity of GC1 or golf club head 100 may be greater than the maximum rebound velocity of GC2 by 5%, and greater than the maximum rebound velocities of GC3 and GC4 by 15%. The golf swing speed of an individual may vary between 60 miles per hour (27 m/s) to 170 miles per hour (76 m/s). Accordingly, the increased rebound or resiliency of the filler material 612 of the golf club head 100 as evidenced by the increase in the average maximum rebound velocity of GC1 relative to the average maximum rebound velocities of GC2, CG3, and CG4, may represent a significant improvement in ball speed and consequently ball carry distance when a golf club having a golf club head 100 is used by an individual.

In one example, as the sleeve front portion 1620 penetrates the interior cavity 210 as described herein by the port sleeve 1610 being screwed into the second port 331, the sleeve front portion 1620 may compress the filler material 612 between the sleeve front portion 1620 and the face portion 162 at or proximate to the ball strike region of the face portion 162. Accordingly, driving the port sleeve 1610 into the interior cavity 210 may provide preloading of the filler material 612 at or around the ball strike region of the golf club head 100 to provide a higher coefficient of restitution (COR) for the golf club head 100. The COR of the golf club head 100 may be adjusted by the depth of penetration of the port sleeve 1610 into the interior cavity 210. Accordingly, by engaging the port sleeve 1610 with a tool to screw the port sleeve 1610 into or out of the second port 331, the COR of the golf club head 100 may be adjusted. The COR may be adjusted to a certain value to comply with rules of certain golf governing bodies. For example, the COR of the golf club head 100 may be adjusted to a maximum or a near maximum value permitted by a certain golf governing body such as the United States Golf Association (USGA). In one example, the COR of the golf club head 100 may be greater than or equal to 0.80 and less than or equal to 0.86. In another example, the COR of the golf club head 100 may be greater than or equal to 0.82 and less than or equal to 0.85. In yet another example, the COR of the golf club head may be greater than or equal to 0.82 and less than or equal to a COR value that complies with the maximum COR value allowed by a golf governing body. The apparatus, methods, and articles of manufacture described herein are not limited in this regard.

Figure 24:
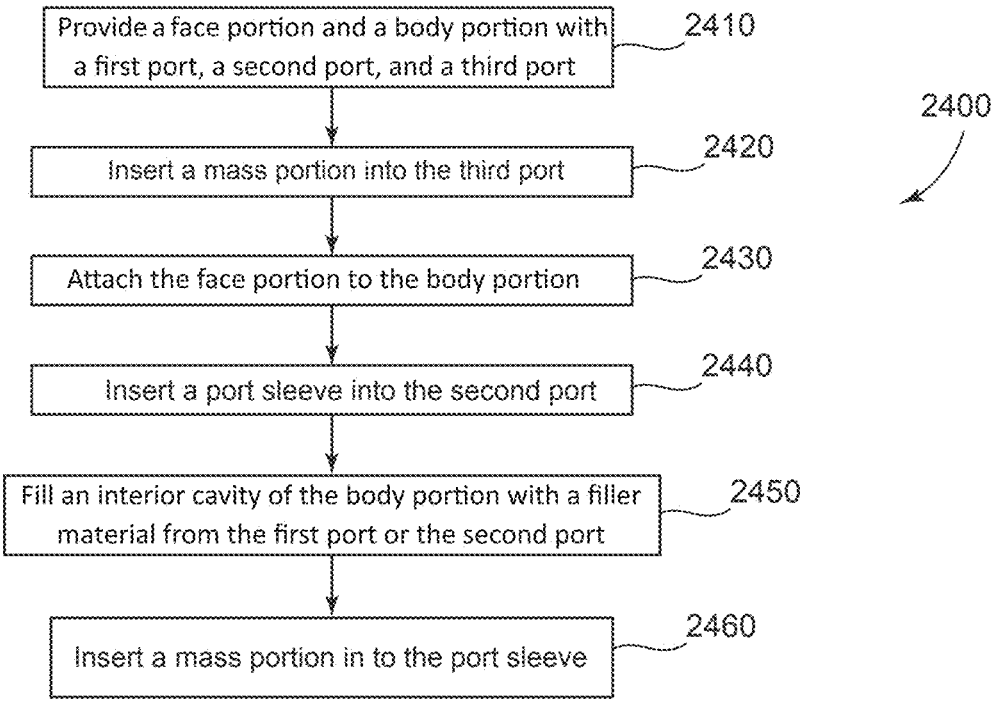

In one example, as illustrated in FIG. 24, a method 2400 of manufacturing the golf club head 100 includes providing a body portion 110, a face portion 162, an external mass portion 435, an internal mass portion 445, a port sleeve 1610, and a badge 428 as described herein (block 2410). The internal mass portion 445 is inserted and/or attached to the body portion 110 inside the third port 341 (block 2420) as described herein. The face portion 162 is attached to the body portion 110 to enclose the interior cavity 210 at the front portion 160 of the body portion 110 (block 2430). The port sleeve 1610 is inserted into the second port 331 by being screwed into the second port 331 (block 2440) as described herein. In one example, the port sleeve 1610 may be completely screwed into the second port 331 until further penetration into the interior cavity 210 is prevented by the sleeve bezel 1614 as described herein. In another example, the port sleeve 1610 may be partially screwed into the second port 331 to allow preloading of one or more filler materials in the interior cavity 210 as described herein. In yet another example, the port sleeve 1610 may be partially screwed into the second port 331 to allow the filler material to fill portions of the second port 331. The interior cavity 210 may be filled with a filler material (block 2450) from the first port 321 or the second port 331 as described herein. The filler material may then cure at room temperature, at a temperature greater than room temperature, and/or using one or more cure cycles. The badge 428 may then be coupled to the body portion 110 over the first port 321 to close the first port 321. As described herein, the badge 428 may be attached to the body portion 110 by being inserted and/or secured inside the recessed portion 426. The external mass portion 435 may then be secured into the second port 331 (block 2460) as described herein. The external mass portion 435 may be removed if required to change the penetration depth of the port sleeve 1610 as described herein and reinstalled inside the second port 331. In other words, the preloading of the filler material 612 may be adjusted at any time. The apparatus, methods, and articles of manufacture described herein are not limited in this regard.

Figure 25:
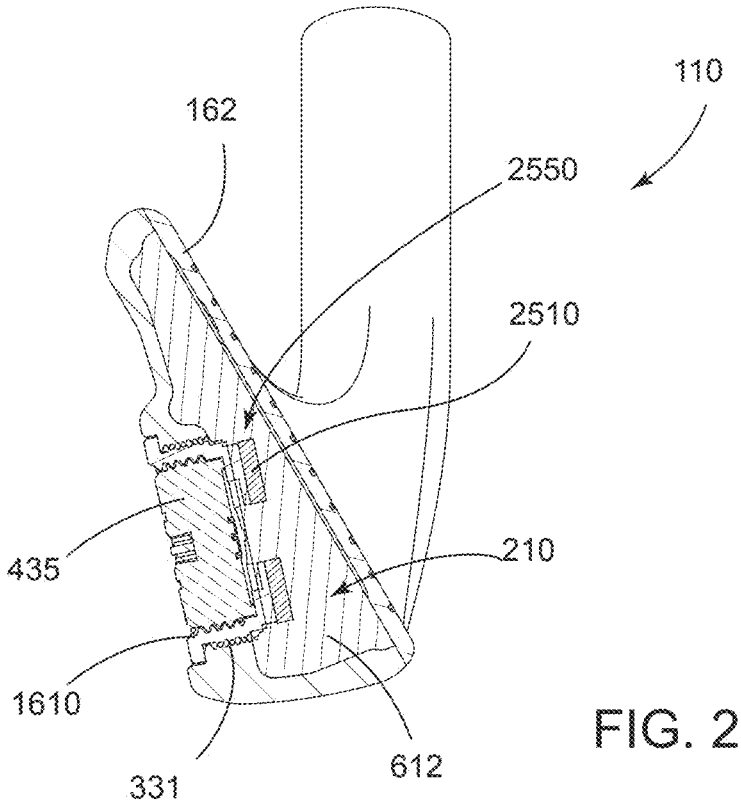
Figure 26:
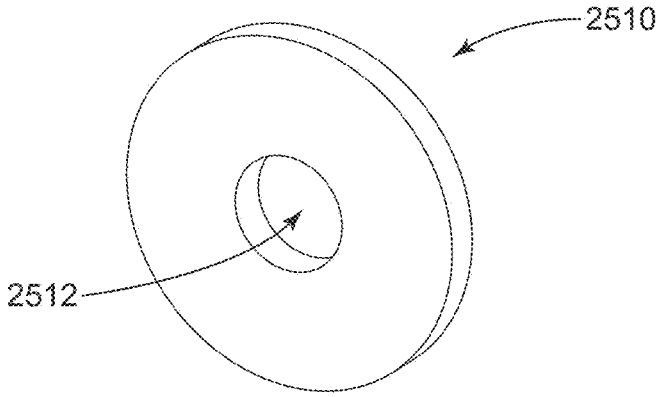
Figure 27:
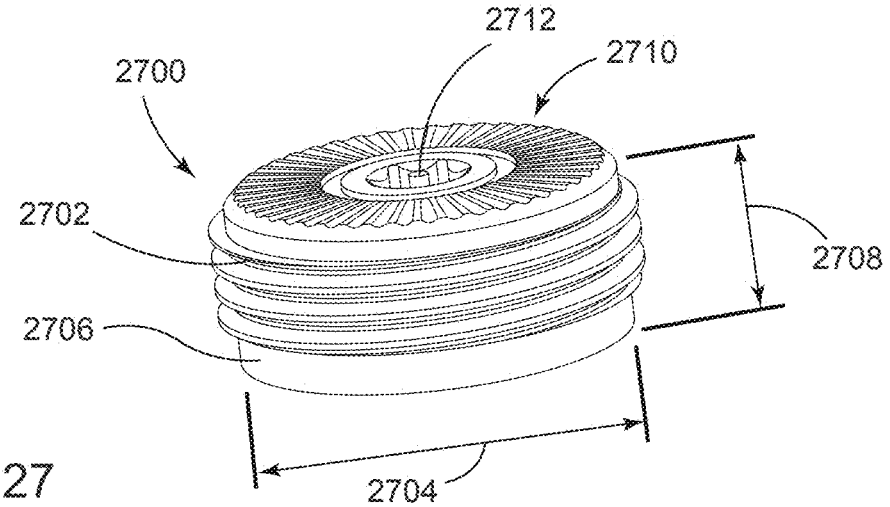
FIGS. 27, 28 and 29 are a mass portion, an example face portion, and another example face portion, respectively, for the golf club head of FIG. 2 according to embodiments of the apparatus, methods, and articles of manufacture described herein.

In one example, as illustrated in FIGS. 25 and 26, the golf club head 100 may include a filler compression portion 2510 between the port sleeve 1610 and the filler material 612. The filler compression portion 2510 may have any shape, size, orientation and/or configuration. In one example, as illustrated in FIGS. FIGS. 25 and 26, the filler compression portion 2510 may be annular and include a center hole 2512. The outer diameter of the filler compression portion 2510 may be the same, greater or smaller than the outer diameter of the port sleeve 1610. In one example, as illustrated in FIGS. FIGS. 25 and 26, the filler compression portion 2510 may have the same or substantially the same outer diameter as the outer diameter of the port sleeve 1610. In another example, the sleeve front portion 1620 may include a circular recess to receive the filler compression portion 2510 therein. As the sleeve front portion 1620 penetrates the interior cavity 210 as described herein by the port sleeve 1610 being screwed into the second port 331, the filler compression portion 2510 may compress the filler material 612 behind the face portion 162 and at or proximate to the ball strike region of the face portion 162. Accordingly, driving the port sleeve 1610 into the interior cavity 210 and using the filler compression portion 2510 may provide preloading of the filler material 612 to provide a higher coefficient of restitution (COR) for the golf club head 100 as described herein. To avoid an excessive force on the face portion 162 due to the preloading of the filler material 612 and possible bulging of the face portion 162, portions of the filler material 612 may flow, displace or move due to the elasticity of the filler material 612 into the center hole 2512 of the filler compression portion 2510 and gaps 2550 inside the interior cavity 210 around the port sleeve 1610 and the filler compression portion 2510. Accordingly, the center hole 2512 and the gaps 2550 may provide certain compression relief to the filler material 612 to prevent bulging of the face portion 162. The apparatus, methods, and articles of manufacture described herein are not limited in this regard.

The filler compression portion 2510 may be constructed from a polymer material having a higher COR than the filler material 612. Accordingly, the filler compression portion 2510 may compress and rebound during use and contribute to increasing the COR of the golf club head 100. In other words, the filler compression portion 2510 may increase the COR of the golf club head 100 by preloading the filler material 612 and by providing a rebounding force on the face during a golf ball strike. Alternatively, the filler compression portion 2510 may be constructed from a relatively more rigid material to provide preloading of the filler material 612. In one example, the filler compression portion 2510 may be constructed from any of the filler materials described herein such as any urethane-based materials, and the filler material 612 may be constructed from a polymer material having a lower COR than the filler compression portion 2510. For example, the filler material 612 may be constructed from a polybutadiene material or any of the filler materials described herein. The filler compression portion, however, may be constructed from any type of material. The apparatus, methods, and articles of manufacture described herein are not limited in this regard.

Figure 30:
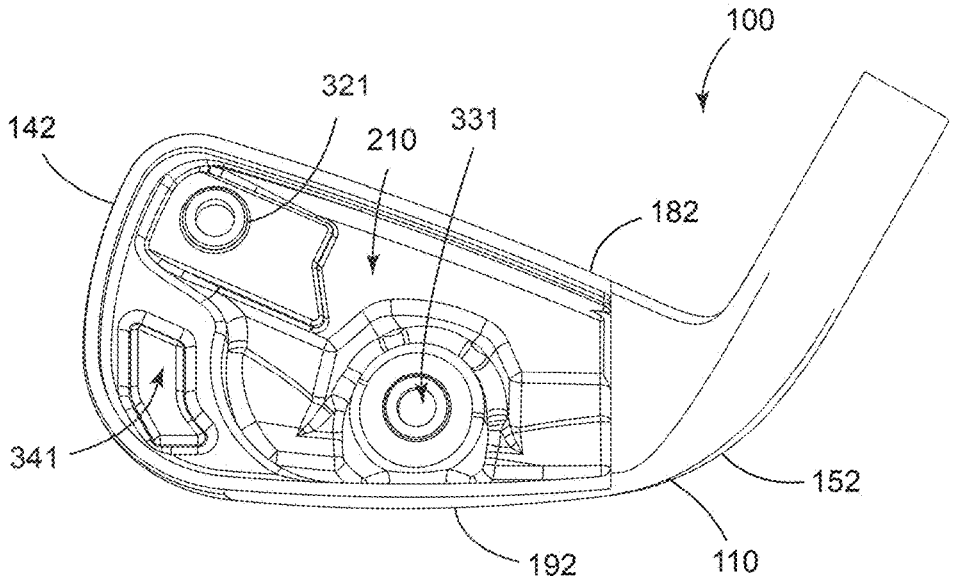
FIGS. 30, 31, 32, and 33, illustrate a front view with the face portion removed, a side view of an internal mass portion, a side perspective view of the internal mass portion of FIG. 31, and a front perspective view of the internal mass portion of FIG. 31, respectively, for another example of the golf club head of FIG. 2 according to embodiments of the apparatus, methods, and articles of manufacture described herein.
Figure 31:
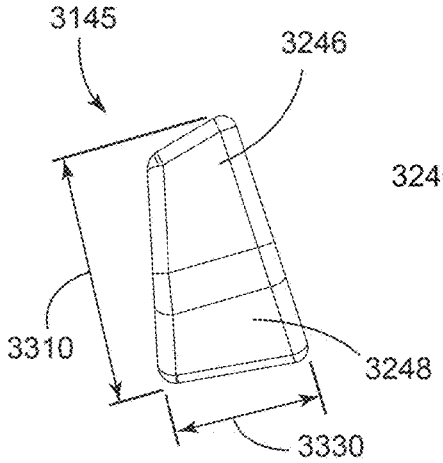
Figure 32:
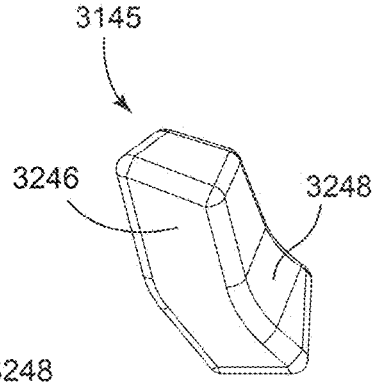
Figure 33:
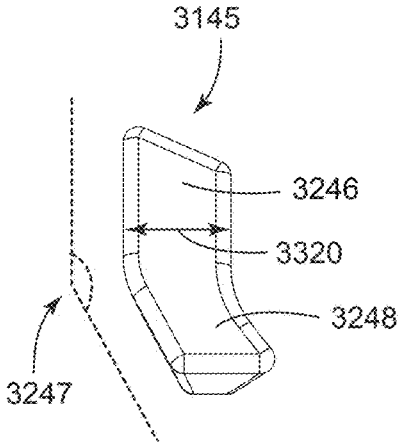

FIG. 30 illustrates another example of the golf club head 100 with an internal mass portion 3145 having a different configuration than the internal mass portion 445. As illustrated in FIGS. 31-33, the internal mass portion 3145 may have an angled shape that may approximately correspond to the shape of the toe portion edge 142. Accordingly, a top portion 3246 of the internal mass portion 3145 may be oriented at an obtuse angle 3247 relative to a bottom portion 3248 of the internal mass portion 3145 to discreetly simulate the curvature of the toc portion edge 142. In another example (not shown), the internal mass portion 3145 may be located close to the toe portion edge 142 and have more than two angled portions oriented at obtuse angles relative to each other to closely discreetly but more closely simulate the curved shape of the toe portion edge 142. In another example, the internal mass portion 3145 may include two separate mass portions that may be located close to the toc portion edge 142. In yet another example, the internal mass portion 3145 may include a plurality of separate mass portions that may be arranged close to the toe portion edge 142 to correspond to the shape of the toc portion edge 142. The apparatus, methods, and articles of manufacture described herein are not limited in this regard.

In one example as illustrated in FIGS. 31-33, the top portion 3246 of the internal mass portion 3145 may have a smaller volume than the bottom portion 3248, and the internal mass portion 3145 may have a gradually increasing volume from the top portion 3246 to the bottom portion 3248. Accordingly, to lower a center of gravity of the golf club head 100, all or a larger portion of the internal mass portion 3145 may be below the horizontal midplane 520, and/or a distance between a center of gravity of the internal mass portion 3145 and the sole portion edge 192 may be less than or substantially less than a distance between the center of gravity of the internal mass portion 3145 and the top portion edge 182. In other words, the shape of the internal mass portion 3145 as provided herein allows placement of the internal mass portion 3145 close to the toc portion edge and placement of all or a relatively larger portion of the internal mass portion 3145 below the horizontal midplane 520. In another example, all portions of the internal mass portion 3145 may be below the horizontal midplane 520. In another example, the internal mass portion 3145 may include a plurality of internal mass portions arranged proximate to the toe portion edge 142 in a top-to-sole and toe-to heel direction, with a greater number or all of the mass portions being located below the horizontal midplane 520. In another example, the internal mass portion 3145 may include large portions that extend close to the sole portion edge 192. The apparatus, methods, and articles of manufacture described herein are not limited in this regard.

As illustrated in FIGS. 31-33, the internal mass portion 3145 may include a height 3310 in a top-to-sole direction, a width 3320 in a toc-to-heel direction, and a depth 3330 in a front-to-back direction. In one example, as illustrated in FIGS. 31-33, the height 3310 may be greater than the width 3320 and greater than the depth 3330. Accordingly, the internal mass portion 3145 may extend proximate to a greater portion of the toc portion edge 142 to increase the moment of inertia of the golf club head 100. In another example, as illustrated in FIGS. 31-33, the depth 3330 may increase in a top-to-sole direction to increase the volume and the mass of the internal mass portion 3145 in a top-to-sole direction as described herein. In another example, as illustrated in FIGS. 31-33, the depth 3330 may be greater than the width 3320. Accordingly, the internal mass portion 3145 may extend proximate to a greater portion of the toe portion edge 142 and farther aft to increase the moment of inertia of the golf club head 100 and move the center of gravity of the golf club head 100 lower and farther aft. The apparatus, methods, and articles of manufacture described herein are not limited in this regard.

The third port 341 may define a recess or cavity in the body portion 110 that may be shaped to correspond to the shape of the internal mass portion 3145 to receive the internal mass portion 3145. In one example, as illustrated in FIGS. 31-33, the third port 341 may be shaped to completely receive the internal mass portion 3145 so that the outer surface of the internal mass portion is flush with the interior walls of the body portion 110 defining the interior cavity 210. The internal mass portion 3145 may be secured inside the third port 341 with one or more adhesives or bonding agents, by welding or soldering, and/or by being press fit. The third port 341 may be defined by a cavity inside a body mass portion 145, which may be an integral portion of the body portion 110, formed with the body portion 110, and/or include the same materials as the materials of the body portion 110. The apparatus, methods, and articles of manufacture described herein are not limited in this regard.

Figure 34:
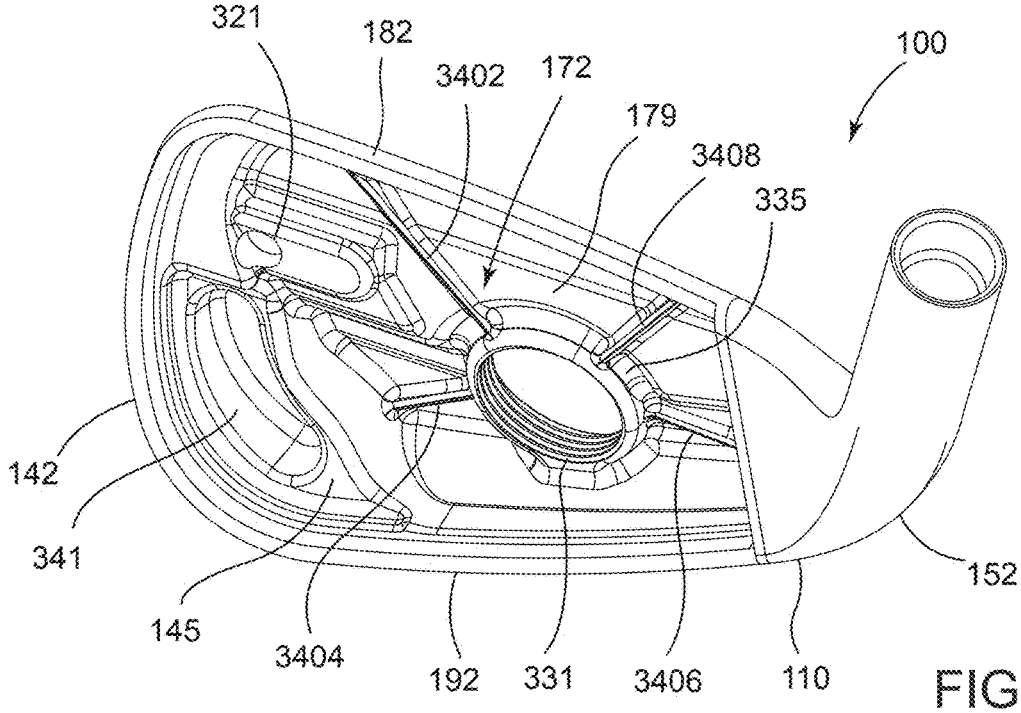
FIGS. 34-36 illustrate a golf club head having rib portions on a back wall portion according to any embodiment of the apparatus, methods, and articles of manufacture described herein.
Figure 35:
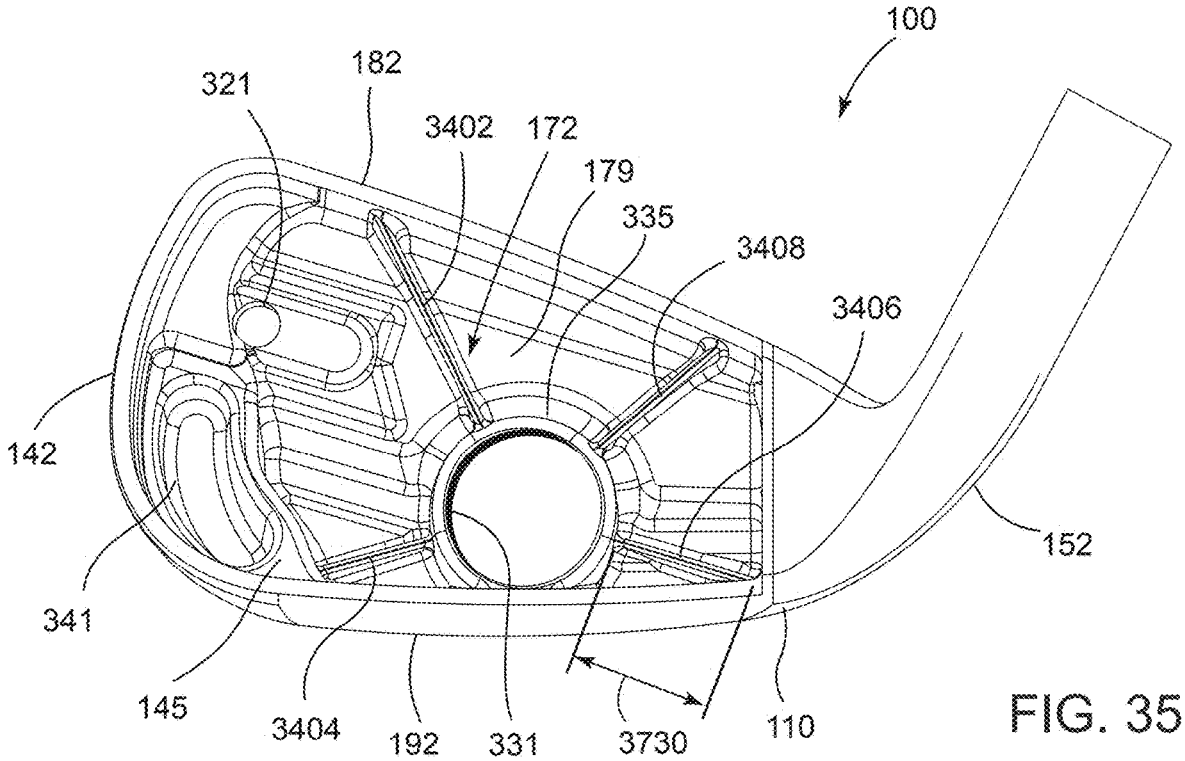
Figure 36:
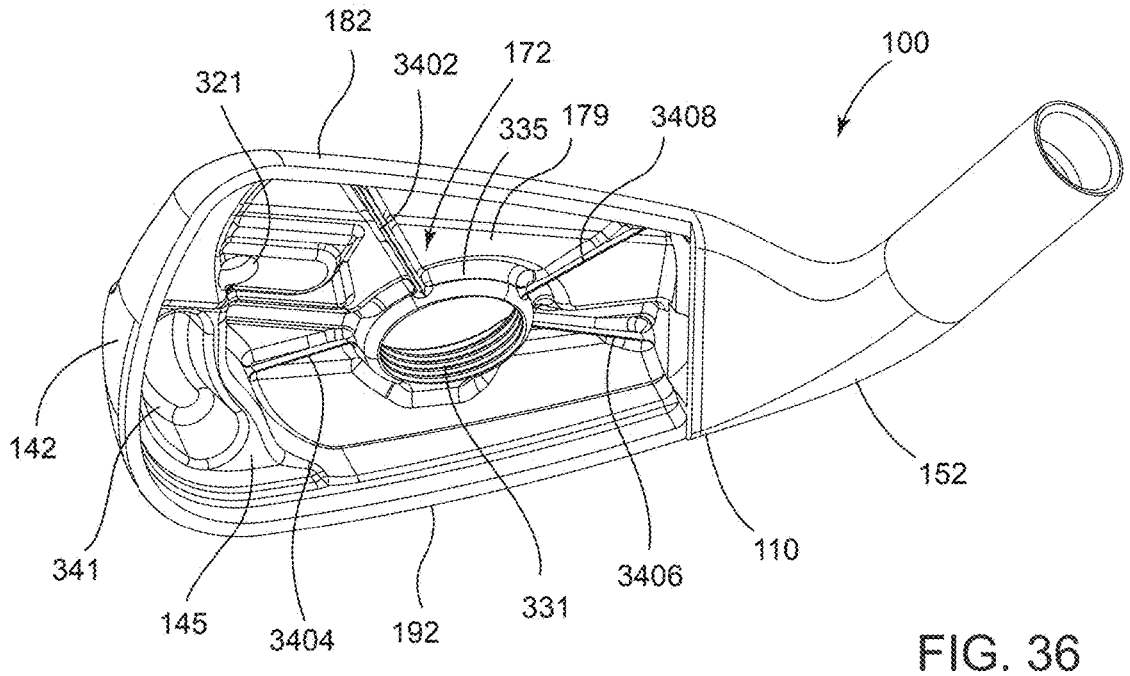

FIGS. 34-36 illustrate another example of the golf club head 100 having one or a plurality of rib portions on the back wall portion 172, which in the example of FIGS. 34-36 extend into the body portion 110 from an inner surface 179 of the back wall portion 172 (i.e., the surface of the back wall portion 172 defining the interior cavity 210). In another example (not shown), the one or the plurality of rib portions may extend outward from the body portion 110. Accordingly, the one or the plurality of rib portions may be located on an outer surface of the back wall portion 172 and extend outward from the outer surface of the back wall portion 172. In yet another example, the one or the plurality of rib portions may include both one or more rib portions that may extend outward from the outer surface of the back wall portion 172 and one or more rib portions that may extend into the body portion 110 from the inner surface 179 of the back wall portion 172. The one or the plurality rib portions (e.g., generally shown as 3402, 3404, 3406, and 3408) on the back wall portion 172 as described herein may provide (i) structural support for the back wall portion 172, (ii) reduce bending or deflection of the back wall portion 172 during a strike on the face portion 162 by a golf ball to provide further compression of the filler material 612 between the face portion 162 and the back wall portion 172, and/or (iii) allow a reduction in a thickness of the back wall portion 172 at one or more portions of the back wall portion 172 without compromising the structural integrity of the back wall portion 172. The apparatus, methods, and articles of manufacture described herein are not limited in this regard.

In one example, as illustrated in FIGS. 34-36, the plurality of rib portions may include four rib portions, which are shown in FIGS. 34-36 as a first rib portion 3402, a second rib portion 3404, a third rib portion 3406, and a fourth rib portion 3408. The first rib portion 3402 may extend from the port wall 335 of the second port 331 toward the top portion edge 182 and the toe portion edge 142 in a slanted or diagonal orientation. The first rib portion 3402 may extend from the port wall 335 to a location on the body portion 110 that may define a transition portion between the back wall portion 172 and the top portion edge 182. In other words, an end portion of the first rib portion 3402 may be attached to or form an integral portion of a perimeter portion of the back wall portion 172 and/or the top portion edge 182. The second rib portion 3404 may extend from the port wall 335 toward the sole portion edge 192 and the toe portion edge 142 in a slanted or diagonal orientation. The second rib portion 3404 may extend from the port wall 335 to the body mass portion 145. The third rib portion 3406 may extend from the port wall 335 toward the sole portion edge 192 and the heel portion edge 152 in a slanted or diagonal orientation. The third rib portion 3406 may extend from the port wall 335 to a location on the body portion 110 that may define a transition portion between the back wall portion 172 and the sole portion edge 192. In other words, an end portion of the third rib portion 3406 be attached to or form an integral portion of a perimeter portion of the back wall portion 172 and/or the sole portion edge 192. The fourth rib portion 3408 may extend from the port wall 335 toward the top portion edge 182 and the heel portion edge 152 in a slanted or diagonal orientation. The fourth rib portion 3408 may extend from the port wall 335 to a location on the body portion 110 that may define a transition portion between the back wall portion 172 and/or the top portion edge 182. In other words, an end portion of the fourth rib portion 3408 be attached to or form an integral portion of a perimeter portion of the back wall portion 172 and/or the top portion edge 182. Accordingly, as illustrated in FIGS. 34-36, the first rib portion 3402, the second rib portion 3404, the third rib portion 3406 and the fourth rib portion 3408 may be radially arranged on the back wall portion 172 and extend outward from the port wall 335 toward opposing corner regions of the body portion 110. In other words, each of the first rib portion 3402, the second rib portion 3404, the third rib portion 3406 and the fourth rib portion 3408 may be located in a corresponding quadrant of the back wall portion 172 to provide structural support to the back wall portion 172 as described herein. While the above example may describe a particular number of rib portions, the back wall portion 172 may include any number of radially arranged rib portions (e.g., two, three, four or more number of rib portions). The apparatus, methods, and articles of manufacture described herein are not limited in this regard.

Figure 37:
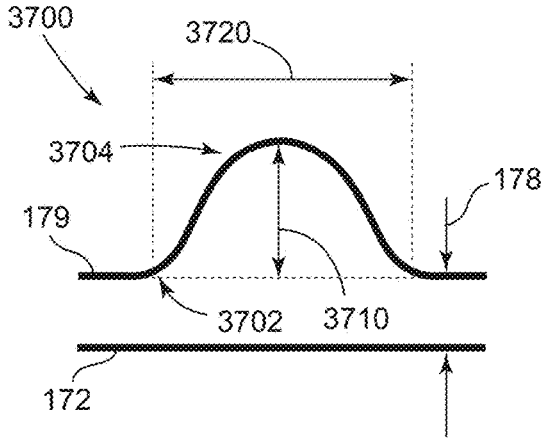
FIGS. 37-40 illustrate schematic cross-sectional view of example rib portions on a back wall portion of a golf club head according to any embodiment of the apparatus, methods, and articles of manufacture described herein.

Each rib portion of the plurality of rib portions described herein may be defined by a wall or projection extending outward and into the interior cavity 210 from the inner surface 179 of the back wall portion 172. As illustrated in FIGS. 34-36 and schematically in FIG. 37, a rib portion 3700 may project from a chamfered or rounded base portion 3702 at the inner surface 179 of the back wall portion 172 to a rounded peak portion 3704. The rounded base portions 3702 and the rounded peak portion 3704 may reduce stress concentration at or around the rib portion 3700. The rib portion 3700 may include a rib portion height 3710, which may be defined by a distance between the peak portion 3702 and the inner surface 179 of the back wall portion 172, a rib portion width 3720, which may be defined by a distance between the rounded base portions 3702, and a rib portion length 3730 (shown in FIG. 35). As illustrated in FIG. 37, the back wall portion thickness 178 of the back wall portion 172 may be less than the rib portion height 3710. The rib portion 3700 may define a thicker portion of the back wall portion 172 to provide structural support for the back wall portion 172. In other words, a thickness of the back wall portion 172 at the rib portion 3700 may be the sum of the back wall portion thickness 178 and the rib portion height 3710. In one example, the rib portion height 3710 and/or the rib portion width 3720 may be greater than or equal to 0.020 inch (0.508 mm) and less than or equal to 0.075 inch (1.905 mm). In another example, the rib portion height 3710 and/or the rib portion width 3720 may be greater than or equal to 0.040 inch (1.016 mm) and less than or equal to 0.100 inch (2.540 mm). In another example, the rib portion height 3710 and/or the rib portion width 3720 may be greater than or equal to 0.055 inch (1.397 mm) and less than or equal to 0.150 inch (3.810 mm). In another example, the rib portion height 3710 and/or the rib portion width 3720 may remain constant along the rib portion length 3730. In another example, the rib portion height 3710 and/or the rib portion width 3720 may vary along the rib portion length 3730. In another example, the rib portion height 3710 may vary and the rib portion width 3720 may remain constant along the rib portion length 3730. In yet another example, the rib portion height 3710 may remain constant and the rib portion width 3720 may vary along the rib portion length 3730. The rib portion height 3710, the rib portion width 3720, and/or the cross-sectional shape of the rib portion 3700 may be configured along the rib portion length 3730, which may also be configured, to provide (i) structural support for the back wall portion 172, (ii) reduce bending or deflection of the back wall portion 172 during a golf ball strike on the face portion 162, and/or (iii) allow a reduction in thickness of the back wall portion 172 at all or portions of the back wall portion 172 without compromising the structural integrity of the back wall portion 172. The apparatus, methods, and articles of manufacture described herein are not limited in this regard.

Figure 38:
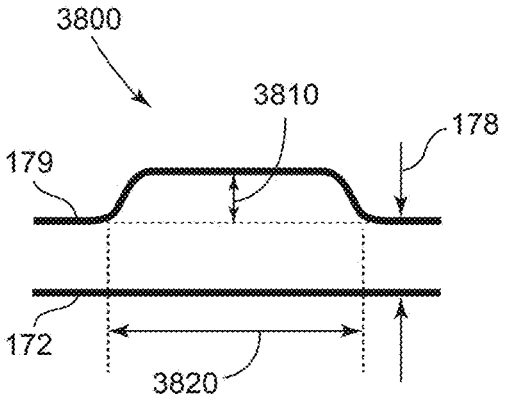

In another example, as illustrated in FIG. 38, a rib portion 3800 may be defined by a planar and thicker portion of the back wall portion 172. The rib portion 3800 may have a rib portion height 3810, which may be uniform or generally uniform along the rib portion width 3820 of the rib portion 3800 as illustrated in FIG. 38. Accordingly, the back wall portion thickness at the rib portion 3800 may be the sum of the back wall portion thickness 178 outside the rib portion 3800 and the rib portion height 3810. The rib portion 3800 may extend at a certain rib portion width 3820 on the back wall portion 172 and have the same or similar cross-sectional shape as the back wall portion 172. In one example, as illustrated in FIG. 38, the rib portion 3800 may have a planar top portion. In another example, the rib portion 3800 may have curved (i.e., concave or convex) top portion. In another example, as illustrated in FIG. 38, the rib portion width 3820 may be greater than the rib portion height 3810. In yet another example, the rib portion width 3820 may be less than the rib portion height 3810. The apparatus, methods, and articles of manufacture described herein are not limited in this regard.

Figure 39:
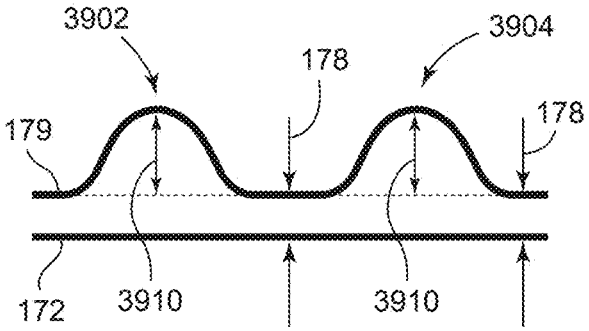

In another example, as illustrated in FIG. 39, the back wall portion 172 may include two relatively closely spaced rib portions, which are shown by example as rib portion 3902 and rib portion 3904, and which may be similar in cross section to the rib portion 3700. In one example, as illustrated in FIG. 39, the rib portion 3902 and the rib portion 3904 may have the same rib portion height 3910. In another example, the rib portion 3902 and the rib portion 3904 may have different rib portion heights. In another example, the rib portion 3902 and the rib portion 3904 may have different rib portion widths. In another example, the rib portion 3902 and the rib portion 3904 may be parallel. In another example, the rib portion 3902 and the rib portion 3904 may diverge in a direction between a center portion of the back wall portion 172 toward an outer perimeter of the back wall portion 172. In yet another example, the rib portion 3902 and the rib portion 3904 may converge in a direction between a center of the back wall portion 172 toward an outer perimeter of the back wall portion 172. The apparatus, methods, and articles of manufacture described herein are not limited in this regard.

Figure 40:
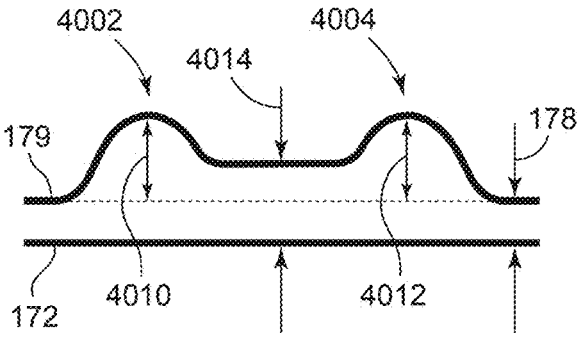

In yet another example, as illustrated in FIG. 40, the back wall portion 172 may include one or more relatively closely spaced rib portions, which are shown as rib portion 4002 and rib portion 4004. The space between the rib portion 4002 and the rib portion 4004 may define a relatively thicker portion of the back wall portion 172. Accordingly, the back wall portion 172 may have a first back wall portion thickness, which is defined by the back wall portion thickness 178, a second back wall portion thickness 4014 between the rib portion 4002 and the rib portion 4004, a third back wall portion thickness that may be defined by the sum of the rib portion height 4010 of the rib portion 4002 and the back wall portion thickness 178, and a fourth back wall portion thickness that may be defined by the sum of the rib portion height 4012 of the rib portion 4004 and the back wall portion thickness 178. The second back wall portion thickness 4014 may be greater than the back wall portion thickness 178. The third back wall portion thickness and the fourth back wall portion thickness may be greater than the second back wall portion thickness 4014. The third back wall portion thickness and the fourth back wall portion thickness may be the same or differ. The apparatus, methods, and articles of manufacture described herein are not limited in this regard.

Figure 41:
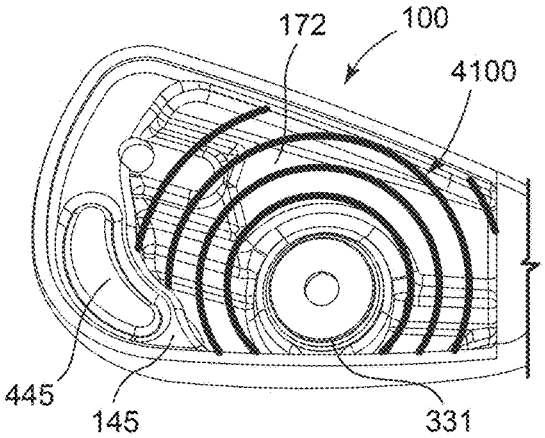
FIGS. 41-46 each illustrates an example golf club head having rib portions on a back wall portion according to any embodiment of the apparatus, methods, and articles of manufacture described herein.
Figure 42:
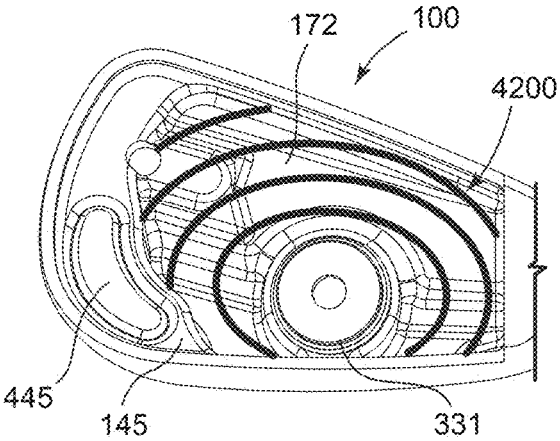
Figure 43:
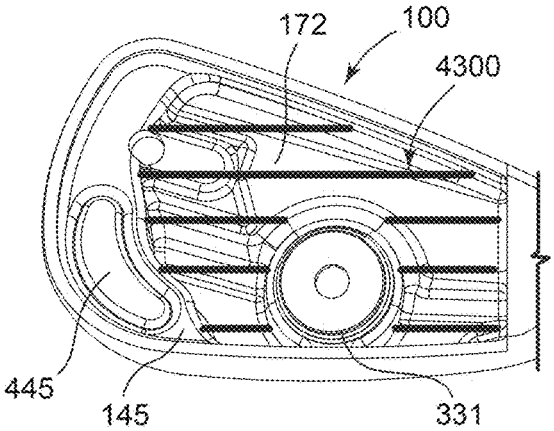
Figure 44:
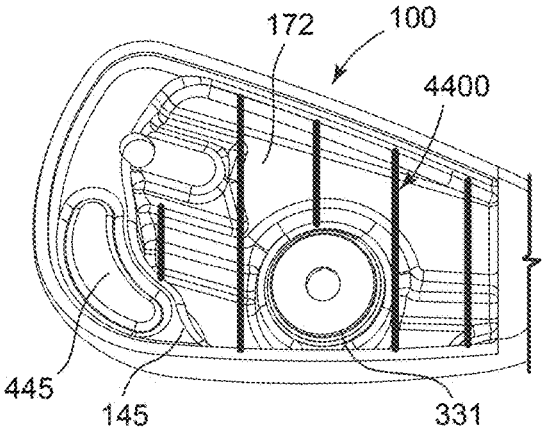
Figure 45:
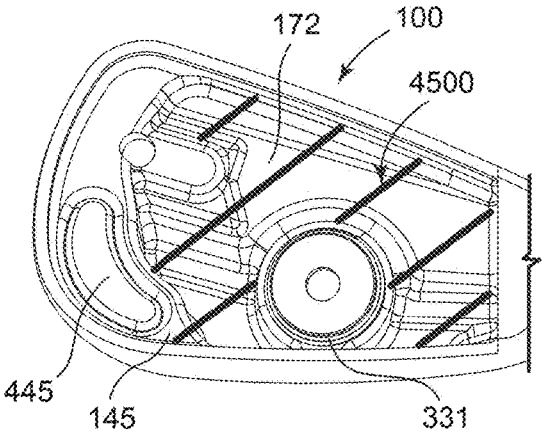
Figure 46:
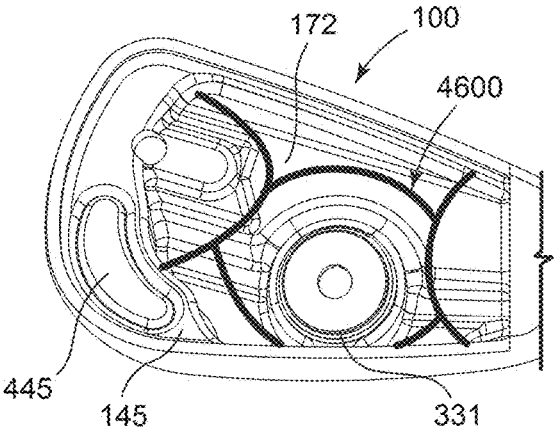

Although the example of FIGS. 34-36 may illustrate radially arranged rib portions, the apparatus, methods, and articles of manufacture as described herein may include rib portions configured in various positions or orientations. In one example, as illustrated in FIG. 41, the back wall portion 172 may include one or more circular rib portions 4100, which may be at any location on the back wall portion 172. In the example of FIG. 41, the circular rib portions 4100 (schematically illustrated in FIG. 41) may be concentrically arranged with the second port 331. In another example, one or more of the circular rib portions 4100 may not be concentrically arranged with each other and/or with the second port 331. In another example, as illustrated in FIG. 42, the back wall portion 172 may include one or a plurality of elliptical or non-circular rib portions 4200 (schematically illustrated in FIG. 42). In yet another example, as illustrated in FIG. 43, the back wall portion 172 may include one or more horizontally arranged rib portions 4300 (schematically illustrated in FIG. 43). In yet another example, as illustrated in FIG. 44, the back wall portion 172 may include one or more vertically arranged rib portions 4400 (schematically illustrated in FIG. 44). In yet another example, as illustrated in FIG. 45, the back wall portion 172 may include one or more diagonally arranged rib portions 4500 (schematically illustrated in FIG. 45). The diagonally arranged rib portions 4500 may be in any non-vertical or non-horizontal direction. In yet another example, as illustrated in FIG. 46, the back wall portion 172 may include a plurality of curved rib portions 4600 (schematically illustrated in FIG. 46). In yet another example, the back wall portion 172 may include any two or more of the rib portions described herein and illustrated in FIGS. 34-46. The back wall portion 172 may include any number of linear or curved rib portions in any geometric or non-geometric arrangement to provide certain performance characteristics for the golf club head 100. The apparatus, methods, and articles of manufacture described herein are not limited in this regard.

The rib portions of the back wall portion as described herein may be used on any type of golf head. In one example, one or more rib portions as described herein may be used on a golf club head that does not have any ports and/or mass portions integral with or coupled to the back wall portion. In another example, one or more rib portions as described herein may be used on a golf club head that does not have any filler material in the interior cavity of the golf club head. Accordingly, the back wall portion of any golf club head may include any number of linear or curved rib portions in any geometric or non-geometric arrangement, such as the examples described and illustrated herein, to provide certain performance characteristics for the golf club. The apparatus, methods, and articles of manufacture described herein are not limited in this regard.

Any of the rib portions described herein may have any length, width, and/or height to provide certain performance characteristics for a golf club head. In one example, each rib portion may increase in width and/or height from a perimeter portion of the back wall portion toward a center portion of the back wall portion. In another example, each rib portion may increase in width from a perimeter portion of the back wall portion toward a center portion of the back wall portion. In yet another example, each rib portion may vary in height and/or width at certain locations along the length of the rib portion depending on the thickness of the back wall portion at or proximate to those locations. To optimize performance of a golf club head, each rib portion may be configured in height, width, length, location, and/or shape depending on the thickness of the back wall portion, location of one or more mass portions and/or ports on the back wall portion, any other structural features of the back wall portion, material of construction of the back wall portion, different characteristics of any filler material in the golf club head, and/or other specific or general features and/or characteristics of the golf club head. In the example described herein, rib portions extend into the body portion 110 from an inner surface 179 of the back wall portion 172. In another example, rib portions may extend outward from an outer surface of the back wall portion 172. In yet another example, the back wall portion 172 may include one or more rib portions that extend into the body portion from the inner surface 179 of the back wall portion and one or more rib portions may extend outward from an outer surface of the back wall portion 172. The apparatus, methods, and articles of manufacture described herein are not limited in this regard.

Figure 47:
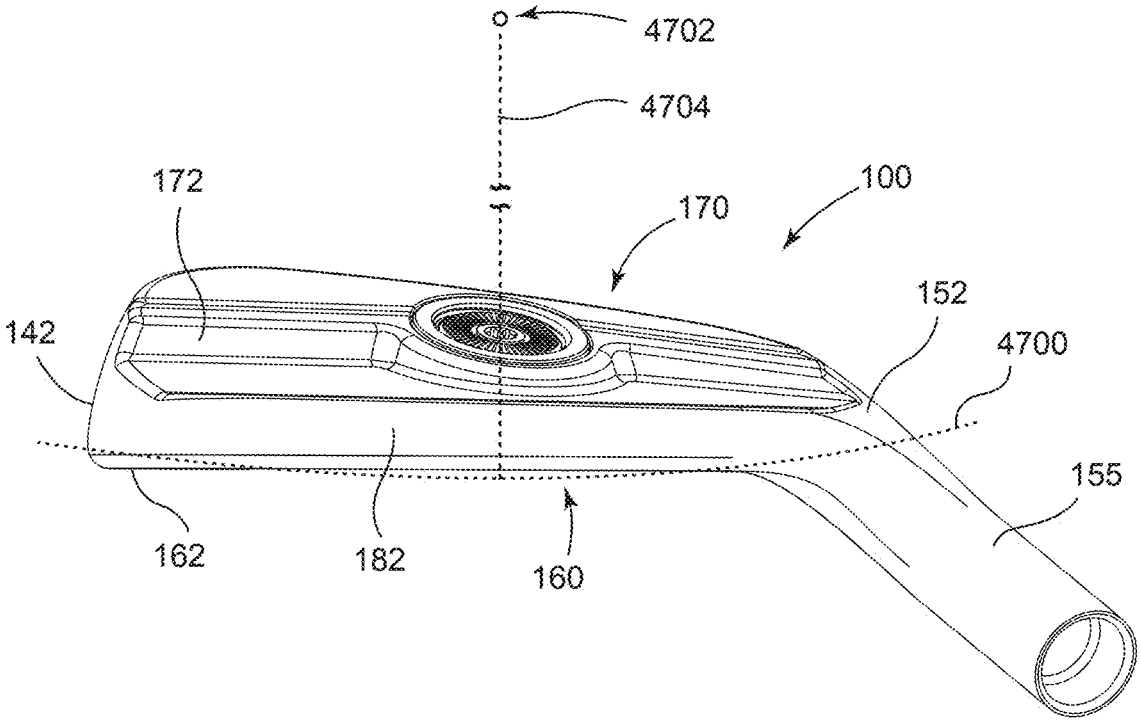
FIGS. 47 and 48 show a top view and a side view, respectively, of another example of a golf club head according to any embodiment of the apparatus, methods, and articles of manufacture described herein.

In one example, as illustrated in FIG. 47, the face portion 162 or the front surface 164 of the face portion 162 may include horizontal curvature 4700 (schematically illustrated in FIG. 47), which may also be referred to herein as face bulge, extending between the toe portion edge 142 and the heel portion edge 152. The horizontal curvature 4700 may be defined by a segment of a circle having a center 4702 located aft of the golf club head 100 with a bulge radius 4704. In one example, the bulge radius 4704 may be greater than or equal to 7 inches (152.4 mm) and less than or equal to 15 inches (381 mm). In another example, the bulge radius 4704 may be greater than or equal to 8 inches (203.2 mm) and less than or equal to 12 inches (304.8 mm). In another example, the bulge radius 4704 may be greater than or equal to 6 inches (152.4 mm) and less than or equal to 10 inches (254 mm). In yet another example, the bulge radius 4704 may be greater than or equal to 6 inches (152.4 mm) and less than or equal to 25 inches (635 mm). For an off-center golf ball strike on the face portion 162, the horizontal curvature 4700 or bulge may impart a horizontal spin on the ball to optimize ball trajectory toward a target line (i.e., a target line of an on-center hit). The apparatus, methods, and articles of manufacture described herein are not limited in this regard.

Figure 48:
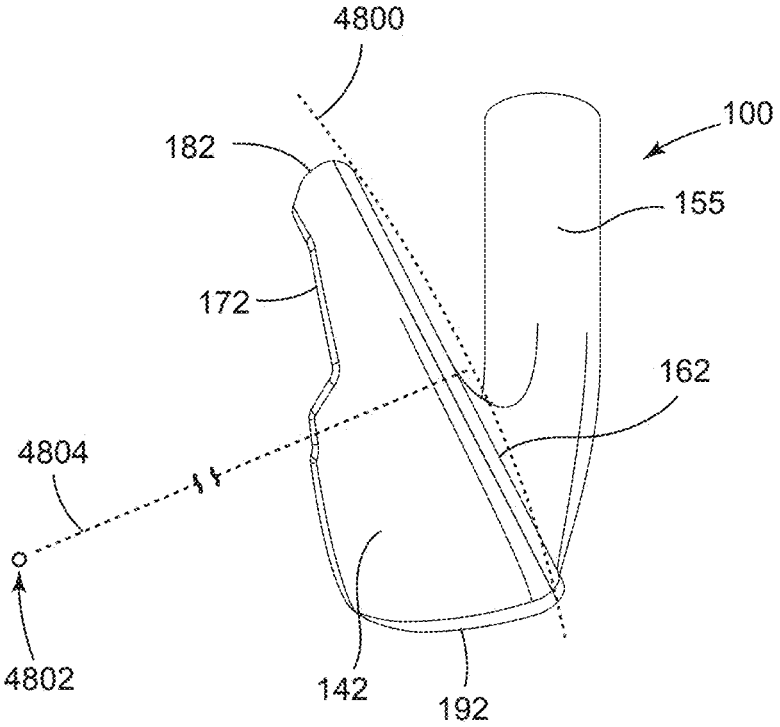
Figure 49:
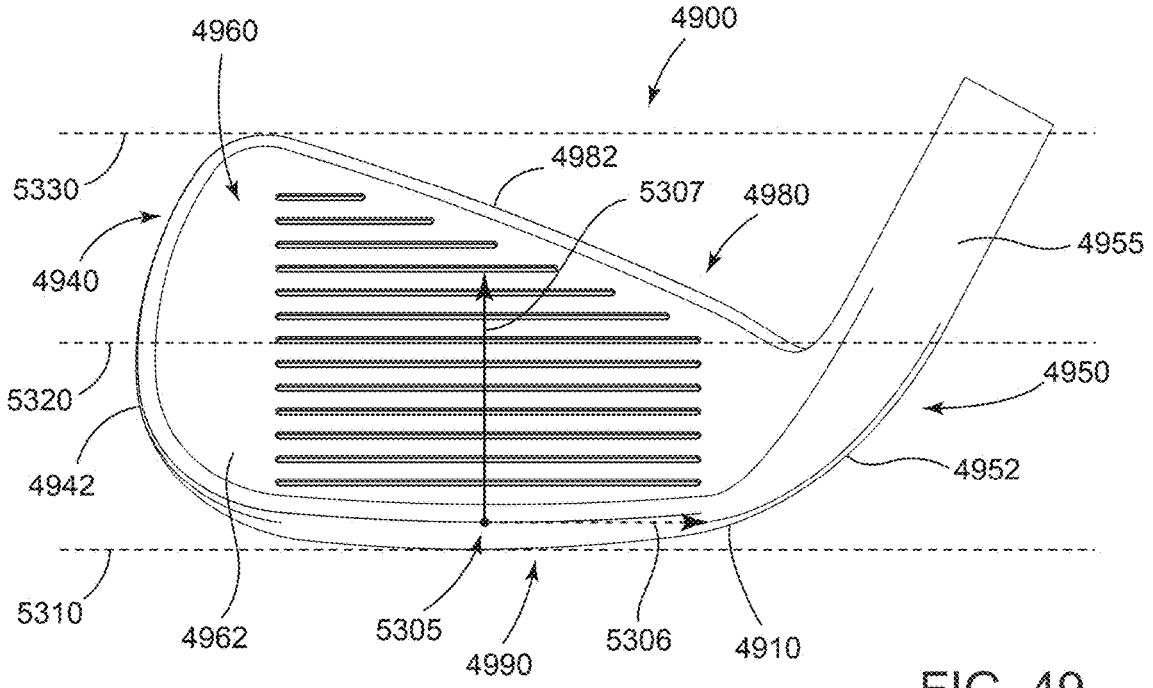
FIGS. 49, 50, 51, 52, 53, and 54 illustrate a front view, a back view, a back and side perspective view, a cross-sectional view taken at line 52-52 of FIG. 50, a cross-sectional view taken at line 53-53 of FIG. 50, and a front view without a face portion, respectively, of a golf club head according to embodiments of the apparatus, methods, and articles of manufacture described herein.
Figure 50:
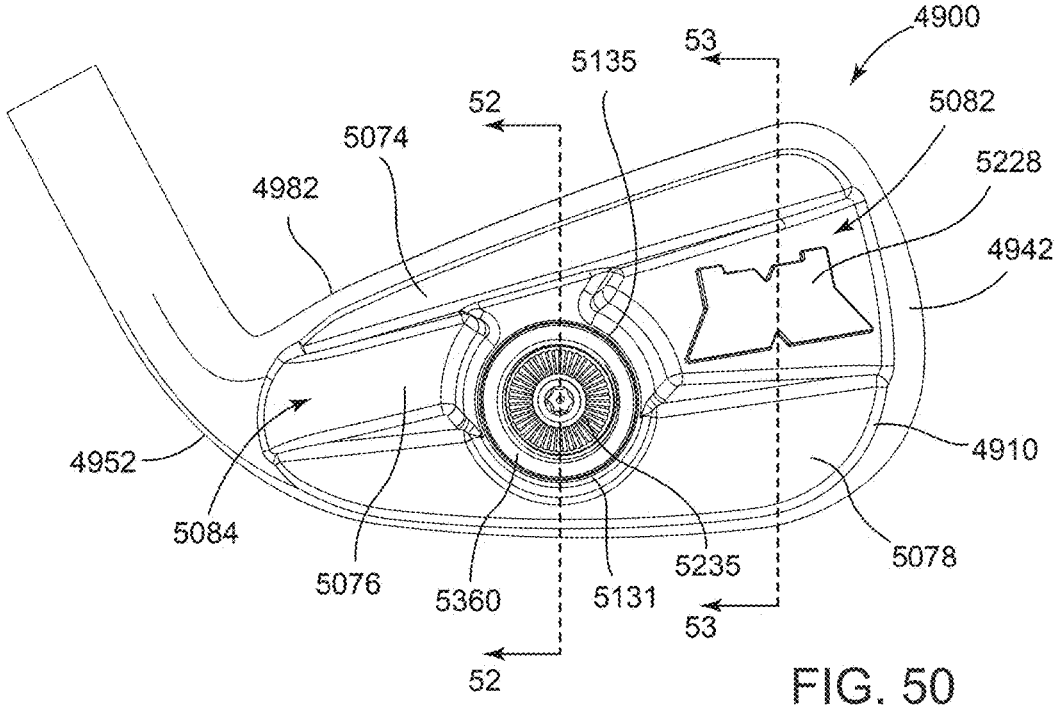
Figure 51:
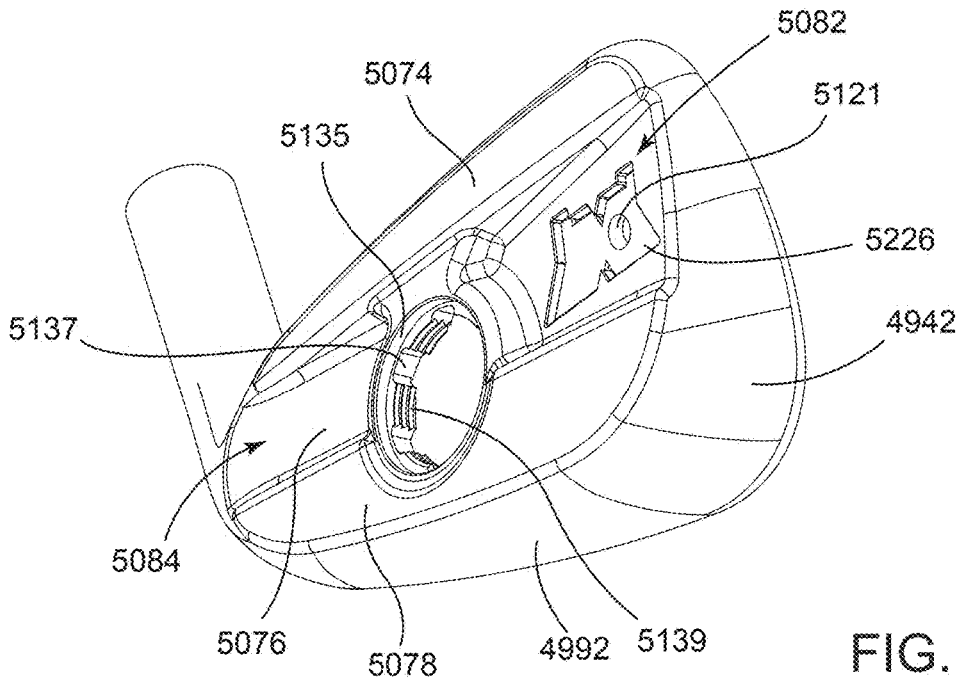
Figure 52:
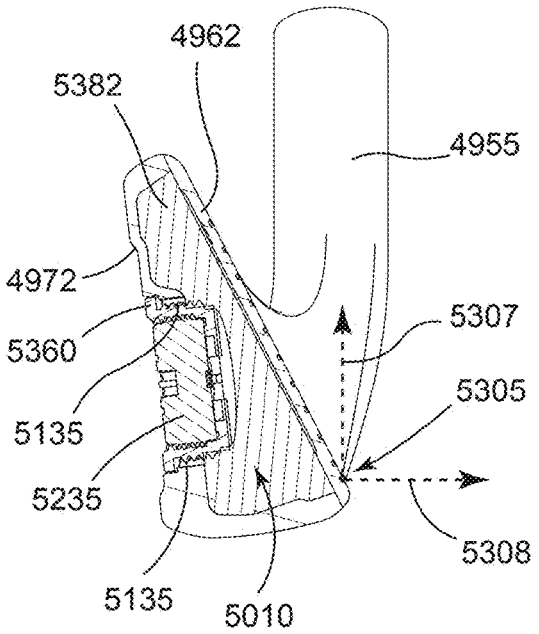
Figure 53:
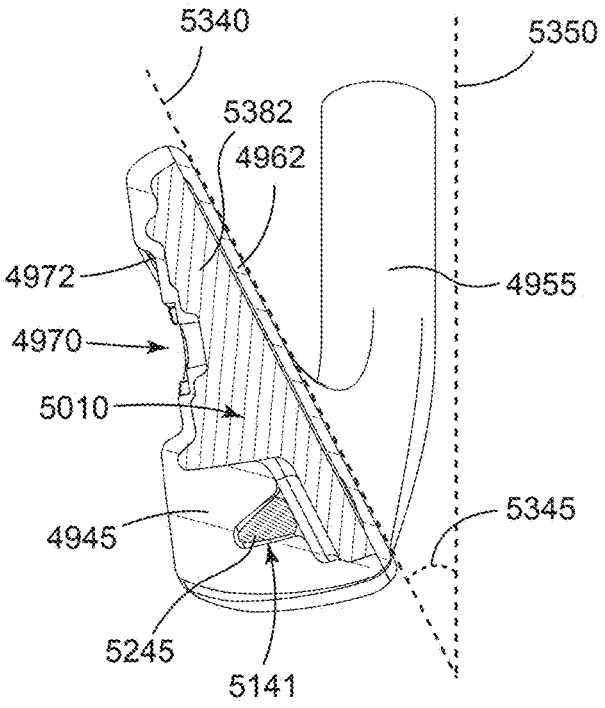

In one example, as illustrated in FIG. 48, the face portion 162 or the front surface 164 of the face portion 162 may include vertical curvature 4800 (schematically illustrated in FIG. 48), which may also be referred to herein as face roll, extending between the top portion edge 182 and the sole portion edge 192. The vertical curvature 4800 may be defined by a segment of a circle having a center 4802 located aft of the golf club head 100 with a roll radius 4804. In one example, the roll radius 4804 may be greater than or equal to 7 inches (152.4 mm) and less than or equal to 15 inches (381 mm). In another example, the roll radius 4804 may be greater than or equal to 8 inches (203.2 mm) and less than or equal to 12 inches (304.8 mm). In another example, the roll radius 4804 may be greater than or equal to 6 inches (152.4 mm) and less than or equal to 10 inches (254 mm). In yet another example, roll radius 4804 may be greater than or equal to 6 inches (152.4 mm) and less than or equal to 25 inches (635 mm). For an off-center golf ball strike on the face portion 162, the vertical curvature 4800 or bulge may impart a vertical spin on the ball to optimize ball trajectory toward a target line (i.e., a target line of an on-center hit). The apparatus, methods, and articles of manufacture described herein are not limited in this regard.

In the example of FIGS. 49-54, a golf club head 4900 may include a body portion 4910 having a toe portion 4940 with a toe portion edge 4942, a heel portion 4950 with a heel portion edge 4952 that may include a hosel portion 4955. A golf club shaft such as the shaft 92 that is illustrated for example in FIG. 1 may include one end coupled to the hosel portion 4955 and an opposite end coupled to a golf club grip such as the grip 94 that is illustrated for example in FIG. 1 to form a golf club such as the golf club 90 that is illustrated for example in FIG. 1. The body portion 4910 may further include a front portion 4960, a back portion 4970 with a back wall portion 4972, a top portion 4980 with a top portion edge 4982, and a sole portion 4990 with a sole portion edge 4992. The toe portion 4940, the heel portion 4950, the front portion 4960, the back portion 4970, the top portion 4980, and/or the sole portion 4990 may partially overlap. The toc portion edge 4942, the heel portion edge 4952, the top portion edge 4982, and the sole portion edge 4992 may define a periphery or boundary of the body portion 4910. The golf club head 4900 may be manufactured by method 2400 as illustrated in FIG. 24 for manufacturing the golf club head 100. The golf club head 4900 may be any type of golf club head described herein, such as, for example, an iron-type golf club head or a wedge-type golf club head. The volume of the golf club head 4900, the materials of construction of the golf club head 4900, and/or any components thereof may be similar to any of the golf club heads described herein and/or described in any of the incorporated by reference patent documents. The apparatus, methods, and articles of manufacture described herein are not limited in this regard.

The golf club head 4900 may include a face portion 4962 (i.e., the strike face) that may be integrally formed with the body portion 4910 (e.g., a single unitary piece). In one example, the face portion 4962 may be a separate piece coupled (e.g., directly or indirectly, adhesively, mechanically, by welding, and/or by soldering) to the front portion 4960 to close a front opening of the front portion 4960. All features, properties, and characteristics of the face portion 4962 including any front grooves and/or back grooves, the attachment of the face portion 4962 to the body portion 4910, and/or manufacturing of the face portion 4962 with the body portion 4910 may be similar in many respects to the face portion 162, any of the face portions described herein, or any of the face portions described in any of the incorporated by reference patent documents. The apparatus, methods, and articles of manufacture described herein are not limited in this regard.

The golf club head 4900 may be associated with a ground plane 5310, a horizontal midplane 5320, and a top plane 5330. In particular, the ground plane 5310 may be a plane that is parallel or substantially parallel to the ground and is tangent to the lowest portion of the sole portion edge 4992 when the golf club head 4900 is at an address position (e.g., the golf club head 4900 aligned to strike a golf ball). A top plane 5330 may be a plane that is tangent to the upper most portion of top portion edge 4982 when the golf club head 4900 is at the address position. The ground plane 5310 and the top plane 5330 may be parallel or substantially parallel. The horizontal midplane 5320 may be vertically halfway between the ground plane 5310 and the top plane 5330, respectively, and be parallel or substantially parallel to the ground plane 5310. Further, the golf club head 4900 may be associated with a loft plane 5340 defining a loft angle 5345 ($\alpha$) of the golf club head 4900. The loft plane 5340 may be a plane that is tangent to or coplanar with the face portion 4962. The loft angle 5345 may be defined by an angle between the loft plane 5340 and a vertical plane 5350 that is normal to the ground plane 5310. The origin 5305 of the coordinate system or the location of coordinates x=0, y=0, and z=0, the x-axis (shown for example by reference number 5306) of the coordinate system, the y-axis (shown for example by reference number 5307) of the coordinate system, and the z-axis (shown for example by reference number 5308) of the coordinate system may be similar to the golf club head 100. The apparatus, methods, and articles of manufacture described herein are not limited in this regard.

The body portion 4910 may include one or more ports, which may be exterior ports and/or interior ports (e.g., located inside the body portion 4910). The inner walls of the body portion 4910 may define an interior cavity 5010, which may be accessible from outside the body portion 4910 with one or more exterior ports on the body portion 4910. The one or more ports may be at any location on the body portion 4910. In one example, as illustrated in FIGS. 49-54, the body portion 4910 may include a first port 5121, a second port 5131, and a third port 5141. The first port 5121 may be similar in many respects to the first port 321 of the golf club head 100. Accordingly, the first port 5121 may extend from a recessed portion 5226 on the back wall portion 4972 to the interior cavity 5010. The recessed portion 5226 may be configured to receive a cover portion or a badge 5228, which may be similar to the badge 428 of the golf club head 100, and may display one or more alphanumeric characters, symbols, shapes or other visual marks to signify a particular feature of or information about of the golf club head 4900. The apparatus, methods, and articles of manufacture described herein are not limited in this regard.

In one example, as illustrated in FIGS. 49-54, the second port 5131 may be similar in many respects to the second port 331 of the golf club head 100. The golf club head 4900 may also include a port sleeve 5360 that may be similar in many respects to the port sleeve 1610 of the golf club head 100. Accordingly, the port sleeve 5360 may include a sleeve body (with reference to sleeve body 1612) and a sleeve bezel (with reference to the sleeve bezel 1614). In one example, as illustrated in FIGS. 49-54, the port wall 5135 of the second port 5131 may include port wall cutouts 5137 that may be space apart with each port wall cutout 5137 extending radially along the port wall 5135. Accordingly, the threaded port wall 5135 may include threaded segments or threaded portions 5139 that are spaced apart by each port wall cutout 5137 and are configured to engage threaded portions of the port sleeve 1610. Each port wall cutout 5137 may allow removal of mass form the port wall 5135 that can then be strategically moved to other portions of the golf club head 4900 to optimize the moment of inertia, center of gravity location, and/or sound and feel of the golf club head 4900 to improve and or optimize performance. The apparatus, methods, and articles of manufacture described herein are not limited in this regard.

The back wall portion 4972 may include an upper back wall portion 5074, a middle back wall portion 5076 and a lower back wall portion 5078. The middle back wall portion 5076 may be between the upper back wall portion 5074 and the lower back wall portion 5078. The middle back wall portion 5076 may include a toc-side recessed portion 5082 and a heel-side recessed portion 5084. The toe-side recessed portion 5082 may extend from the second port 5131 to the toe portion edge 4942. The heel-side recessed portion 5084 may extend from the second port 5131 to the heel portion edge 4952. Each of the toe-side recessed portion 5082 and the heel-side recessed portion 5084 allows mass form a center region of the golf club head 4900 to be shifted to other portions of the golf club head 4900 to optimize the moment of inertial, center of gravity location, and/or the performance of the golf club head 4900.

The body portion 4910 may include one or more mass portions (e.g., weight portion(s)) at any location on the body portion 4910. The one or more mass portions may be integral mass portion(s) or separate mass portion(s) that may be coupled to the body portion 4910 at any exterior or interior location on the body portion 4910. In the illustrated example of FIGS. 49-54, the body portion 4910 may include an external mass portion 5235 and an internal mass portion 5245, which may be similar in many respects to the external mass portion 435 (e.g., the mass portion 2700) and the internal mass portion 445 of the golf club head 100, respectively. The port sleeve 5360 may be configured to receive the external mass portion 5235, as described herein with respect to the port sleeve 1610 and the external mass portion 435 of the golf club head 100. The apparatus, methods, and articles of manufacture described herein are not limited in this regard.

In one example, as illustrated in FIGS. 49-54, the third port 5141 may be similar in many respects to the third port 341 (i.e., the internal port) of the golf club head 100. Accordingly, the third port 5141 may define a recess or cavity in the body portion 4910 that may be shaped to correspond to the shape of the internal mass portion 5245 to receive the internal mass portion 5245 similar to the coupling of the internal mass portion 445 and the third port 341 as described in detail herein with respect to the golf club head 100. Accordingly, in one example, the third port 5141 may be shaped to completely receive the internal mass portion 5245 so that the outer surface of the internal mass portion is flush with the interior walls of the body portion 4910 defining the interior cavity 5010. The internal mass portion 5245 may be secured inside the third port 5141 with one or more adhesives or bonding agents, by welding or soldering, and/or by being press fit. The third port 5141 may be defined by a cavity inside a body mass portion 4945, which may be similar in many respects to the body mass portion 145 of the golf club head 100. The apparatus, methods, and articles of manufacture described herein are not limited in this regard.

The interior cavity 5010 may be partially or entirely filled with one or more filler materials (i.e., a cavity filling material), which may include one or more similar or different types of materials. In one example, as illustrated in FIGS. 49-54, the filler material 5382 may be similar in many respect to the filler material 612, which may be a urethane elastomer material that may be curable at room temperature or higher temperatures to accelerate the curing process. The process of injecting and/or placing the filler material 5382 into the interior cavity 5010 may be similar in many respects to the process described for injecting the filler material 612 into the interior cavity 210 of the golf club head 100. In another example, the filler material 5382 may be similar to any of the filler materials described herein or in any of the incorporated by reference patent documents. In yet another example, the interior cavity 5010 may be filled with a first filler material and a second filler material that may be similar to the first filler material and the second filler material of any of the golf club heads described in any of the incorporated by reference patent documents. The apparatus, methods, and articles of manufacture described herein are not limited in this regard.

As described herein, the interior cavity 5010 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head), (ii) provide structural support for the face portion, and/or (iii) optimize ball travel distance, ball speed, ball launch angle, ball spin rate, ball peak height, ball landing angle and/or ball dispersion. The filler material may provide structural support for the relatively thinner portions of the face portion 4962. The apparatus, methods, and articles of manufacture described herein are not limited in this regard.

In one example, as illustrated in FIGS. 49-54, the golf club head 4900 may include one or a plurality of groove portions on the back wall portion 4972, which may be defined by groove portions on an inner surface 4979 (i.e., the surface of the back wall portion 4972 defining the interior cavity 5010) of the back wall portion 4972. The one or the plurality groove portions (e.g., generally shown as groove portions 5402, 5404, 5406, 5408, and 5410) on the back wall portion 4972 as described herein may allow increased bending or deflection of the back wall portion 4972 at certain locations on the back wall portion 4972 during a strike on the face portion 4962 without compromising the structural integrity of the back wall portion 4972. Accordingly, the rebounding of the back wall portion 4972 as a result of the increased bending or deflection of the back wall portion 4972 may increase ball speed. The apparatus, methods, and articles of manufacture described herein are not limited in this regard.

Figure 54:
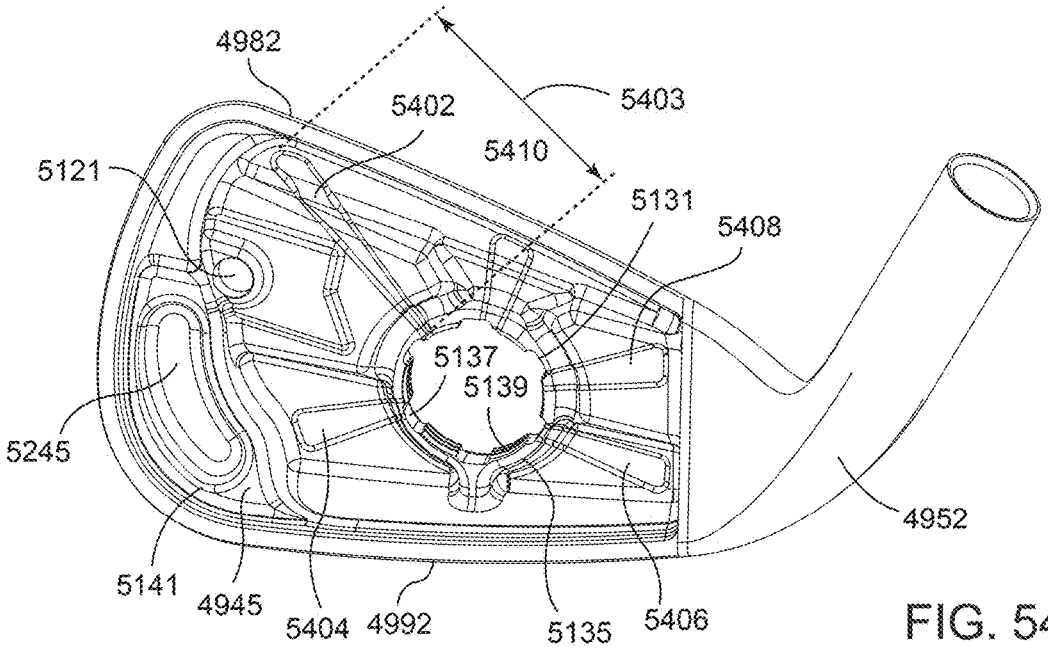

In one example, as illustrated in FIG. 54, the plurality of groove portions may include five groove portions, which are shown in FIG. 54 as a first groove portion 5402, a second groove portion 5404, a third groove portion 5406, a fourth groove portion 5408, and a fifth groove portion 5410. Each groove portion may include a groove portion length (e.g., a groove portion length 5403 shown in FIG. 54), a groove portion width (e.g., a groove portion width 5520 shown in FIG. 55), and a groove portion depth (e.g., a groove portion depth 5510 shown in FIG. 55). The first groove portion 5402 may extend from the port wall 5135 of the second port 5131 toward the top portion edge 4982 and the toe portion edge 4942 in a slanted or diagonal orientation (e.g., the groove portion length 5403 has a diagonal orientation on the back wall portion 4972). The first groove portion 5402 may extend from the port wall 5135 to a location on the body portion 4910 that may define a transition portion between the back wall portion 4972 and the top portion edge 4982. In other words, an end portion of the first groove portion 5402 may be attached to or form an integral portion of a perimeter portion of the back wall portion 4972 and/or the top portion edge 4982. The second groove portion 5404 may extend from the port wall 5135 toward the sole portion edge 4992 and the toe portion edge 4942 in a slanted or diagonal orientation. The second groove portion 5404 may extend from the port wall 5135 to the body mass portion 4945. The third groove portion 5406 may extend from the port wall 5135 toward the sole portion edge 4992 and the heel portion edge 4952 in a slanted or diagonal orientation. The third groove portion 5406 may extend from the port wall 5135 toward the heel portion edge 4952 in a downwardly inclining orientation. The fourth groove portion 5408 may extend from the port wall 5135 toward the heel portion edge 4952 in an upwardly inclining orientation. The fifth groove portion 5410 may extend vertically from the port wall 5135 to a location on the body portion 4910 that may be at or proximate to the top portion edge 4982. Accordingly, as illustrated in FIG. 54, the first groove portion 5402, the second groove portion 5404, the third groove portion 5406, the fourth groove portion 5408, and the fifth groove portion 5410 may be radially arranged on the back wall portion 4972 and extend outward from the port wall 5135. The radial or diagonal arrangement of the groove portions may direct the rebound energy of the back wall portion 4972 toward a center portion of the face portion 4962 or the ball strike region of the face portion 4962. While the above example may describe a particular number of groove portions, the back wall portion 4972 may include any number of radially arranged groove portions (e.g., two, three, four or a greater number of groove portions). The apparatus, methods, and articles of manufacture described herein are not limited in this regard.

Figure 55:
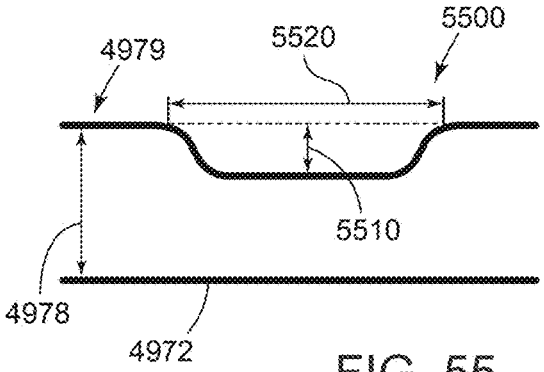
FIGS. 55-58 illustrate schematic cross-sectional view of example groove portions on a back wall portion of a golf club head according to any embodiment of the apparatus, methods, and articles of manufacture described herein.
Figure 56:
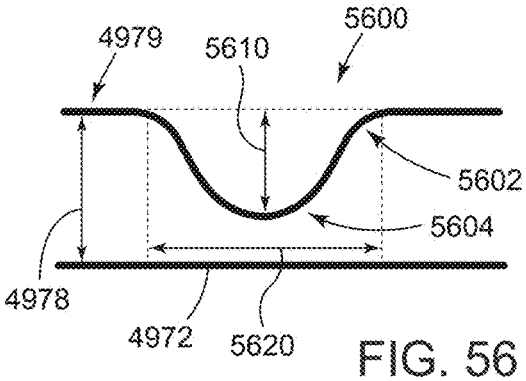

Each groove portion of the plurality of groove portions described herein may be defined by a groove extending into the back wall portion 4972 from the inner surface 4979 of the back wall portion 4972. As illustrated in FIG. 54 and in one example as illustrated schematically in FIG. 55, a groove portion 5500 may be defined by a planar or a channel-shaped portion of the back wall portion 4972. The groove portion 5500 may have a groove portion depth 5510, which may be uniform or vary along the groove portion width 5520 of the groove portion 5500. All corners of the groove portion 5500 may be rounded or chamfered to reduce stress concentration at or around the groove portion 5500. The groove portion 5500 may have a planar bottom portion as shown in FIG. 55. In another example, the groove portion 5500 may have curved (i.e., concave or convex) bottom portion. In another example, as illustrated in FIG. 55, the groove portion width 5520 may be greater than the groove portion depth 5510. In yet another example, the groove portion width 5520 may be less than the groove portion depth 5510. In another example, as illustrated schematically in FIG. 56, a groove portion 5600 may extend from a chamfered or rounded base portion 5602 at the inner surface 4979 of the back wall portion 4972 to a rounded valley portion 5604. The rounded base portions 5602 and the rounded valley portion 5604 may reduce stress concentration at or around the groove portion 5600. The groove portion 5600 may include a groove portion depth 5610 and a groove portion width 5620. Any of the groove portions described herein may have a cross-sectional shape at any location on the groove portion that may be similar to the groove portion 5500 or the groove portion 5600. As illustrated in the example of FIG. 54, each of the groove portions 5402, 5404, 5406, 5408, and 5410 may increase in width from the port wall 5135 toward the perimeter of the golf club head 4900. Accordingly, in one example, the narrower parts of the groove portions 5402, 5404, 5406, 5408, and 5410 may have a cross sectional shape similar to the groove portion 5600, and the relatively wider parts of the groove portions 5402, 5404, 5406, 5408, and 5410 may have a cross sectional shape similar to the groove portion 5500, with parts of the groove portions 5402, 5404, 5406, 5408, and 5410 gradually transitioning from one cross sectional shape to another. In another example, the groove portion depths of the groove portions 5402, 5404, 5406, 5408, and 5410 may remain constant or be variable along the length of each groove portions 5402, 5404, 5406, 5408, and 5410. The apparatus, methods, and articles of manufacture described herein are not limited in this regard.

In another example, a groove portion depth as described herein may vary and a groove portion width as described herein may remain constant along a groove portion length. In yet another example, a groove portion depth may remain constant and a groove portion width may vary along a groove portion length. A groove portion depth, a groove portion width, and/or a cross-sectional shape of a groove portion may be configured along the groove portion length, which may also be configured, to optimize bending or deflection of the back wall portion 4972 during a golf ball strike on the face portion 4962, and/or allow a reduction in thickness of the back wall portion 4972 at all or portions of the back wall portion 4972 without compromising the structural integrity of the back wall portion 4972. The apparatus, methods, and articles of manufacture described herein are not limited in this regard.

In one example, a groove portion width may be greater than or equal to 0.025 inch (0.635 mm) and less than or equal to 0.150 inch (3.810 mm). In another example, a groove portion width may be greater than or equal to 0.033 inch (0.838 mm) and less than or equal to 0.200 inch (5.080 mm). In another example, a groove portion width may be greater than or equal to 0.040 inch (1.016 mm) and less than or equal to 0.250 inch (6.350 mm). In another example, a groove portion width may be greater than or equal to 0.055 inch (1.397 mm) and less than or equal to 0.300 inch (7.620 mm). In yet another example, a groove portion width may be greater than or equal to 0.065 inch (1.651 mm) and less than or equal to 0.350 inch (8.890 mm). The apparatus, methods, and articles of manufacture described herein are not limited in this regard.

In one example, a groove portion depth may be greater than or equal to 0.003 inch (0.076 mm) and less than or equal to 0.008 inch (0.203 mm). In another example, a groove portion depth may be greater than or equal to 0.007 inch (0.178 mm) and less than or equal to 0.010 inch (0.254 mm). In another example, a groove portion depth may be greater than or equal to 0.010 inch (0.254 mm) and less than or equal to 0.020 inch (0.508 mm). In another example, a groove portion depth may be greater than or equal to 0.015 inch (0.381 mm) and less than or equal to 0.025 inch (0.635 mm). In yet another example, a groove portion depth may be greater than or equal to 0.020 inch (0.508 mm) and less than or equal to 0.030 inch (0.762 mm). The apparatus, methods, and articles of manufacture described herein are not limited in this regard.

Figure 57:
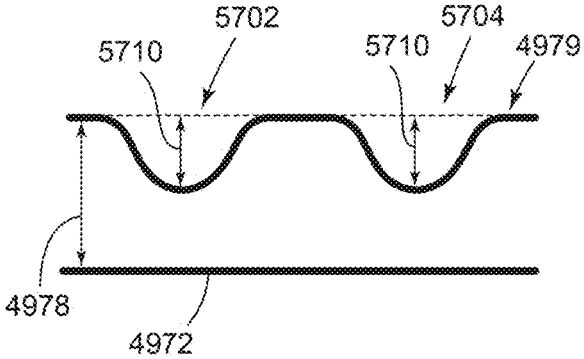

In another example, as illustrated in FIG. 57, the back wall portion 4972 may include two relatively closely spaced groove portions, which are shown by example as groove portion 5702 and groove portion 5704. Each of the groove portion 5702 and the groove portion 5704 may be similar in cross section to the groove portion 5600. In one example, as illustrated in FIG. 57, the groove portion 5702 and the groove portion 5704 may have the same groove portion depth 5710. In another example, the groove portion 5702 and the groove portion 5704 may have different groove portion depths. In another example, the groove portion 5702 and the groove portion 5704 may have different groove portion widths. In another example, the groove portion 5702 and the groove portion 5704 may be parallel. In another example, the groove portion 5702 and the groove portion 5704 may diverge in a direction between a center portion of the back wall portion 4972 toward an outer perimeter of the back wall portion 4972. In yet another example, the groove portion 5702 and the groove portion 5704 may converge in a direction between a center of the back wall portion 4972 toward an outer perimeter of the back wall portion 4972. The apparatus, methods, and articles of manufacture described herein are not limited in this regard.

Figure 58:
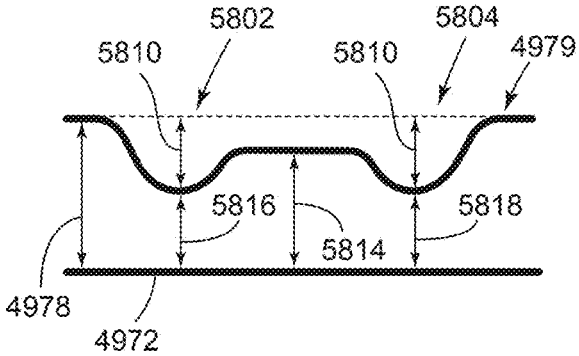
Figure 59:
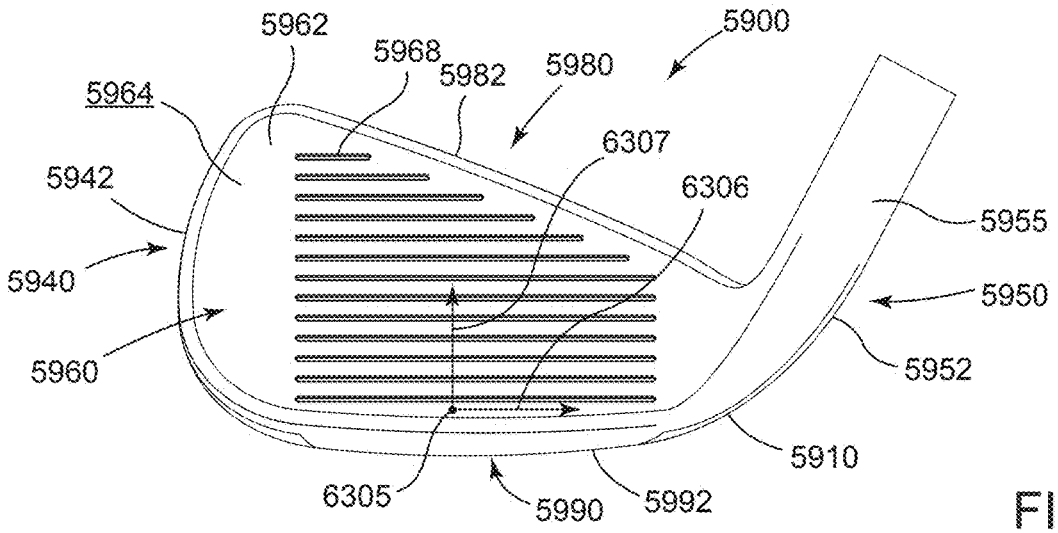
FIGS. 59, 60, 61, 62, 63, 64, 65, 66, 67, 68, 69, 70, 71, 72, 73, 74, and 75 illustrate a front view, a back view, another back view, a top view, a bottom view, a toe side view, another toe side view, a front view without a face portion, a perspective view of an external mass portion, a perspective view of an internal mass portion, another perspective view of an internal mass portion, a cross-sectional view taken at line 70-70 of FIG. 60, a cross-sectional view taken at line 71-71 of FIG. 60, a cross-sectional view taken at line 72-72 of FIG. 60, a cross-sectional view taken at line 73-73 of FIG. 60, a cross-sectional view taken at line 74-74 of FIG. 60, and a cross-sectional view taken at line 75-75 of FIG. 60, of a golf club head according to embodiments of the apparatus, methods, and articles of manufacture described herein.

In yet another example, as illustrated in FIG. 58, the back wall portion 4972 may include one or more relatively closely spaced groove portions, which are shown as groove portion 5802 and groove portion 5804. The space between the groove portion 5802 and the groove portion 5804 may define a relatively thicker portion of the back wall portion 4972. Accordingly, the back wall portion 4972 may have a first back wall portion thickness, which is defined by the back wall portion thickness 4978, a second back wall portion thickness 5814 between the groove portion 5802 and the groove portion 5804, a third back wall portion thickness 5816 that may be defined by the thickness of the back wall portion 4972 at the bottom of the groove portion 5802, and a fourth back wall portion thickness 5818 that may be defined by the thickness of the back wall portion 4972 at the bottom of the groove portion 5804. In one example, as illustrated in FIG. 58, the second back wall portion thickness 5814 may be less than the back wall portion thickness 4978, and the second back wall portion thickness 5814 may be greater than the third back wall portion thickness 5816 and/or the fourth back wall portion thickness 5818. The third back wall portion thickness 5816 and the fourth back wall portion thickness 5818 may be the same or differ. The groove portion depth 5810 of the groove portion 5802 and the groove portion depth 5810 of the groove portion 5804 may be the same or vary. The apparatus, methods, and articles of manufacture described herein are not limited in this regard.

Although the example of FIGS. 54-58 may illustrate radially arranged groove portions, the apparatus, methods, and articles of manufacture as described herein may include groove portions configured in various positions or orientations. Referring back to FIGS. 41-46, the different configurations of the rib portions shown in FIGS. 41-46 and described herein may be equally applicable to configurations of groove portions. Accordingly. FIGS. 41-46 are described in the following as illustrating groove portions rather than rib portions. In one example, as illustrated in FIG. 41, the back wall portion 4972 (shown in FIGS. 41-46 as the back wall portion 172) may include one or more circular groove portions, which may be at any location on the back wall portion 4972. In the example of FIG. 41, the circular groove portions (schematically illustrated in FIG. 41) may be concentrically arranged with the second port (shown in FIGS. 41-46 as the second port 331). In another example, one or more of the circular groove portions may not be concentrically arranged with each other and/or with the second port. In another example, as illustrated in FIG. 42, the back wall portion 4972 may include one or a plurality of elliptical or non-circular groove portions (schematically illustrated in FIG. 42). In yet another example, as illustrated in FIG. 43, the back wall portion 4972 may include one or more horizontally arranged groove portions (schematically illustrated in FIG. 43). In yet another example, as illustrated in FIG. 44, the back wall portion 4972 may include one or more vertically arranged groove portions (schematically illustrated in FIG. 44). In yet another example, as illustrated in FIGS. 45, the back wall portion 4972 may include one or more diagonally arranged groove portions (schematically illustrated in FIG. 45). The diagonally arranged groove portions may be in any non-vertical or non-horizontal direction. In yet another example, as illustrated in FIG. 46, the back wall portion 4972 may include a plurality of curved groove portions (schematically illustrated in FIG. 46). The back wall portion 4972 may include any number of linear or curved groove portions in any geometric or non-geometric arrangement to provide certain performance characteristics for the golf club head 4900. The apparatus, methods, and articles of manufacture described herein are not limited in this regard.

The groove portions of the back wall portion as described herein may be used on any type of golf head. In one example, one or more groove portions as described herein may be used on a golf club head that does not have any ports and/or mass portions integral with or coupled to the back wall portion. In another example, one or more groove portions as described herein may be used on a golf club head that does not have any filler material in the interior cavity of the golf club head. Accordingly, the back wall portion of any golf club head may include any number of linear or curved groove portions in any geometric or non-geometric arrangement, such as the examples described and illustrated herein, to provide certain performance characteristics for the golf club. The apparatus, methods, and articles of manufacture described herein are not limited in this regard.

Any of the groove portions described herein may have any length, width, and/or height to provide certain performance characteristics for a golf club head. In one example, each groove portion may increase in width and/or height from a perimeter portion of the back wall portion toward a center portion of the back wall portion. In another example, each groove portion may increase in width from a perimeter portion of the back wall portion toward a center portion of the back wall portion. In yet another example, each groove portion may vary in height and/or width at certain locations along the length of the groove portion depending on the thickness of the back wall portion at or proximate to those locations. To optimize performance of a golf club head, each groove portion may be configured in height, width, length, location, and/or shape depending on the thickness of the back wall portion, location of one or more mass portions and/or ports on the back wall portion, any other structural features of the back wall portion, material of construction of the back wall portion, different characteristics of any filler material in the golf club head, and/or other specific or general features and/or characteristics of the golf club head. The apparatus, methods, and articles of manufacture described herein are not limited in this regard.

As described herein the golf club head 4900 may be similar in many respects to the golf club head 100 except for the features described herein. Accordingly, any feature, configuration, physical property, and/or characteristic of the golf club head 4900 that may not be described in detail herein may be similar or identical to the same feature, configuration, physical property, and/or characteristic of the golf club head 100, respectively. As described herein, the golf club head 100 may include one or a plurality of rib portions on the back wall portion, whereas the golf club head 4900 may include one or a plurality of groove portions on the back wall portions. In another example, a golf club head that may be similar to any of the golf club heads described herein may include both one or a plurality of rib portions and one or a plurality of groove portions. The one or more groove portions and the one or more rib portions may be strategically located on the back wall portion to optimize bending characteristics of the back wall portion. The apparatus, methods, and articles of manufacture described herein are not limited in this regard.

In the example of FIGS. 59-75, a golf club head 5900 may include a body portion 5910 having a toc portion 5940 with a toe portion edge 5942, a heel portion 5950 with a heel portion edge 5952 that may include a hosel portion 5955. A golf club shaft that may be similar to the shaft 92 of FIG. 1 may be coupled at one end to the hosel portion 5955 and coupled at the opposite end to a golf club grip that may be similar to the grip 94 of FIG. 1 to form a golf club such as the golf club 90 of FIG. 1. The body portion 5910 may further include a front portion 5960, a back portion 5970 with a back wall portion 5972, a top portion 5980 with a top portion edge 5982, and a sole portion 5990 with a sole portion edge 5992. The toe portion 5940, the heel portion 5950, the front portion 5960, the back portion 5970, the top portion 5980, and/or the sole portion 5990 may partially overlap. The toc portion edge 5942, the heel portion edge 5952, the top portion edge 5982, and the sole portion edge 5992 may define a periphery or boundary of the body portion 5910. The body portion 5910 may be constructed as a hollow body to define an interior cavity 6010. The golf club head 5900 may be any type of golf club head described herein, such as, for example, an iron-type golf club head or a wedge-type golf club head. The volume of the golf club head 5900, the materials of construction of the golf club head 5900, and/or any components thereof may be similar to any of the golf club heads described herein and/or described in any of the incorporated by reference patent documents. The golf club head 5900 may be manufactured by any of the golf club head manufacturing methods described herein or described in any of the incorporated by reference patent documents. The apparatus, methods, and articles of manufacture described herein are not limited in this regard.

The golf club head 5900 may include a face portion 5962 (i.e., the strike face) that may be integrally formed with the body portion 5910 (e.g., a single unitary piece) or formed as a separate piece coupled (e.g., directly or indirectly, adhesively, mechanically, by welding, and/or by soldering) to the front portion 5960. The face portion 5962 may include a front surface 5964 and a back surface 5966. The front surface 5964 may include front grooves 5968 that may extend between the toe portion 5940 and the heel portion 5950. The front grooves 5968 may be similar in many respects to the front grooves of any of the golf club heads described herein or described in any of the incorporated by reference patent documents. The back surface 5966 of the face portion 5962 may include one or more grooves, slots, channels, depressions, or recesses. In one example, the grooves on the back surface 5966 may be similar in many respects to any of the back grooves described herein such as the back grooves shown in FIGS. 28 and 29. In another example, the grooves on the back surface 5966 may be similar to any of the back grooves described in U.S. Pat. Nos. 11,400,352 and 10,449,428, which are incorporated by reference herein. In another example, the back surface 5966 may not include any grooves, slots, channels, depressions, or recesses. All features, properties, and characteristics of the face portion 5962 including any front grooves and/or back grooves, the attachment of the face portion 5962 to the body portion 5910, and/or manufacturing of the face portion 5962 with the body portion 5910 may be similar in many respects to any of the face portions described herein or described in any of the incorporated by reference patent documents. The apparatus, methods, and articles of manufacture described herein are not limited in this regard.

The descriptions and configurations of the coordinate system, ground plane, horizontal midplane, top plane, and a loft angle between a loft plane and a vertical plane of the golf club head 100 equally apply to the golf club head 5900. Accordingly, the golf club head 5900 may include a coordinate system having an origin 6305, an x-axis 6306, a y-axis 6307, and a z-axis 6308; and the golf club head 5900 may be associated with a ground plane 6310, a horizontal midplane 6320, a top plane 6330, and a loft plane 6340 having a loft angle 6345 (i.e., loft angle of the face portion 5962) relative to a vertical plane 6350. The apparatus, methods, and articles of manufacture described herein are not limited in this regard.

Figure 60:
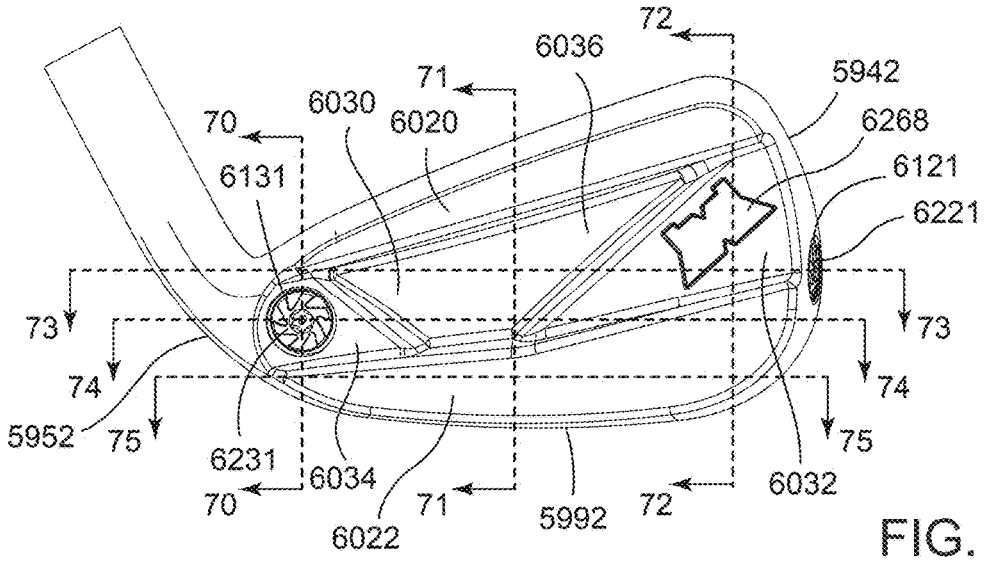
Figure 61:
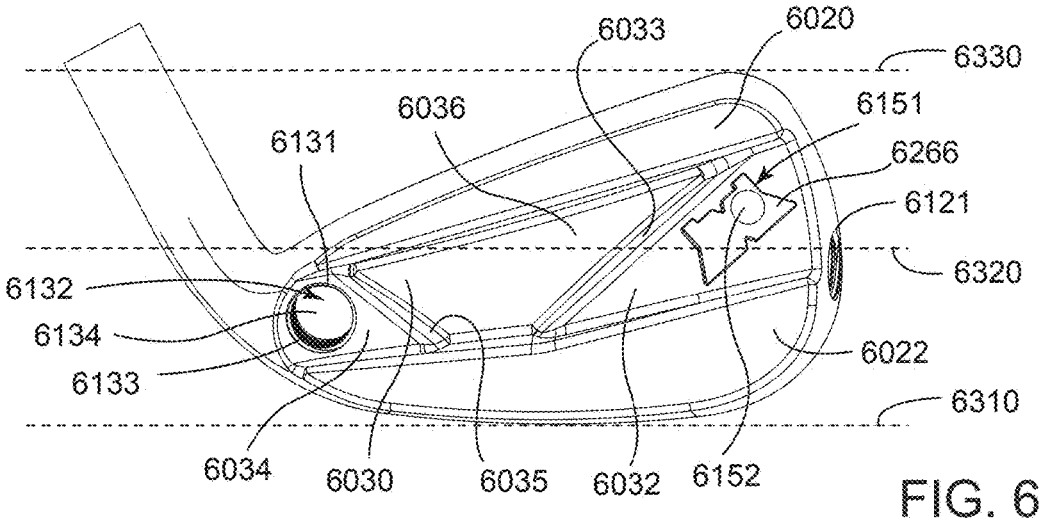
Figure 62:
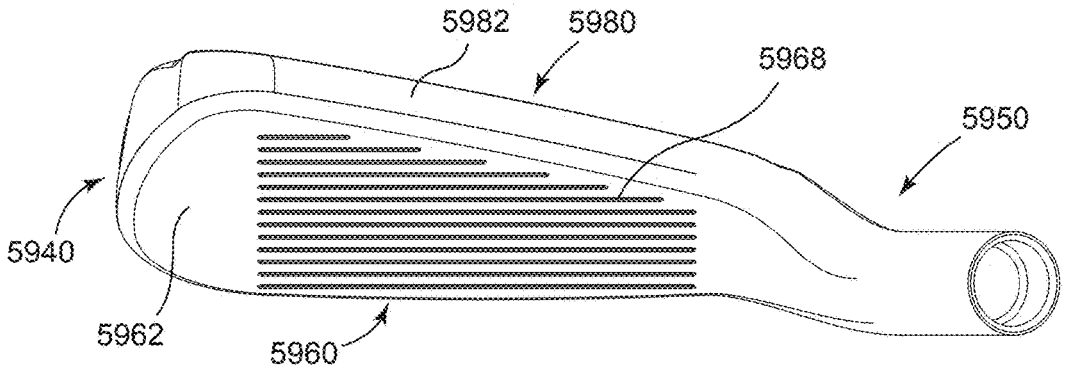
Figure 63:
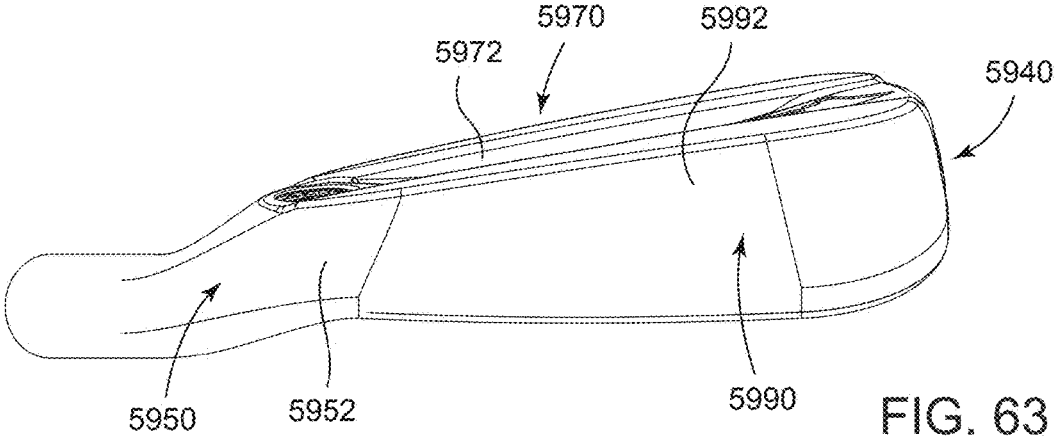
Figure 71:
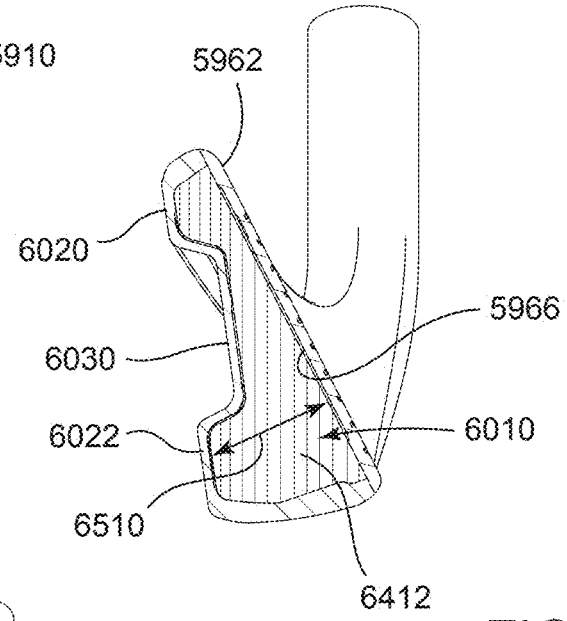
Figure 72:
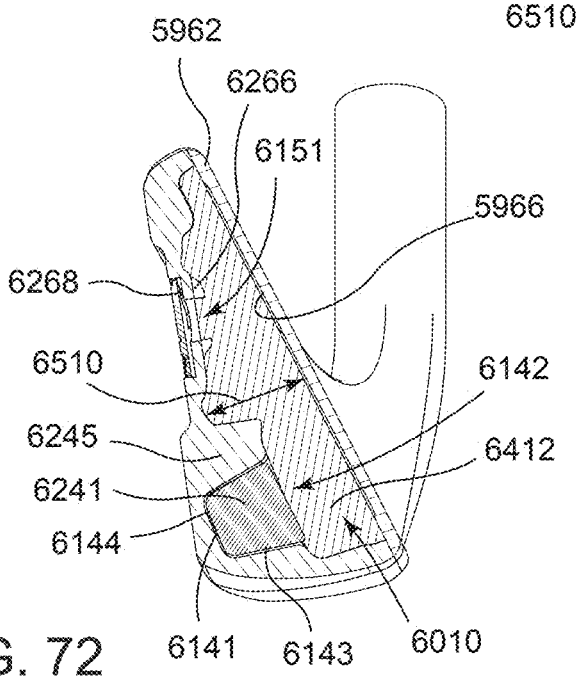
Figure 73:
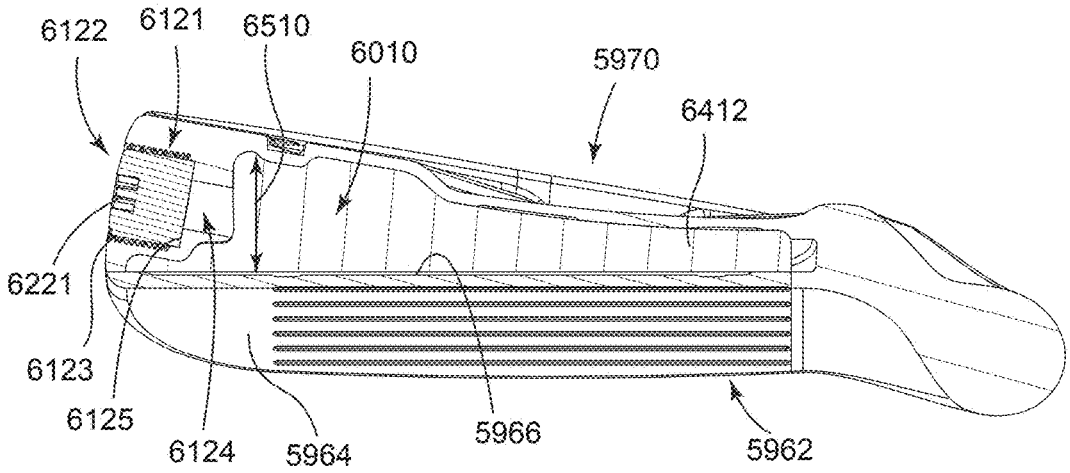
Figure 74:
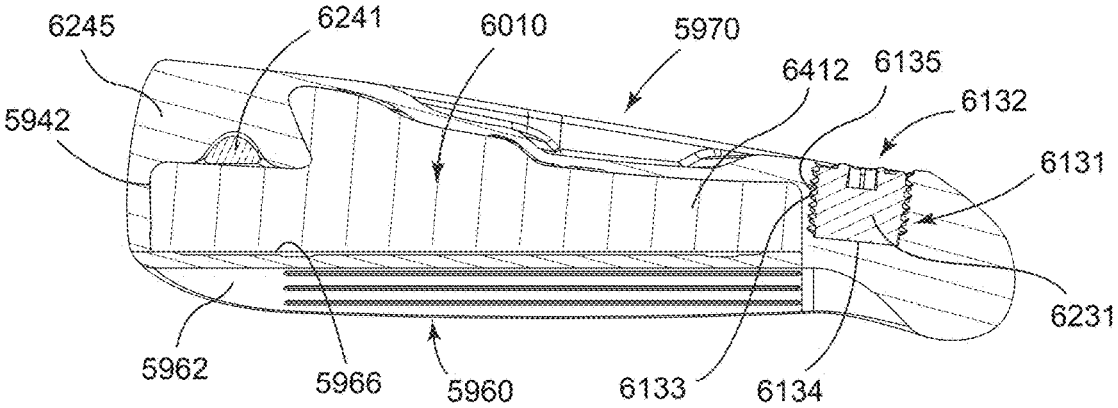
Figure 75:
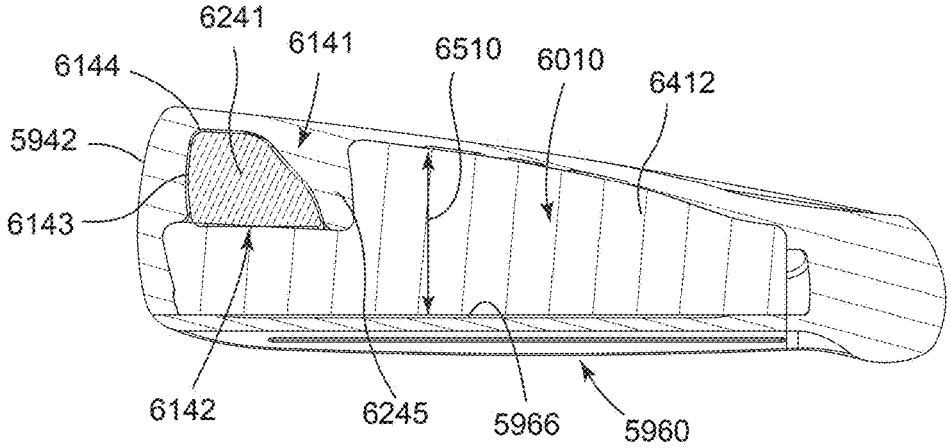
Figure 76:
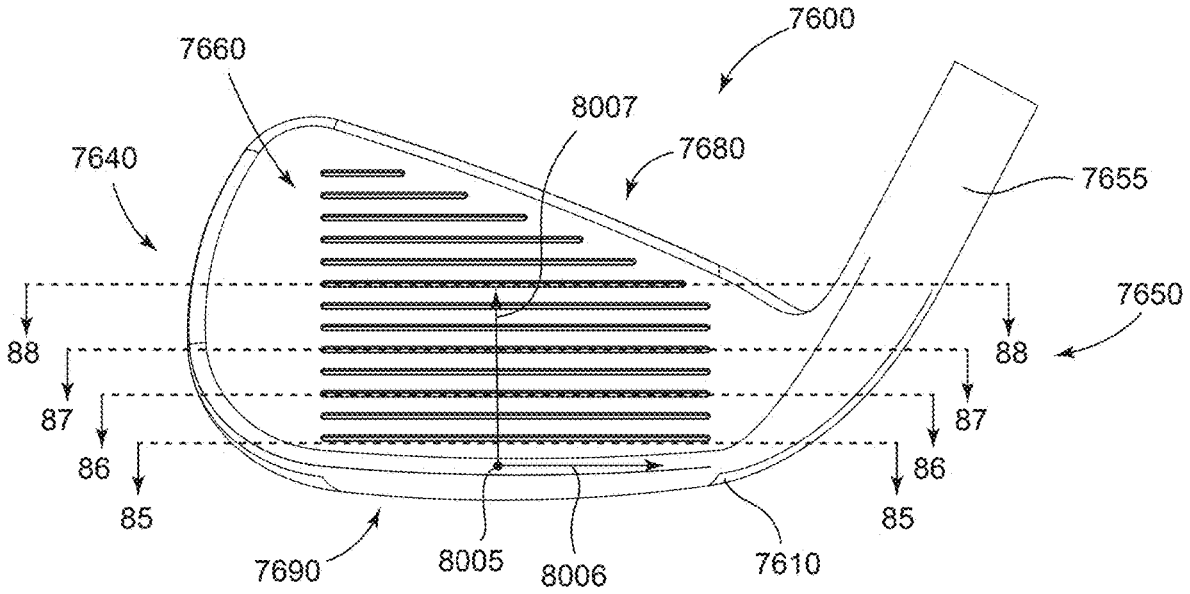
FIGS. 76, 77, 78, 79, 80, 81, 82, 83, 84, 85, 86, 87, 88, 89, and 90 illustrate a front view, a back view, heel side view, a toe side view, a cross-sectional view taken at line 80-80 of FIG. 77, a cross-sectional view taken at line 81-81 of FIG. 77, a cross-sectional view taken at line 82-82 of FIG. 77, a perspective front view of an internal mass portion, a perspective back view of the internal mass portion, a cross-sectional view taken at line 85-85 of FIG. 76, a cross-sectional view taken at line 86-86 of FIG. 76, a cross-sectional view taken at line 87-87 of FIG. 76, a cross-sectional view taken at line 88-88 of FIG. 76, a front view without a face portion, and another back view of a golf club head according to embodiments of the apparatus, methods, and articles of manufacture described herein.
Figure 77:
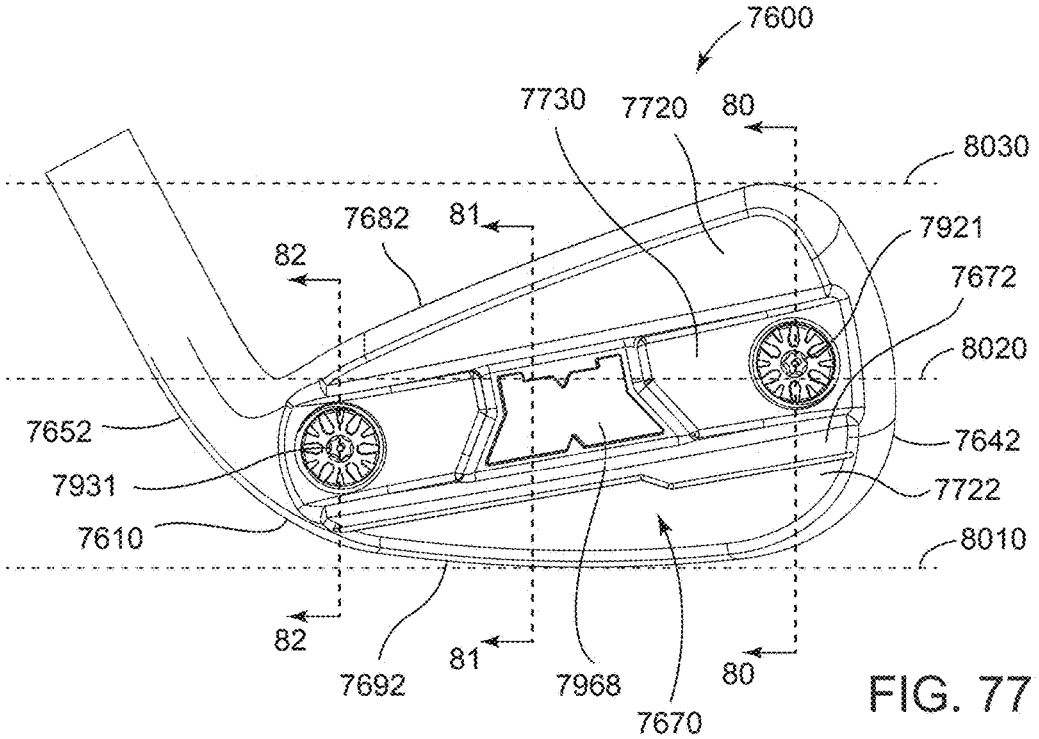
Figure 78:
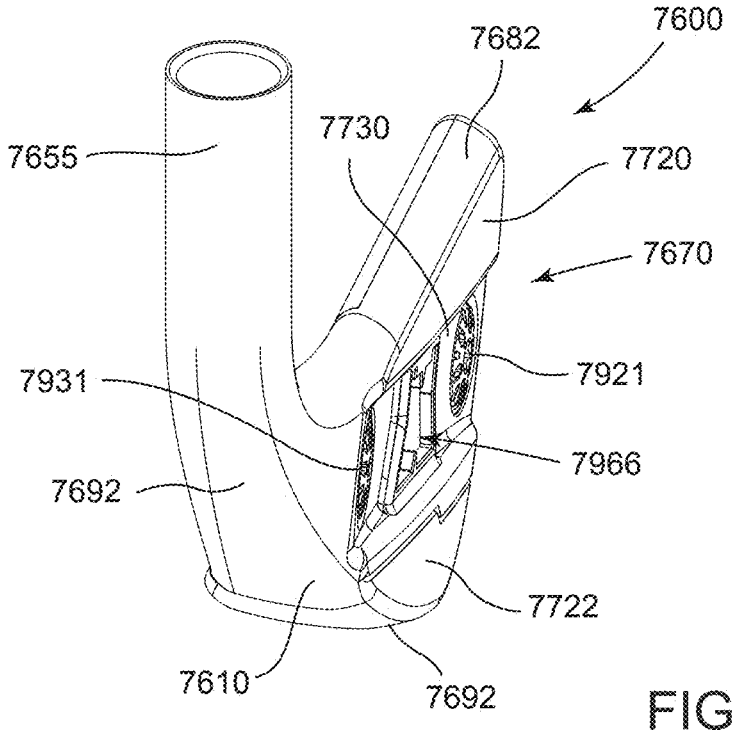

The back wall portion 5972 may include an upper back wall portion 6020, a lower back wall portion 6022, and a middle back wall portion 6030 between the upper back wall portion 6020 and the lower back wall portion 6022. The middle back wall portion 6030 may extend from a location at or proximate to the toc portion edge 5942 to a location at or proximate to the heel portion edge 5952. The middle back wall portion 6030 may include a first mid-back-wall portion 6032 extending from a location at or proximate to the toe portion edge 5942 toward the heel portion edge 5952, a second mid-back-wall portion 6034 extending from a location at or proximate to the heel portion edge 5952 toward the toe portion edge 5942, and a third mid-back-wall portion 6036 that may extend between the first mid-back-wall portion 6032 and the second mid-back-wall portion 6034. The third mid-back-wall portion 6036 may be recessed relative to the first mid-back-wall portion 6032 and the second mid-back-wall portion 6034 as illustrated in FIGS. 60, 61, and 71. A boundary between the third mid-back wall portion 6036 and the first mid-back-wall portion 6032 may be defined by a first transition surface 6033 that may be diagonally oriented in a toe to heel direction. A boundary between the third mid-back wall portion 6036 and the second mid-back-wall portion 6034 may be defined by a second transition surface 6035 that may be diagonally oriented in a heel to toe direction. Accordingly, as illustrated in FIGS. 60 and 61, the first transition surface 6033 and the second transition surface 6035 may be define a trapezoidal shape for the third mid-back-wall portion 6036. The apparatus, methods, and articles of manufacture described herein are not limited in this regard.

Figure 64:
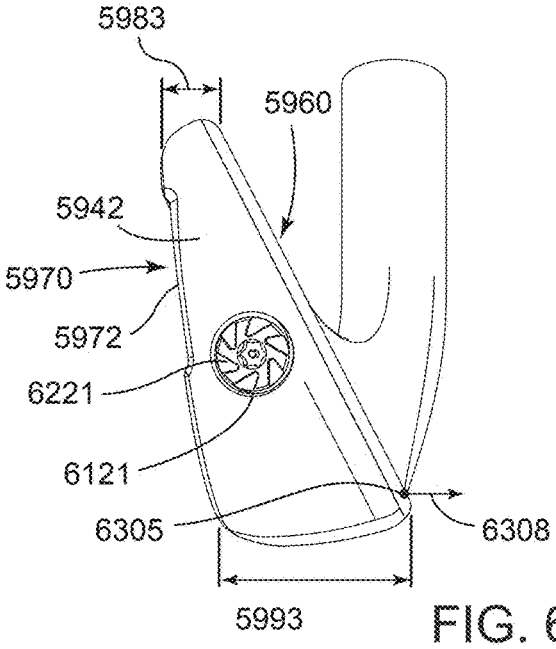
Figure 65:
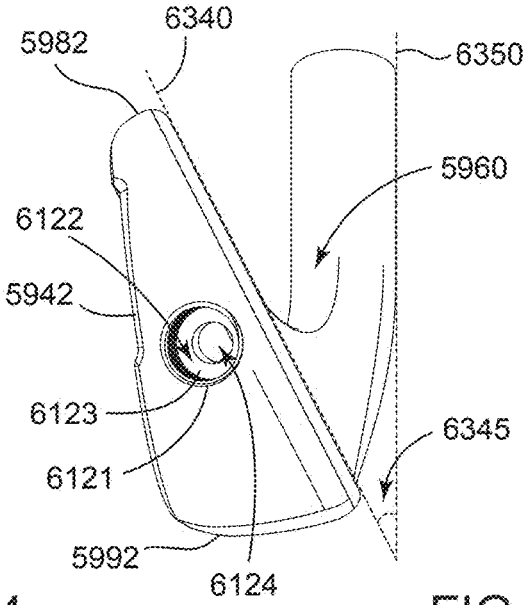

In one example, as illustrated in FIG. 64, a top rail width 5983, which may be defined as a distance between the back wall portion 5972 and the face portion 5962 at the top portion edge 5982, may have the same range of values as the top rail width 183 of the golf club head 100, and a sole width 5993, which may be defined as a distance between the back wall portion 5972 and the face portion 5962 at the sole portion edge 5992, may have the same range of values as the top rail width 183 and the sole width 193, respectively, of the golf club head 100 as described herein to place the center of gravity of the golf club head 5900 relatively low or as low as possible while complying with rules established by one or more golf governing bodies to provide optimum performance for the golf club head 5900. The apparatus, methods, and articles of manufacture described herein are not limited in this regard.

The body portion 5910 may include one or more ports, which may be exterior ports and/or interior ports (e.g., located inside the body portion 5910). The one or more ports may be at any location on the body portion 5910. The inner walls of the body portion 5910 that define the interior cavity 6010 may include one or more ports. In one example, as illustrated in FIGS. 59-75, the body portion 5910 may include a first port 6121 at the toe portion edge 5942, a second port 6131 in the second mid-back-wall portion 6034, a third port 6141 inside the body portion 5910, and a fourth port 6151 in the first mid-back-wall portion 6032. Accordingly, the first port 6121, the second port 6131, and the fourth port 6151 may be external ports, i.e., having port openings on an external surface of the body portion 5910, whereas the third port 6141 may be an internal port having a port opening on one or more internal walls of the body portion 5910 that define the interior cavity 6010. The body portion 5910 may include ports that may be similar in many respects to any of the ports of any of the golf club heads described herein or described in any of the incorporated by reference patent documents. The apparatus, methods, and articles of manufacture described herein are not limited in this regard.

In one example, as illustrated in FIGS. 59-75, a portion of the first port 6121 may be above the horizontal midplane 6320 and a portion of the first port 6121 may be below the horizontal midplane 6320. The first port 6121 may include a first port first opening 6122 on the toe portion edge 5942, first port wall 6123 that extend from the first port first opening 6122 toward the heel portion 5950, and a first port second opening 6124 that connects the first port first opening 6122 to the interior cavity 6010. The first port second opening 6124 may have a smaller diameter than the first port first opening 6122 to define a ledge portion or shoulder 6125 inside the first port 6121. In another example, the first port 6121 may be below the horizontal midplane 6320. In another example, the first port 6121 may be above the horizontal midplane 6320. In another example, the first port 6121 may not be connected to the interior cavity 6010. In another example, the first port wall 6123 may not include any wall structures, threads, grooves, projections, or channels. In another example, as illustrated in FIGS. 59-75, the first port 6121 may be cylindrical and the first port wall 6123 may be threaded to receive a correspondingly threaded object. In another example, the first port 6121 may not be cylindrical. In yet another example, the first port 6121 may be at any location on the back wall portion 5972. The apparatus, methods, and articles of manufacture described herein are not limited in this regard.

In one example, as illustrated in FIGS. 59-75, the second port 6131 may be located below the horizontal midplane 6320 and in the second mid-back-wall portion 6034. Accordingly, the second port 6131 may be located below the horizontal midplane 6320 and proximate to the heel portion edge 5952. The second port 6131 may include a second port opening 6132 and a second port wall 6133 that extends from the second port opening 6132 to a second port bottom 6134. The second port 6131 may be connected to interior cavity 6010 by a passage 6135 that extends from the second port wall 6133 to the interior cavity 6010. In another example, the second port 6131 may be above the horizontal midplane 6320. In another example, a portion of the second port 6131 may be above the horizontal midplane 6320, and a portion of the second port 6131 may be below the horizontal midplane. In another example, the second port 6131 may be not be connected to the interior cavity 6010. In another example, the second port wall 6133 may not include any wall structures, threads, grooves, projections, or channels. In another example, as illustrated in FIGS. 59-75, the second port 6131 may be cylindrical and the second port wall 6133 may be threaded to receive a correspondingly threaded object. In yet another example, the second port 6131 may not be cylindrical. The apparatus, methods, and articles of manufacture described herein are not limited in this regard.

In one example, as illustrated in FIGS. 59-75, the third port 6141 may define a recess or cavity in the body portion 5910 located on the lower back wall portion 6022 at or proximate to a transition region between the toc portion edge 5942 and the sole portion edge 5992, which may include being at or proximate to portions of the toc portion edge 5942 and the sole portion edge 5992. The third port 6141 may include a third port opening 6142 that opens to the interior cavity 6010, a third port wall 6143, and a third port bottom 6144. As illustrated in the example of FIGS. 59-75, the third port 6141 may be shaped to closely correspond to a shape of the toc portion edge 5942 and the sole portion edge 5992 at or proximate to the transition region between the toe portion edge 5942 and the sole portion edge 5992. Accordingly, the third port 6141 may be in the body portion 5910 as close as possible to the toe portion edge 5942 and the sole portion edge 5992. The apparatus, methods, and articles of manufacture described herein are not limited in this regard.

In one example as illustrated in FIGS. 59-75, the fourth port 6151 may be located above the horizontal midplane 6320 and at the first mid-back-wall portion 6032. The fourth port 6151 may have a first port first opening 6122 on the first mid-back-wall portion 6032 that may be raised, coplanar, or recessed relative to portions of the first mid-back-wall portion 6032 that surround the first port first opening 6122. In one example, as illustrated in FIGS. 59-75, the first port first opening 6122 may be inside a recessed portion 6266 on the first mid-back-wall portion 6032. The fourth port 6151 may be cylindrical and extend from the fourth port first opening 6152 to the interior cavity at a fourth port second opening 6154 to connect to the interior cavity 6010. Accordingly, the fourth port first opening 6152 may provide access to the interior cavity 6010 from outside of the body portion 5910 via the fourth port second opening 6154. As illustrated in FIGS. 59-75, the fourth port 6151 may have a circular cross section (i.e., cylindrical port). In another example, the fourth port 6151 may be elliptical. In yet another example, the fourth port 6151 may have any shape. In one example, as illustrated in FIGS. 59-75, the recessed portion 6266 may be configured to receive a cover portion or a badge 6268 to cover the fourth port first opening 6152. The badge 6268 may be similar in many respects to the badge 428 as described herein such that in one example the badge 6268 may display one or more alphanumeric characters, symbols, shapes or other visual marks to signify a particular feature of or information about of the golf club head 5900 and/or be secured in the recessed portion 6266. In another example, the fourth port 6151 may be closed with a mass portion that may be constructed from a material having a different density than a material of the body portion 5910. In yet another example, the fourth port 6151 may be closed with a mass portion that may be constructed from a material having the same density as a material of the body portion 5910. The apparatus, methods, and articles of manufacture described herein are not limited in this regard.

The golf club head 5900 may include one or more mass portions (e.g., weight portion(s)) at any location on the body portion 5910. The one or more mass portions may be integral with the body portion 5910 or separate mass portion(s) that may be coupled to the body portion 5910 at any exterior or interior location on the body portion 5910. In the illustrated example of FIGS. 59-75, the body portion 5910 may include a first mass portion 6221, a second mass portion 6231, and a third mass portion 6241. In one example, as illustrated in FIG. 67, each of the first mass portion 6221 and the second mass portion 6231 may be cylindrical and include a threaded shaft portion 6226 and a head portion 6227, which may include a tool engaging portion 6228. The third mass portion 6241 may have a shape that may correspond to the shape of the third port 6141. In another example, the first and second mass portions may be similar to any of the mass portions described herein or described in U.S. Pat. Nos. 11,369,847, 11,400,352, and 11,707,655, which are incorporated by reference herein. The apparatus, methods, and articles of manufacture described herein are not limited in this regard.

In one example, as illustrated in FIGS. 59-75, the first port 6121 may be configured to receive the first mass portion 6221, and the second port 6131 may be configured to receive the second mass portion 6231. In the illustrated example of FIGS. 59-75, the first mass portion 6221 and the second mass portion 6231 may have identical or similar dimensions such that the first port 6121 and the second port 6131 may interchangeably receive the first mass portion 6221 and the second mass portion 6231. The first mass portion 6221 or the second mass portion 6231 may be secured inside the first port 6121 or the second port 6131 by being screwed into the first port 6121 or the second port 6131. The shoulder 6125 of the first port 6121 may prevent excessive insertion of the first mass portion 6221 or the second mass portion 6231 into the first port 6121. The second port bottom 6134 may prevent excessive insertion of the first mass portion 6221 or the second mass portion 6231 into the second port 6131. In another example, the first mass portion 6221 and the second mass portion 6231 may be secured inside the first port 6121 or the second port 6131 by being press fit, by using one or more adhesives, or by one or more mechanical locking methods when the first port 6121 and the second port 6131 do not have threaded walls. The apparatus, methods, and articles of manufacture described herein are not limited in this regard.

The first mass portion 6221 and the second mass portion 6231 may have different or the same material properties. In one example, the first mass portion 6221 may be constructed from a material having a higher density than the material from which the second mass portion 6231 is constructed. In another example, the first mass portion 6221 may be constructed from a material having a lower density than the material from which the second mass portion 6231 is constructed. In another example, the first mass portion 6221 and the second mass portion 6231 may be constructed from the same material. In another example, the first mass portion 6221 or the second mass portion 6231 may be constructed from a material having a higher density than the material from which the body portion 5910 is constructed. In another example, the first mass portion 6221 or the second mass portion 6231 may be constructed from a material having a lower density than the material from which the body portion 5910 is constructed. In yet another example, the first mass portion 6221 or the first mass portion 6221 may be constructed from a material having the same density as the material from which the body portion 5910 is constructed. The golf club head may include a plurality of the first mass portions 6221 and the second mass portions 6231 that may be similar in dimension to be interchangeably usable with the first port 6121 and the second port 6131 as described herein but with some or all of the plurality of the mass portions being constructed from materials having different densities. Accordingly, the weight distribution of the golf club head 5900 may be customized to provide certain performance characteristics. For example, the first port 6121 may receive a first mass portion 6221 having a greater weight than a second mass portion 6231 that may be used with the second port 6131. Accordingly, the golf club head 5900 may provide a relatively enhanced fade-type shot. In contrast, the first port 6121 may receive a first mass portion 6221 having a lower weight than a second mass portion 6231 that may be used with the second port 6131. Accordingly, the golf club head 5900 may provide a relatively enhanced draw-type shot. Thus, by using mass portions with similar or different weights as described herein, the performance of the golf club head 5900 may be customized and optimized for an individual. The apparatus, methods, and articles of manufacture described herein are not limited in this regard.

In the illustrated example of FIGS. 59-75, the third port 6141 is configured to receive the third mass portion 6241. The third mass portion 6241 may include a front portion 6242, a bottom portion 6243 and side walls 6247. The third mass portion 6141 may be secured inside the third port 6141 by being press fit, by using one or more adhesives, or by using welding or soldering. Accordingly, in one example, the bottom portion 6243 and/or side walls 6247 may engage the third port bottom 6144 or third port wall 6143, respectively, either directly or via one or more adhesives or other materials when the third mass portion 6241 is secured inside the third port 6141. In another example, the side walls 6247 may press fittingly engage the third port wall 6143 without the use of any adhesive to secure the third mass portion 6241 in the third port 6141 secured inside the third port 6141. In yet another example, the third mass portion 6241 may be inserted into the third port 6141 and the front portion 6242 may be welded, soldered, or adhered to the third port opening 6142 and/or third port wall 6143. The location of the third mass portion 6241 as described herein may lower the center of gravity and increase the moment of inertia of the golf club head 5900 to provide optimal performance. The apparatus, methods, and articles of manufacture described herein are not limited in this regard.

The third mass portion 6241 may be constructed from a material having a greater density than a material from which the body portion 5910 may be constructed. Accordingly, the third mass portion 6241 provides strategically moving mass from other portions of the body portion 5910 to the location of the third port 6141 to: 1) move the center of gravity of the golf club head 5900 to a relatively lower position, 2) move the center of gravity of the golf club head 5900 to a relatively rearward position, and/or 3) to increase the moment of inertial of the golf club head 5900 without changing the total weight of the golf club head 5900. As described herein, the location of the third port 6141 may allow placement of the third mass portion 6241 inside the body portion 5910 as close to the toe portion edge 5942 and the sole portion edge 5992 as possible to provide enhanced performance characteristics for the golf club head 5900. The apparatus, methods, and articles of manufacture described herein are not limited in this regard.

In the illustrated example of FIGS. 59-75, the third port 6141 may be defined by a cavity inside a body mass portion 6245, which may be an integral portion of the body portion 5910, formed with the body portion 5910, and/or include the same materials as the materials of the body portion 5910. The body mass portion 6245 may be located in the toe portion 5940 and may extend to the toe portion edge 5942 to increase the moment of inertial of the golf club head 5900. In the illustrated example of FIGS. 59-75, the body mass portion 6245 may extend from the top portion edge 5982 to the sole portion edge 5992 and extend into the interior cavity 6010 from the toe portion edge 5942. The shape, size, volume, and/or mass of the body mass portion 6245 may be determined to provide certain performance characteristics for the golf club head 5900. The shape, size, volume, and/or mass of the body mass portion 6245 may vary and depend on various properties of the golf club head 5900 including the loft angle 6345. The apparatus, methods, and articles of manufacture described herein are not limited in this regard.

The interior cavity 6010 may vary in width between the toc portion 5940 and the heel portion 5950. An interior cavity width 6510 may be smaller proximate to the toc portion edge 5942 between the body mass portion 6245 and the face portion 5962 than the interior cavity width 6510 at the center portion of the body portion or at the heel portion 5950. Accordingly, a greater portion of the mass of the body portion 5910 may be closer to the toe portion edge 5942 than the heel portion edge 5952 to increase the moment of inertia of the body portion 5910. In one example, the maximum value of the interior cavity width 6510 may be greater than or equal to 0.4 inch (10.16 mm) and less than or equal to 0.9 inch (22.86 mm). In another example, the maximum value of the interior cavity width 6510 may be greater than or equal to 0.5 inch (12.70 mm) and less than or equal to 0.8 inch (20.32 mm). In yet another example, the maximum value of the interior cavity width 6510 may be greater than or equal to 0.6 inch (15.24 mm) and less than or equal to 0.7 inch (17.78 mm). The apparatus, methods, and articles of manufacture described herein are not limited in this regard.

The interior cavity 6010 may be partially or entirely filled with one or more filler materials (i.e., a cavity filling material), which may include one or more similar or different types of materials. In one example, as illustrated in FIGS. 59-75, the filler material 6412 may be a urethane elastomer material that may be curable at room temperature or higher temperatures to accelerate the curing process. In one example, the filler material 6412 may be injected into the interior cavity 6010 from the first port 6121 or the second port 6131 to fill the interior cavity 6010 partially or completely. One of the first port 6121 or the second port 6131 that is not used for injecting the filler material 6412 into the interior cavity 6010 may serve as an exhaust port to allow the air that is displaced in the interior cavity 6010 by the filler material to exit the interior cavity 6010. Accordingly, as illustrated in FIGS. 59-75, the filler material 6412 may be molded in the shape of the interior cavity 6010. After injection of the filler material 6412 into the interior cavity 6010, the filler material 6412 may be allowed to cure. In one example, the filler material 6412 may cure at room temperature. In another example, the filler material 6412 may be cured at 50 degrees Celsius. In another example, the filler material 6412 may be cured at 70 degrees Celsius. In yet another example, the filler material 6412 may be cured at 80 degrees Celsius. In another example, the filler material 6412 may be similar to any of the filler materials described herein or in any of the incorporated by reference patent documents. In another example, the interior cavity 6010 may be filled with a first filler material and a second filler material that may be similar to the first filler material and the second filler material of any of the golf club heads described in any of the incorporated by reference patent documents. In yet another example, the filler material 6412 may be separately molded in the shape of the all or portions of interior cavity 6010 and inserted into the interior cavity 6010. The apparatus, methods, and articles of manufacture described herein are not limited in this regard.

In one example, the golf club head 5900 may have a total weight of greater than or equal to 5980 grams and less than or equal to 6140 grams. In another example, the golf club head 5900 may have a total weight of greater than or equal to 6020 grams and less than or equal to 6100 grams. In yet another example, the golf club head 5900 may have a total weight of greater than or equal to 6050 grams and less than or equal to 6070 grams. In one example, the weight of the filler material may be greater than or equal to 15 grams and less than or equal to 35 grams. In another example, the weight of the filler material may be greater than or equal to 22 grams and less than or equal to 30 grams. In yet another example, the weight of the filler material may be greater than or equal to 22 grams and less than or equal to 28 grams. The total weight of the filler material 6412 may be expressed as a percentage of the total weight of the golf club head 5900. Accordingly, the weight of the filler material may comprise greater than or equal to 5% and less than or equal to 19% of the total weight of the golf club head 5900. The apparatus, methods, and articles of manufacture described herein are not limited in this regard.

As described herein, the interior cavity 6010 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head), (ii) provide structural support for the face portion, and/or (iii) optimize ball travel distance, ball speed, ball launch angle, ball spin rate, ball peak height, ball landing angle and/or ball dispersion. The interior cavity 6010 may be filled with a filler material such that the back surface 5966 of the face portion is covered with the filler material. Accordingly, the filler material may provide structural support for the relatively thinner portions of the face portion 5962.

In one example, the COR of the golf club head 5900 may be determined to be at a maximum or a near a maximum value permitted by a certain golf governing body such as the United States Golf Association (USGA). In one example, the COR of the golf club head 5900 may be greater than or equal to 0.80 and less than or equal to 0.86. In another example, the COR of the golf club head 5900 may be greater than or equal to 0.82 and less than or equal to 0.85. In yet another example, the COR of the golf club head may be greater than or equal to 0.82 and less than or equal to a COR value that complies with the maximum COR value allowed by a golf governing body. The apparatus, methods, and articles of manufacture described herein are not limited in this regard.

In the illustrated example of FIGS. 59-75, the golf club head 5900 may include one or a plurality of groove portions on the back wall portion 5972, which may be defined by groove portions on an inner surface (i.e., the surface of the back wall portion 5972 defining the interior cavity 6010) of the back wall portion 5972. The one or the plurality groove portions (e.g., generally shown as groove portions 6601, 6602, 6603, 6604, 6605, 6606, 6607, and 6608) on the back wall portion 5972 as described herein may allow increased bending or deflection of the back wall portion 5972 at certain locations on the back wall portion 5972 during a strike on the face portion 5962 without compromising the structural integrity of the back wall portion 5972. Accordingly, the rebounding of the back wall portion 5972 as a result of the increased bending or deflection of the back wall portion 5972 may increase ball speed. The apparatus, methods, and articles of manufacture described herein are not limited in this regard.

Figure 66:
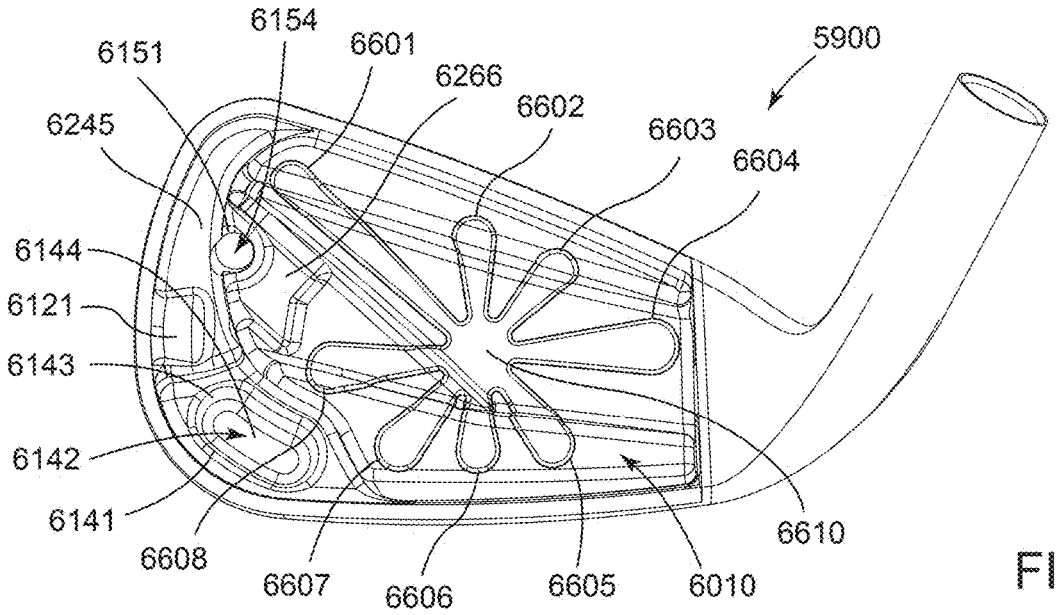
Figure 67:
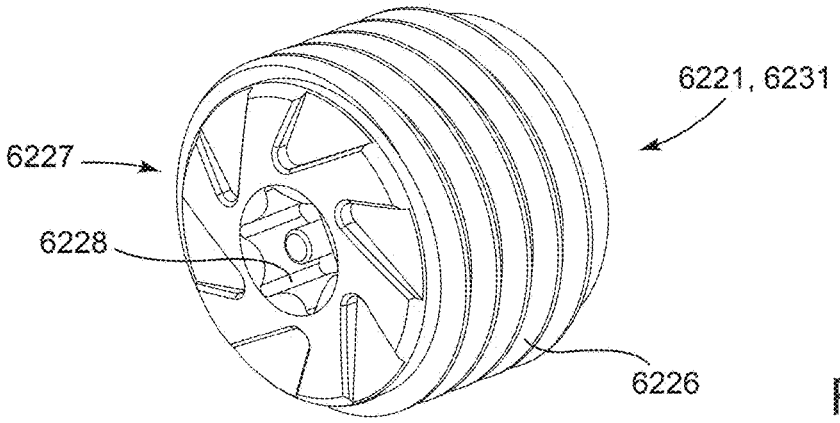
Figure 68:
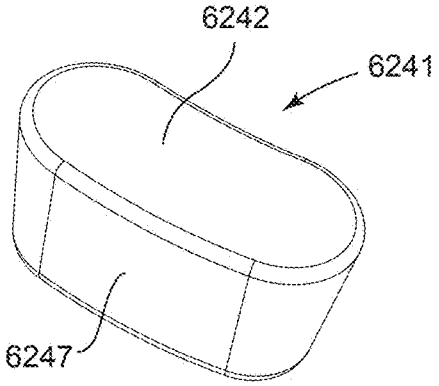
Figure 69:
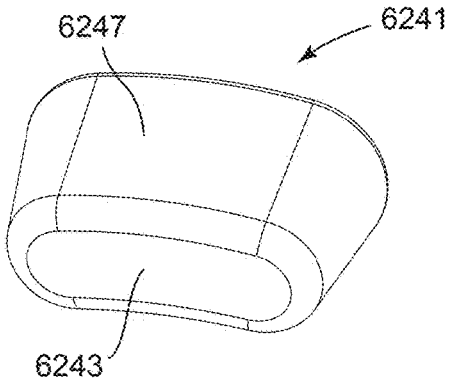
Figure 70:
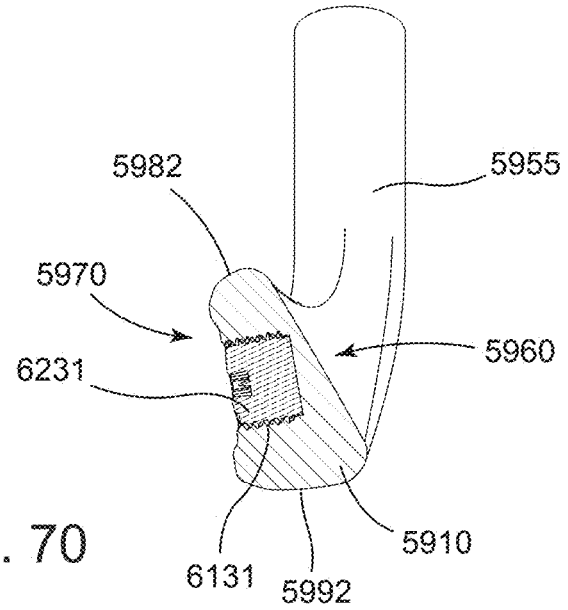

In one example, as illustrated in FIG. 66, the plurality of groove portions may include eight groove portions, which are shown groove portions 6601, 6602, 6603, 6604, 6605, 6606, 6607, and 6608, and a center groove portion 6610. Groove portions 6602 and 6606 may extend vertically in opposite directions from the center groove portion 6610 toward the top portion edge 5982 and the sole portion edge 5992, respectively. Groove portions 6604 and 6608 may extend horizontally in opposite directions from the center groove portion 6610 toward the heel portion edge 5952 and the toe portion edge 5942, respectively. Groove portions 6601 and 6605 may extend diagonally in opposite directions from the center groove portion 6610 toward the toc portion side of the top portion edge 5982 and heel portion side of the sole portion edge 5992, respectively. Groove portions 6603 and 6607 may extend diagonally in opposite directions from the center groove portion 6610 toward the heel portion side of the top portion edge 5982 and toe portion side of the sole portion edge 5992, respectively. The outward extending arrangement of the groove portions from the center groove portion may direct the rebound energy of the back wall portion 5972 toward a center portion of the face portion 5962 or the ball strike region of the face portion 5962. The depths and/or widths of the groove portions and the center groove portion 6610 may be similar to the width and depth of the groove portions illustrated in FIGS. 54-58 and described herein. While the above example may describe a particular number of groove portions, the back wall portion 5972 may include any number of radially arranged groove portions (e.g., two, three, four or more number of groove portions). In one example, any of the groove portions 6601, 6602, 6603, 6604, 6605, 6606, 6607, or 6608 may have a cross-sectional shape that is illustrated in FIGS. 55-58 and discussed herein. In another example, the back wall portion 5972 may have a groove portion configuration like the groove portion configuration shown in FIG. 54 and described herein. In yet another example, the back wall portion 5972 may have a groove portion configuration that may be like any of the configurations of the rib portions shown in FIGS. 34-36, and 41-46. The apparatus, methods, and articles of manufacture described herein are not limited in this regard.

In the example of FIGS. 76-90, a golf club head 7600 may include a body portion 7610 having a toe portion 7640 with a toe portion edge 7642, a heel portion 7650 with a heel portion edge 7652 that may include a hosel portion 7655. A golf club shaft that may be similar to the shaft 92 of FIG. 1 may be coupled at one end to the hosel portion 7655 and coupled at the opposite end to a golf club grip that may be similar to the grip 94 of FIG. 1 to form a golf club such as the golf club 90 of FIG. 1. The body portion 7610 may further include a front portion 7660, a back portion 7670 with a back wall portion 7672, a top portion 7680 with a top portion edge 7682, and a sole portion 7690 with a sole portion edge 7692. The toc portion 7640, the heel portion 7650, the front portion 7660, the back portion 7670, the top portion 7680, and/or the sole portion 7690 may partially overlap. The toc portion edge 7642, the heel portion edge 7652, the top portion edge 7682, and the sole portion edge 7692 may define a periphery or boundary of the body portion 7610. The body portion 7610 may be constructed as a hollow body to define an interior cavity 7710. The golf club head 7600 may be any type of golf club head described herein, such as, for example, an iron-type golf club head or a wedge-type golf club head. The volume of the golf club head 7600, the materials of construction of the golf club head 7600, and/or any components thereof may be similar to any of the golf club heads described herein and/or described in any of the incorporated by reference patent documents. The golf club head 7600 may be manufactured by any of the golf club head manufacturing methods described herein or described in any of the incorporated by reference patent documents. The apparatus, methods, and articles of manufacture described herein are not limited in this regard.

The golf club head 7600 may include a face portion 7662 (i.e., the strike face) that may be integrally formed with the body portion 7610 (e.g., a single unitary piece) or formed as a separate piece coupled (e.g., directly or indirectly, adhesively, mechanically, by welding, and/or by soldering) to the front portion 7660. The face portion 7662 may include a front surface 7664 and a back surface 7666. The front surface 7664 may include front grooves 7668 that may extend between the toc portion 7640 and the heel portion 7650. The front grooves 7668 may be similar in many respects to the front grooves of any of the golf club heads described herein or described in any of the incorporated by reference patent documents. The back surface 7666 of the face portion 7662 may include one or more grooves, slots, channels, depressions, or recesses. In one example, the grooves on the back surface 7666 may be similar in many respects to any of the back grooves described herein such as the back grooves shown in FIGS. 28 and 29. In another example, the grooves on the back surface 7666 may be similar to any of the back grooves described in U.S. Pat. Nos. 10,449,428 and 11,400,352, which are incorporated by reference herein. In another example, the back surface 7666 may not include any grooves, slots, channels, depressions, or recesses. All features, properties, and characteristics of the face portion 7662 including any front grooves and/or back grooves, the attachment of the face portion 7662 to the body portion 7610, and/or manufacturing of the face portion 7662 with the body portion 7610 may be similar in many respects to any of the face portions described herein or described in any of the incorporated by reference patent documents. The apparatus, methods, and articles of manufacture described herein are not limited in this regard.

The descriptions and configurations of the coordinate system, ground plane, horizontal midplane, top plane, and a loft angle between a loft plane and a vertical plane of the golf club head 100 equally apply to the golf club head 7600. Accordingly, the golf club head 7600 may include a coordinate system having an origin 8005, an x-axis 8006, a y-axis 8007, and a z-axis 8008; and the golf club head 7600 may be associated with a ground plane 8010, a horizontal midplane 8020, a top plane 8030, and a loft plane 8040 having a loft angle 8045 (i.e., loft angle of the face portion 7662) relative to a vertical plane 8050. The apparatus, methods, and articles of manufacture described herein are not limited in this regard.

The back wall portion 7672 may include an upper back wall portion 7720, a lower back wall portion 7722, and a middle back wall portion 7730 between the upper back wall portion 7720 and the lower back wall portion 7722. The middle back wall portion 7730 may extend from a location at or proximate to the toe portion edge 7642 to a location at or proximate to the heel portion edge 7652. The middle back wall portion 7730 may be recessed relative to the upper back wall portion 7720 and the lower back wall portion 7722. The middle back wall portion 7730 may include a first mid-back-wall portion 7732 extending from a location at or proximate to the toc portion edge 7642 toward the heel portion edge 7652, a second mid-back-wall portion 7734 extending from a location at or proximate to the heel portion edge 7652 toward the toc portion edge 7642, and a third mid-back-wall portion 7736 that may extend between the first mid-back-wall portion 7732 and the second mid-back-wall portion 7734. The third mid-back-wall portion 7736 may be recessed relative to the first mid-back-wall portion 7732 and the second mid-back-wall portion 7734 as illustrated in FIGS. 76-90. In one example, an interior surface of the back wall portion 7672 may include one or more groove portions and/or one or more rib portions that may be similar to any of the back wall groove portions and back wall rib portions, respectively, described herein or described in any of the incorporated by reference patent documents. The apparatus, methods, and articles of manufacture described herein are not limited in this regard.

Figure 79:
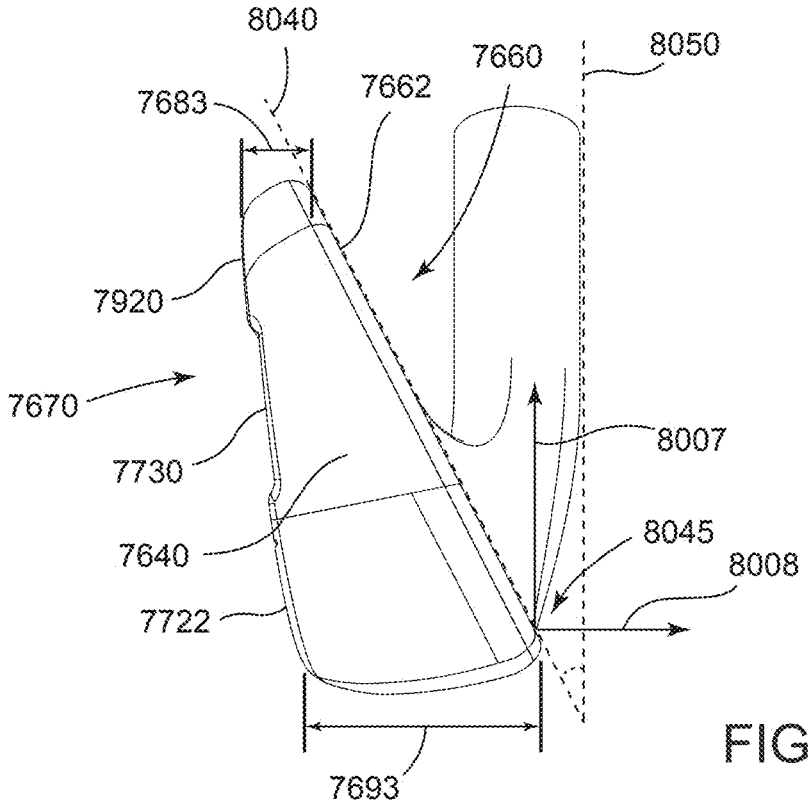
Figure 80:
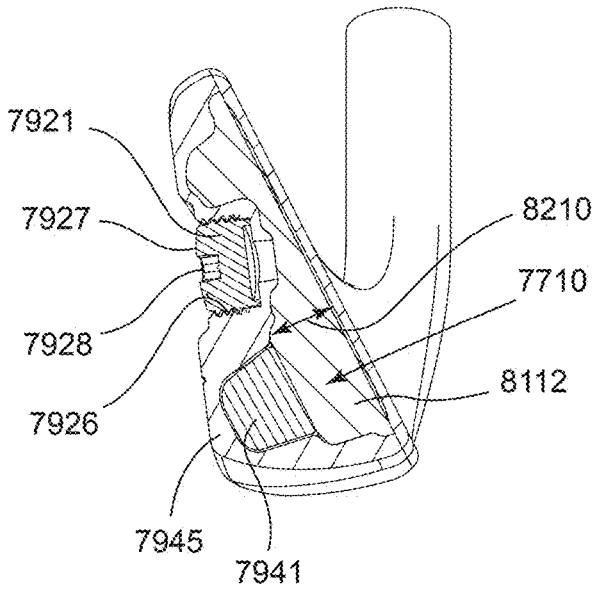
Figure 81:
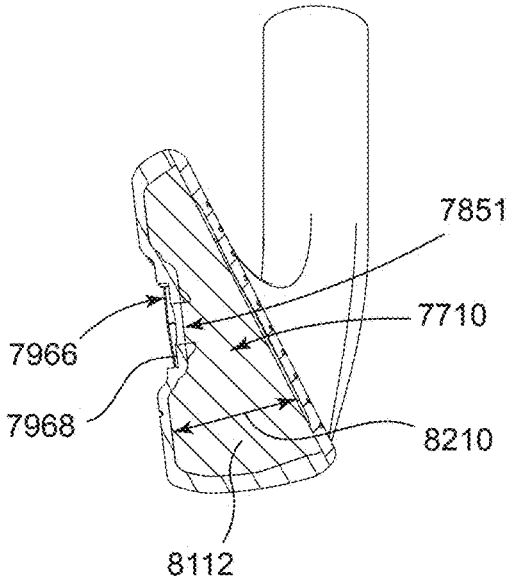
Figure 82:
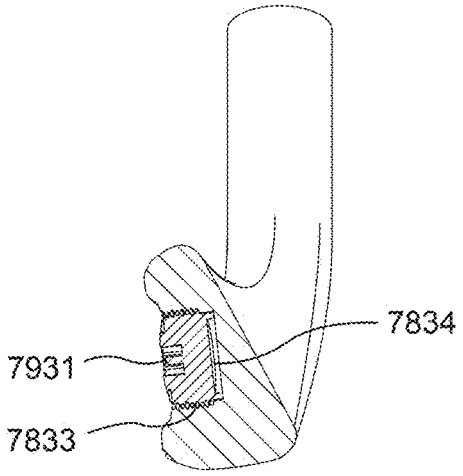
Figure 83:
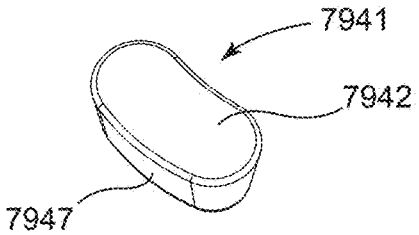
Figure 84:
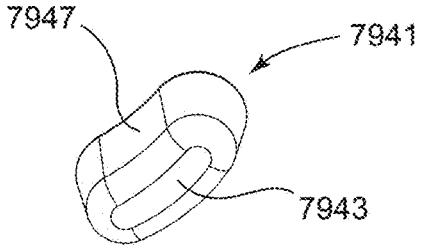

In one example, as illustrated in FIG. 79, a top rail width 7683, which may be defined as a distance between the back wall portion 7672 and the face portion 7662 at the top portion edge 7682, may have the same range of values as the top rail width 183 of the golf club head 100, and a sole width 7693, which may be defined as a distance between the back wall portion 7672 and the face portion 7662 at the sole portion edge 7692, may have the same range of values as the top rail width 183 and the sole width 193, respectively, of the golf club head 100 as described herein to place the center of gravity of the golf club head 7600 relatively low or as low as possible while complying with rules established by one or more golf governing bodies to provide optimum performance for the golf club head 7600. The apparatus, methods, and articles of manufacture described herein are not limited in this regard.

The body portion 7610 may include one or more ports, which may be exterior ports and/or interior ports (e.g., located inside the body portion 7610). The one or more ports may be at any location on the body portion 7610. The inner walls of the body portion 7610 that define the interior cavity 7710 may include one or more ports. In one example, as illustrated in FIGS. 76-90, the body portion 7610 may include a first port 7821 in the first mid-back-wall portion 7732 and proximate to the toe portion edge 7642, a second port 7831 in the second mid-back-wall portion 7734 and proximate to the heel portion edge 7652, a third port 7841 inside the body portion 7610, and a fourth port 7851 in the third mid-back-wall portion 7736. Accordingly, the first port 7821, the second port 7831, and the fourth port 7851 may be external ports, i.e., having port openings on an external surface of the body portion 7610, whereas the third port 7841 may be an internal port having a port opening on one or more internal walls of the body portion 7610 that define the interior cavity 7710. The body portion 7610 may include ports that may be similar in many respects to any of the ports of any of the golf club heads described herein or described in any of the incorporated by reference patent documents. The apparatus, methods, and articles of manufacture described herein are not limited in this regard.

In one example, as illustrated in FIGS. 76-90, a portion of the first port 7821 may be above the horizontal midplane 8020 and a portion of the first port 7821 may be below the horizontal midplane 8020. The first port 7821 may include a first port first opening 7822, first port wall 7823 that extend from the first port first opening 7822 toward the front portion 7660, and a first port second opening 7824 that connects the first port first opening 7822 to the interior cavity 7710. The first port second opening 7824 may have a smaller diameter than the first port first opening 7822 to define a ledge portion or shoulder 7825 inside the first port 7821. In another example, the first port 7821 may be below the horizontal midplane 8020. In another example, the first port 7821 may be above the horizontal midplane 8020. In another example, the first port 7821 may not be connected to the interior cavity 7710. In another example, the first port wall 7823 may not include any wall structures, threads, grooves, projections, or channels. In another example, as illustrated in FIGS. 76-90, the first port 7821 may be cylindrical and the first port wall 7823 may be threaded to receive a correspondingly threaded object. In another example, the first port 7821 may not be cylindrical. In yet another example, the first port 7821 may be at any location on the back wall portion 7672. The apparatus, methods, and articles of manufacture described herein are not limited in this regard.

In one example, as illustrated in FIGS. 76-90, the second port 7831 may be located below the horizontal midplane 8020 and in the second mid-back-wall portion 7734. Accordingly, the second port 7831 may be located below the horizontal midplane 8020 and proximate to the heel portion edge 7652. The second port 7831 may include a second port opening 7832 and a second port wall 7833 that extends from the second port opening 7832 to a second port bottom 7834. In the example of FIGS. 76-90, the second port 7831 is not connected to interior cavity 7710. In another example, the second port 7831 may be connected to the interior cavity 7710 with one or more passages that may be similar to any of the ports described herein or described in any of the incorporated by reference patent documents. In another example, the second port 7831 may be above the horizontal midplane 8020. In another example, a portion of the second port 7831 may be above the horizontal midplane 8020, and a portion of the second port 7831 may be below the horizontal midplane. In another example, the second port wall 7833 may not include any wall structures, threads, grooves, projections, or channels. In another example, as illustrated in FIGS. 76-90, the second port 7831 may be cylindrical and the second port wall 7833 may be threaded to receive a correspondingly threaded object. In yet another example, the second port 7831 may not be cylindrical. The apparatus, methods, and articles of manufacture described herein are not limited in this regard.

In one example, as illustrated in FIGS. 76-90, the third port 7841 may define a recess or cavity in the body portion 7610 located on the lower back wall portion 7722 at or proximate to a transition region between the toe portion edge 7642 and the sole portion edge 7692, which may include being at or proximate to portions of the toc portion edge 7642 and the sole portion edge 7692. The third port 7841 may include a third port opening 7842 that opens to the interior cavity 7710, a third port wall 7843, and a third port bottom 7844. As illustrated in the example of FIGS. 76-90, the third port 7841 may be shaped to closely correspond to a shape of the toc portion edge 7642 and the sole portion edge 7692 at or proximate to the transition region between the toc portion edge 7642 and the sole portion edge 7692. Accordingly, the third port 7841 may be in the body portion 7610 as close as possible to the toc portion edge 7642 and the sole portion edge 7692. The apparatus, methods, and articles of manufacture described herein are not limited in this regard.

In one example as illustrated in FIGS. 76-90, the fourth port 7851 may be located at the third mid-back-wall portion 7736. In one example, as illustrated in FIGS. 76-90, the fourth port 7851 may be inside a recessed portion 7966 on the third mid-back-wall portion 7736. The fourth port 7851 may be cylindrical and extend from the recessed portion 7966 to the interior cavity 7710. Accordingly, the fourth port 7851 may provide access to the interior cavity 7710 from outside of the body portion 7610 via the recessed portion 7966. As illustrated in FIGS. 76-90, the fourth port 7851 may have a circular cross section (i.e., cylindrical port). In another example, the fourth port 7851 may be elliptical. In yet another example, the fourth port 7851 may have any shape. In one example, as illustrated in FIGS. 76-90, the recessed portion 7966 may be configured to receive a cover portion or a badge 7968 to cover the fourth port 7851. The badge 7968 may be similar in many respects to the badge 428 as described herein such that in one example the badge 7968 may display one or more alphanumeric characters, symbols, shapes or other visual marks to signify a particular feature of or information about of the golf club head 7600 and/or be secured in the recessed portion 7966. In another example, the fourth port 7851 may be closed with a mass portion that may be constructed from a material having a different density than a material of the body portion 7610. In yet another example, the fourth port 7851 may be closed with a mass portion that may be constructed from a material having the same density as a material of the body portion 7610. The apparatus, methods, and articles of manufacture described herein are not limited in this regard.

The golf club head 7600 may include one or more mass portions (e.g., weight portion(s)) at any location on the body portion 7610. The one or more mass portions may be integral with the body portion 7610 or separate mass portion(s) that may be coupled to the body portion 7610 at any exterior or interior location on the body portion 7610. In the illustrated example of FIGS. 76-90, the body portion 7610 may include a first mass portion 7921, a second mass portion 7931, and a third mass portion 7941. Each of the first mass portion 7921 and the second mass portion 7931 may be cylindrical and include a threaded shaft portion 7926 and a head portion 7927, which may include a tool engaging portion 7928. The third mass portion 7941 may have a shape that may correspond to the shape of the third port 7841. In another example, the first and second mass portions may be similar to any of the mass portions described herein such as the mass portion 6221, or the mass portion 6231, or any of the mass portions described in U.S. Pat. Nos. 11,369,847, 11,400,352, and 11,707,825, which are incorporated by reference herein. The apparatus, methods, and articles of manufacture described herein are not limited in this regard.

In one example, as illustrated in FIGS. 76-90, the first port 7821 may be configured to receive the first mass portion 7921, and the second port 7831 may be configured to receive the second mass portion 7931. In the illustrated example of FIGS. 76-90, the first mass portion 7921 and the second mass portion 7931 may have identical or similar dimensions such that the first port 7821 and the second port 7831 may interchangeably receive the first mass portion 7921 and the second mass portion 7931. The first mass portion 7921 or the second mass portion 7931 may be secured inside the first port 7821 or the second port 7831 by being screwed into the first port 7821 or the second port 7831. The shoulder 7825 of the first port 7821 may prevent excessive insertion of the first mass portion 7921 or the second mass portion 7931 into the first port 7821. The second port bottom 7834 may prevent excessive insertion of the first mass portion 7921 or the second mass portion 7931 into the second port 7831. In another example, the first mass portion 7921 and the second mass portion 7931 may be secured inside the first port 7821 or the second port 7831 by being press fit, by using one or more adhesives, or by one or more mechanical locking methods when the first port 7821 and the second port 7831 do not have threaded walls. The apparatus, methods, and articles of manufacture described herein are not limited in this regard.

The first mass portion 7921 and the second mass portion 7931 may have different or the same material properties. In one example, the first mass portion 7921 may be constructed from a material having a higher density than the material from which the second mass portion 7931 is constructed. In another example, the first mass portion 7921 may be constructed from a material having a lower density than the material from which the second mass portion 7931 is constructed. In another example, the first mass portion 7921 and the second mass portion 7931 may be constructed from the same material. In another example, the first mass portion 7921 or the second mass portion 7931 may be constructed from a material having a higher density than the material from which the body portion 7610 is constructed. In another example, the first mass portion 7921 or the second mass portion 7931 may be constructed from a material having a lower density than the material from which the body portion 7610 is constructed. In yet another example, the first mass portion 7921 or the first mass portion 7921 may be constructed from a material having the same density as the material from which the body portion 7610 is constructed. The apparatus, methods, and articles of manufacture described herein are not limited in this regard.

The golf club head may include a plurality of the first mass portions 7921 and the second mass portions 7931 that may be similar in dimension to be interchangeably usable with the first port 7821 and the second port 7831 as described herein but with some or all of the plurality of the mass portions being constructed from materials having different densities. Accordingly, the weight distribution of the golf club head 7600 may be customized to provide certain performance characteristics. For example, the first port 7821 may receive a first mass portion 7921 having a greater weight than a second mass portion 7931 that may be used with the second port 7831. Accordingly, the golf club head 7600 may provide a relatively enhanced fade-type shot. In contrast, the first port 7821 may receive a first mass portion 7921 having a lower weight than a second mass portion 7931 that may be used with the second port 7831. Accordingly, the golf club head 7600 may provide a relatively enhanced draw-type shot. Thus, by using mass portions with similar or different weights as described herein, the performance of the golf club head 7600 may be customized and optimized for an individual. The apparatus, methods, and articles of manufacture described herein are not limited in this regard.

In one example, the first port 7821 and the second port 7831 may be positioned such that the first mass portion 7921 and the second mass portion 7931 are spaced apart by a relatively large distance of the span between the toe portion edge 7642 and the heel portion edge 7652. This relatively wide separation may enhance the redistribution of mass toward the perimeter of the golf club head 7600 to the moment of inertia (MOI) and improving stability and forgiveness on off-center strikes. The first mass portion 7921 and the second mass portion 7931 may be constructed from materials having the same or different densities, including materials of higher, lower, or equal density relative to the body portion 7610, as described above. When combined with the wide spatial separation, the ability to vary the density of the mass portions may further expand the range of performance tuning, allowing for precise adjustments to shot shape, feel, and overall club dynamics. Accordingly, the spatial and material configuration of the mass portions may work in concert to optimize the performance of the golf club head 7600 for a range of player preferences and swing characteristics. In one example, the first port 7821 and the second port 7831 may be positioned such that the first mass portion 7921 and the second mass portion 7931 are spaced apart by a distance greater than 50% of the span between the toc portion edge 7642 and the heel portion edge 7652. In another example, the first port 7821 and the second port 7831 may be positioned such that the first mass portion 7921 and the second mass portion 7931 are spaced apart by a distance greater than 60% of the span between the toe portion edge 7642 and the heel portion edge 7652. In another example, the first port 7821 and the second port 7831 may be positioned such that the first mass portion 7921 and the second mass portion 7931 are spaced apart by a distance greater than 75% of the span between the toc portion edge 7642 and the heel portion edge 7652. In yet another example, the first port 7821 may be on the toe portion edge 7642, as illustrated in the example of FIGS. 59-75 to maximize the distance between the first mass portion 7921 and the second mass portion 7931. The apparatus, methods, and articles of manufacture described herein are not limited in this regard.

In the illustrated example of FIGS. 76-90, the third port 7841 is configured to receive the third mass portion 7941. The third mass portion 7941 may include a front portion 7942, a bottom portion 7943 and side walls 7947. The third mass portion 7941 may be secured inside the third port 7841 by being press fit, by using one or more adhesives, or by using welding or soldering. Accordingly, in one example, the bottom portion 7943 and/or side walls 7947 may engage the third port bottom 7844 or third port wall 7843, respectively, either directly or via one or more adhesives or other materials when the third mass portion 7941 is secured inside the third port 7841. In another example, the side walls 7947 may press fittingly engage the third port wall 7843 without the use of any adhesive to secure the third mass portion 7941 in the third port 7841 secured inside the third port 7841. In yet another example, the third mass portion 7941 may be inserted into the third port 7841 and the front portion 7942 may be welded, soldered, or adhered to the third port opening 7842 and/or third port wall 7843. The location of the third mass portion 7941 as described herein may lower the center of gravity and increase the moment of inertia of the golf club head 7600 to provide optimal performance. The apparatus, methods, and articles of manufacture described herein are not limited in this regard.

The third mass portion 7941 may be constructed from a material having a greater density than a material from which the body portion 7610 may be constructed. Accordingly, the third mass portion 7941 provides strategically moving mass from other portions of the body portion 7610 to the location of the third port 7841 to: 1) move the center of gravity of the golf club head 7600 to a relatively lower position, 2) move the center of gravity of the golf club head 7600 to a relatively rearward position, and/or 3) to increase the moment of inertial of the golf club head 7600 without changing the total weight of the golf club head 7600. As described herein, the location of the third port 7841 may allow placement of the third mass portion 7941 inside the body portion 7610 as close to the toe portion edge 7642 and the sole portion edge 7692 as possible to provide enhanced performance characteristics for the golf club head 7600. The apparatus, methods, and articles of manufacture described herein are not limited in this regard.

The first mass portion 7921 and the second mass portion 7931, and in particular their locations on the golf club head 7600 (similarly, the first mass portion 6221 and the second mass portion 6231 of the golf club head 5900) as described herein may provide a high degree of customization that may allow an individual to optimize ball flight and feel based on their swing characteristics. For individuals who struggle with a slice or want to promote a draw, positioning more weight closer to the heel may help the clubface close more easily through impact. Conversely, placing more weight near the toe may help reduce a hook or encourage a fade by slowing the rate at which the face closes. The third mass portion 7941 (similarly the third mass portion 6241 of the golf club head 5900) may lower the center of gravity (CG), which may typically produce a higher launch angle and reduced spin, resulting in longer and more controlled shots. Additionally, the third mass portion 7941 may increase the moment of inertia (MOI) which may provide forgiveness and consistency.

In the illustrated example of FIGS. 76-90, the third port 7841 may be defined by a cavity inside a body mass portion 7945, which may be an integral portion of the body portion 7610, formed with the body portion 7610, and/or include the same materials as the materials of the body portion 7610. The body mass portion 7945 may be located in the toc portion 7640 and may extend to the toe portion edge 7642 to increase the moment of inertial of the golf club head 7600. In the illustrated example of FIGS. 76-90, the body mass portion 7945 may extend from the top portion edge 7682 to the sole portion edge 7692 and extend into the interior cavity 7710 from the toc portion edge 7642. The shape, size, volume, and/or mass of the body mass portion 7945 may be determined to provide certain performance characteristics for the golf club head 7600. The shape, size, volume, and/or mass of the body mass portion 7945 may vary and depend on various properties of the golf club head 7600 including the loft angle 8045. The apparatus, methods, and articles of manufacture described herein are not limited in this regard.

Figure 85:
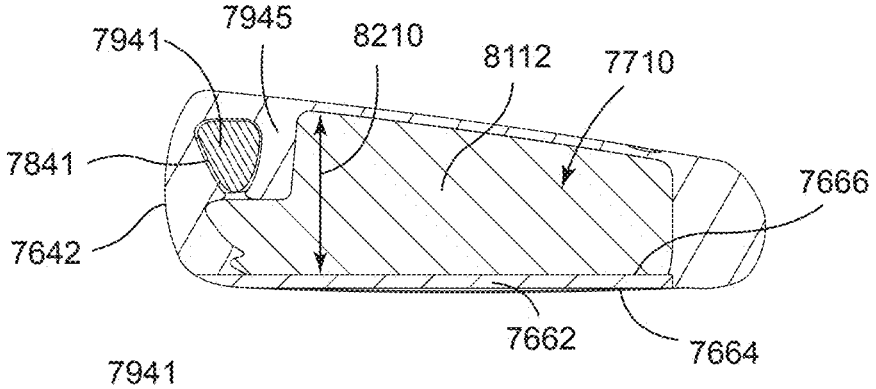
Figure 86:
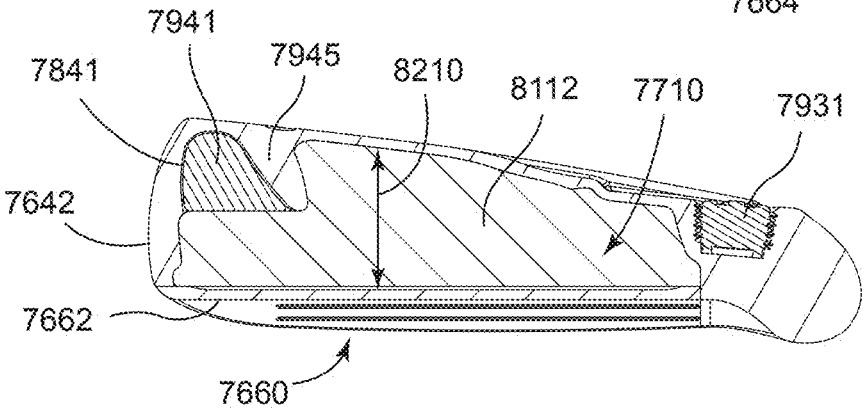
Figure 87:
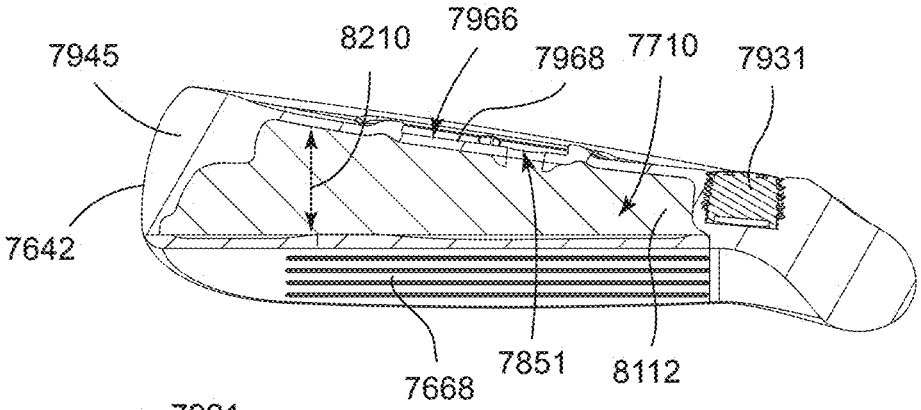
Figure 88:
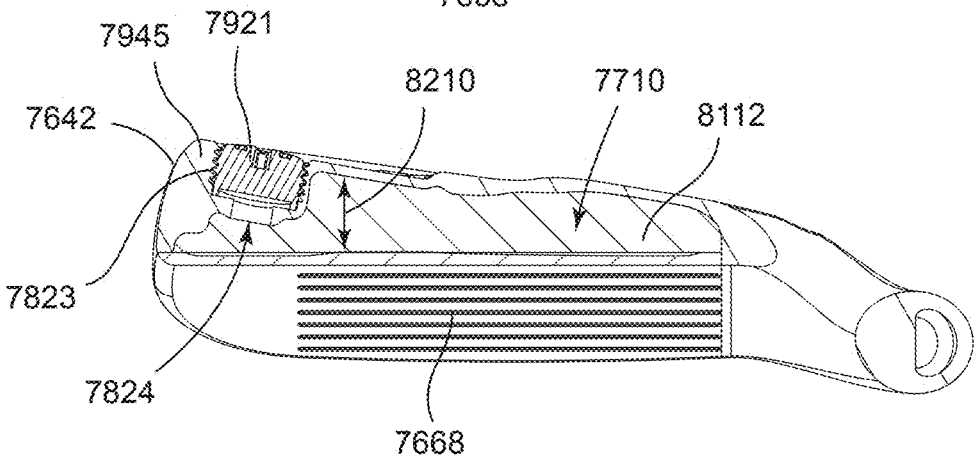
Figure 89:
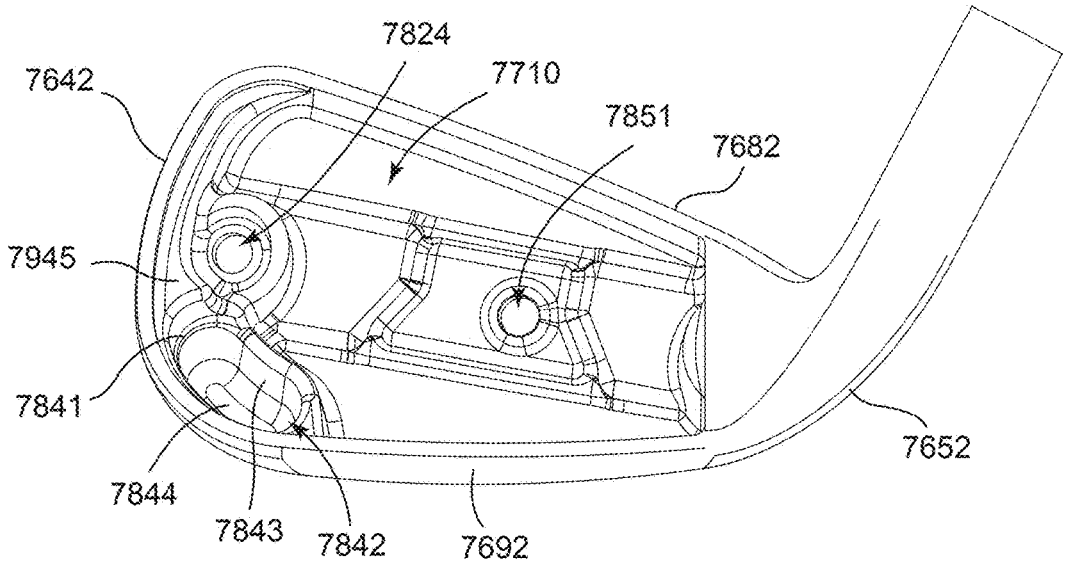
Figure 90:
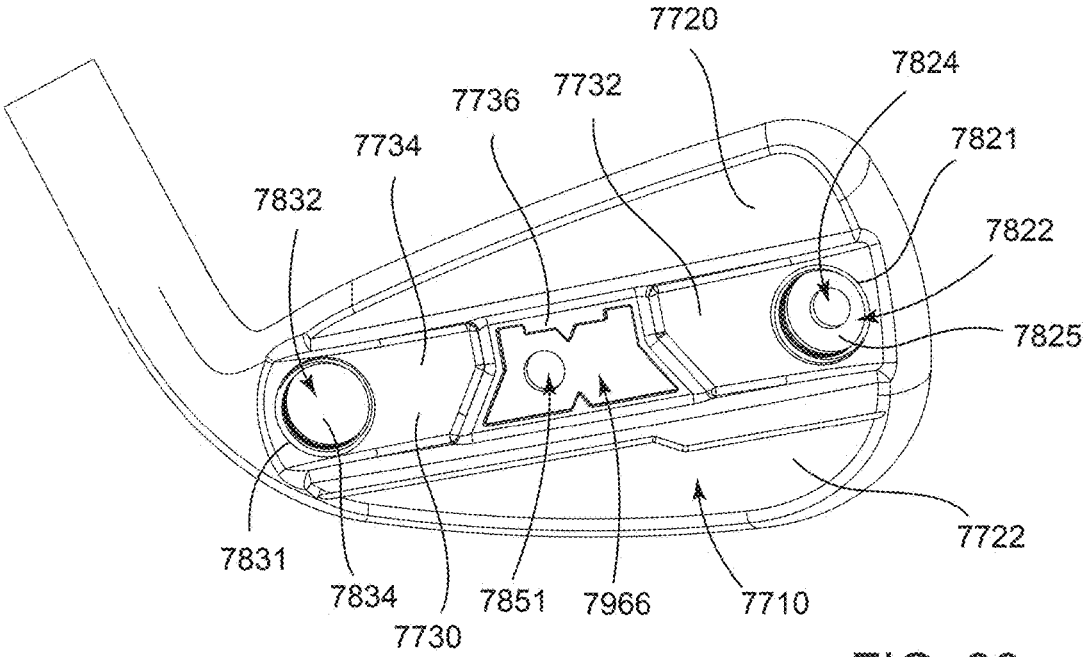

The interior cavity 7710 may vary in width between the toe portion 7640 and the heel portion 7650. An interior cavity width 8210 may be smaller proximate to the toe portion edge 7642 between the body mass portion 7945 and the face portion 7662 than the interior cavity width 8210 at the center portion of the body portion or at the heel portion 7650. Accordingly, a greater portion of the mass of the body portion 7610 may be closer to the toe portion edge 7642 than the heel portion edge 7652 to increase the moment of inertia of the body portion 7610. In one example, the maximum value of the interior cavity width 8210 may be greater than or equal to 0.4 inch (10.16 mm) and less than or equal to 0.9 inch (22.86 mm). In another example, the maximum value of the interior cavity width 8210 may be greater than or equal to 0.5 inch (12.70 mm) and less than or equal to 0.8 inch (20.32 mm). In yet another example, the maximum value of the interior cavity width 8210 may be greater than or equal to 0.6 inch (15.24 mm) and less than or equal to 0.7 inch (17.78 mm). In one example, as illustrated in FIG. 85, the interior cavity width 8210 may be at a maximum proximate to the sole portion edge 7692 and at the body mass portion 7945. The apparatus, methods, and articles of manufacture described herein are not limited in this regard.

The interior cavity 7710 may be partially or entirely filled with one or more filler materials (i.e., a cavity filling material), which may include one or more similar or different types of materials. In one example, as illustrated in FIGS. 76-90, the filler material 8112 may be a urethane elastomer material that may be curable at room temperature or higher temperatures to accelerate the curing process. In one example, the filler material 8112 may be injected into the interior cavity 7710 from the first port 7821 or the second port 7831 to fill the interior cavity 7710 partially or completely. One of the first port 7821 or the second port 7831 that is not used for injecting the filler material 8112 into the interior cavity 7710 may serve as an exhaust port to allow the air that is displaced in the interior cavity 7710 by the filler material to exit the interior cavity 7710. Accordingly, as illustrated in FIGS. 76-90, the filler material 8112 may be molded in the shape of the interior cavity 7710. After injection of the filler material 8112 into the interior cavity 7710, the filler material 8112 may be allowed to cure. In one example, the filler material 8112 may cure at room temperature. In another example, the filler material 8112 may be cured at 50 degrees Celsius. In another example, the filler material 8112 may be cured at 70 degrees Celsius. In yet another example, the filler material 8112 may be cured at 80 degrees Celsius. In another example, the filler material 8112 may be similar to any of the filler materials described herein or in any of the incorporated by reference patent documents. In another example, the interior cavity 7710 may be filled with a first filler material and a second filler material that may be similar to the first filler material and the second filler material of any of the golf club heads described in any of the incorporated by reference patent documents. In yet another example, the filler material 8112 may be separately molded in the shape of the all or portions of interior cavity 7710 and inserted into the interior cavity 7710. The apparatus, methods, and articles of manufacture described herein are not limited in this regard.

In one example, the golf club head 7600 may have a total weight of greater than or equal to 5980 grams and less than or equal to 6140 grams. In another example, the golf club head 7600 may have a total weight of greater than or equal to 6020 grams and less than or equal to 6100 grams. In yet another example, the golf club head 7600 may have a total weight of greater than or equal to 6050 grams and less than or equal to 6070 grams. In one example, the weight of the filler material may be greater than or equal to 15 grams and less than or equal to 35 grams. In another example, the weight of the filler material may be greater than or equal to 22 grams and less than or equal to 30 grams. In yet another example, the weight of the filler material may be greater than or equal to 22 grams and less than or equal to 28 grams. The total weight of the filler material 8112 may be expressed as a percentage of the total weight of the golf club head 7600. Accordingly, the weight of the filler material may comprise greater than or equal to 5% and less than or equal to 19% of the total weight of the golf club head 7600. The apparatus, methods, and articles of manufacture described herein are not limited in this regard.

As described herein, the interior cavity 7710 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head), (ii) provide structural support for the face portion, and/or (iii) optimize ball travel distance, ball speed, ball launch angle, ball spin rate, ball peak height, ball landing angle and/or ball dispersion. The interior cavity 7710 may be filled with a filler material such that the back surface 7666 of the face portion is covered with the filler material. Accordingly, the filler material may provide structural support for the relatively thinner portions of the face portion 7662.

In one example, the COR of the golf club head 7600 may be determined to be at a maximum or a near a maximum value permitted by a certain golf governing body such as the United States Golf Association (USGA). In one example, the COR of the golf club head 7600 may be greater than or equal to 0.80 and less than or equal to 0.86. In another example, the COR of the golf club head 7600 may be greater than or equal to 0.82 and less than or equal to 0.85. In yet another example, the COR of the golf club head may be greater than or equal to 0.82 and less than or equal to a COR value that complies with the maximum COR value allowed by a golf governing body. The apparatus, methods, and articles of manufacture described herein are not limited in this regard.

Any of the mass portions described herein may be constructed from a material having a greater density than one or more materials of a body portion of a golf club head. In one example, any of the mass portions described herein may be constructed from tungsten or tungsten-based materials, whereas the body portion may be constructed from one or more materials having a lower density than tungsten or tungsten-based materials such as aluminum, steel, titanium, and/or composite materials. Any of the mass portions described herein may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. Any of the mass portions described herein may be constructed from a material having a lower density than one or more materials of a body portion of a golf club head. The apparatus, methods, and articles of manufacture described herein are not limited in this regard.

Any of the golf club heads described herein may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although a particular type of club head may be depicted and described, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The body portion and/or the face portion of any of the golf club heads described herein may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. The body portion and/or the face portion may be constructed with materials that are similar to any of the body portions and/or face portions described herein or in any of the incorporated by reference patent documents. The apparatus, methods, and articles of manufacture described herein are not limited in this regard.

In one example, the area of the front surface of the face portion of any of the golf club heads described herein may be greater than or equal to 330 $mm^2$ and less than or equal to 5000 $mm^2$. In another example, the area of the front surface of the face portion of any of the golf club heads described herein may be greater than or equal to 1000 $mm^2$ and less than or equal to 5300 $mm^2$. In yet another example, the arca of the front surface of the face portion of any of the golf club heads described herein may be greater than or equal to 1500 $mm^2$ and less than or equal to 4800 $mm^2$. While the above examples may describe particular areas, the area of the front surface may greater than or less than those numbers. The apparatus, methods, and articles of manufacture described herein are not limited in this regard.

In one example, a filler material as described herein may include an elastic polymer or an elastomer material, a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties. In another example, a filler material may include low-viscosity, organic, solvent-based solutions and/or dispersions of polymers and other reactive chemicals. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. In another example, any one or more of the filler materials described herein may be formed from one or more metals or metal alloys, such as aluminum, copper, zinc, and/or titanium. A filler material not specifically described in detail herein may include one or more similar or different types of materials described herein and in any of the incorporated by reference patent documents. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference patent documents. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron. 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent." "close." "immediate." "nearby." "neighboring." etc. . . . and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a hollow body portion comprising a toe portion with a toe portion edge, a heel portion with a heel portion edge, a front portion including a face portion, a back portion with a back wall portion, a top portion with a top portion edge, a sole portion with a sole portion edge, and an interior cavity having a maximum cavity width;

a body mass portion integral with the hollow body portion and located at or proximate to the toe portion edge, the body mass portion comprising a cavity portion having an opening to the interior cavity;

a first mass portion coupled to the hollow body portion at or proximate to the toe portion edge;

a second mass portion coupled to the hollow body portion at or proximate to the heel portion edge;

a third mass portion in the cavity portion, the third mass portion having a shape different from each of the first mass portion and the second mass portion; and a filler material in at least a portion of the interior cavity, wherein the maximum cavity width is proximate to the sole portion edge and at or proximate to the body mass portion, and wherein the maximum cavity width is greater than or equal to 0.4 inch (10.16 mm) and less than or equal to 0.9 inch (22.86 mm), wherein a first portion of the first mass portion is above a horizontal midplane of the hollow body portion and a second portion of the first mass portion is below the horizontal midplane, and wherein the second mass portion is below the horizontal midplane.

2. A golf club head as defined in claim 1, wherein the third mass portion has a greater mass than the first mass portion, and wherein the third mass portion has a greater mass than the second mass portion.

3. A golf club head as defined in claim 1, wherein the filler material comprises a lower density than a material of the hollow body portion.

4. A golf club head as defined in claim 1, wherein the third mass portion is below a horizontal midplane of the hollow body portion.

5. A golf club head as defined in claim 1, wherein at least a portion of the third mass portion has a curvature similar to a curvature of the hollow body portion at or proximate to the toe portion edge.

6. A golf club head as defined in claim 1, wherein at least a portion of the third mass portion has a curvature similar to a curvature of the hollow body portion at or proximate to the sole portion edge.

7. A golf club head as defined in claim 1, wherein a portion of the back wall portion comprises visible indicia associated with the golf club head.

8. A golf club head comprising:

a hollow body portion comprising an interior cavity, a toe portion with a toe portion edge, a heel portion with a heel portion edge, a front portion, a back portion with a back wall portion, a top portion with a top portion edge, and a sole portion with a sole portion edge;

a face portion coupled to the front portion;

a first port on the back wall portion;

a second port on the back wall portion;

a body mass portion integral with the hollow body portion and located at or proximate to the toe portion edge, the body mass portion comprising a cavity portion having a third port and an opening to the interior cavity; and a first mass portion in the first port;

a second mass portion in the second port;

a third mass portion in the third port, the third mass portion having a shape different from each of the first mass portion and the second mass portion; and a filler material in at least a portion of the interior cavity, wherein a distance between the first port and the second port is greater than 50% of a distance between the toe portion edge and the heel portion edge, wherein a first portion of the first port is above a horizontal midplane of the hollow body portion and a second portion of the first port is below the horizontal midplane, and wherein the second port is below the horizontal midplane.

9. A golf club head as defined in claim 8, wherein at least one of the first port or the second port comprises a cylindrical port.

10. A golf club head as defined in claim 8, wherein the filler material comprises a non-metallic material.

11. A golf club head as defined in claim 8 further comprising a badge coupled to the back wall portion, wherein the badge is configured to display information associated with the golf club head.

12. A golf club head as defined in claim 8, wherein at least a portion of the third mass portion has a curvature similar to a curvature of the hollow body portion at or proximate to a region between the toe portion edge and the sole portion edge.

13. A golf club head as defined in claim 8, wherein the third port is below the horizontal midplane of the hollow body portion.

14. A golf club head as defined in claim 8, wherein the first port and the second port are configured to interchangeably receive the first mass portion or the second mass portion.

15. A golf club comprising:

a shaft having a first end portion and a second end portion;

a grip coupled to the first end portion; and a golf club head coupled to the second end portion, the golf club head comprising:

a hollow body portion comprising a toe portion with a toe portion edge, a heel portion with a heel portion edge, a front portion including a face portion, a back portion with a back wall portion, a top portion with a top portion edge, a sole portion with a sole portion edge, and an interior cavity having a maximum cavity width;

a body mass portion integral with the hollow body portion and located at or proximate to the toe portion edge, the body mass portion comprising a cavity portion having an opening to the interior cavity;

a first mass portion coupled to the hollow body portion;

a second mass portion coupled to the hollow body portion at a location between the first mass portion and the heel portion edge;

a third mass portion coupled to the cavity portion, the third mass portion having a shape different from each of the first mass portion and the second mass portion;

a filler material in at least a portion of the interior cavity, wherein the maximum cavity width is proximate to the sole portion edge and at or proximate to the body mass portion, and wherein a distance between the first mass portion and the second mass portion is greater than 50% of a distance between the toe portion edge and the heel portion edge, wherein a first portion of the first mass portion is above a horizontal midplane of the hollow body portion and a second portion of the first mass portion is below the horizontal midplane, and wherein the second mass portion is below the horizontal midplane.

16. A golf club as defined in claim 15, wherein the maximum cavity width is greater than or equal to 0.4 inch (10.16 mm) and less than or equal to 0.9 inch (22.86 mm).

17. A golf club as defined in claim 15 further comprising a badge coupled to the back wall portion, wherein the badge is configured to display information associated with the golf club head.

18. A golf club as defined in claim 15, wherein at least a portion of the third mass portion has a curvature similar to a curvature of the hollow body portion at or proximate to a region between the toe portion edge and the sole portion edge.

19. A golf club as defined in claim 15, wherein the filler material comprises a non-metallic material.

20. A golf club as defined in claim 15, wherein the cavity portion of the body mass portion is below a horizontal midplane of the hollow body portion.

* * * * *